US007956261B2

(12) United States Patent
Iwamoto et al.

(10) Patent No.: US 7,956,261 B2
(45) Date of Patent: Jun. 7, 2011

(54) PEDAL APPARATUS OF ELECTRONIC MUSICAL INSTRUMENT

(75) Inventors: Toshiyuki Iwamoto, Hamamatsu (JP); Mitsuru Kitajima, Hamamatsu (JP); Shigeru Muramatsu, Mori-machi (JP); Koichi Saigo, Hamamatsu (JP)

(73) Assignee: Yamaha Corporation (JP)

( * ) Notice: Subject to any disclaimer, the term of this patent is extended or adjusted under 35 U.S.C. 154(b) by 0 days.

(21) Appl. No.: 12/408,904

(22) Filed: Mar. 23, 2009

(65) Prior Publication Data

US 2009/0235803 A1 Sep. 24, 2009

(30) Foreign Application Priority Data

| | | |
|---|---|---|
| Mar. 24, 2008 | (JP) | 2008-075121 |
| Mar. 24, 2008 | (JP) | 2008-075126 |
| Jan. 13, 2009 | (JP) | 2009-004450 |
| Jan. 13, 2009 | (JP) | 2009-004455 |

(51) Int. Cl.
*G10D 3/00* (2006.01)

(52) U.S. Cl. ..... 84/299

(58) Field of Classification Search ..... 84/229, 84/225

See application file for complete search history.

(56) References Cited

U.S. PATENT DOCUMENTS 2,893,282 A * 7/1959 Searles ..... 84/313

* cited by examiner

*Primary Examiner* — Jianchun Qin

(74) *Attorney, Agent, or Firm* — Rossi, Kimms & McDowell LLP

(57) ABSTRACT

A lever 40 is supported by a lever supporting portion 41. The lever 40 is urged by a first spring 45 and a second spring 46. The urging force of the first spring 45 varies over the entire operational range of the lever 40. The second spring 46 and a third spring 47 are provided serially through a movable supporting member 48. The displacement of the movable supporting member 48 is restricted by a fixed supporting member FR. If the urging force of the second spring 46 exceeds the urging force of the third spring 47, the restriction on the displacement of the movable supporting member 48 is removed. Therefore, the present invention provides a player with feeling similar to that the player perceives when he manipulates a damper pedal of an acoustic piano.

16 Claims, 30 Drawing Sheets

PEDAL APPARATUS OF ELECTRONIC MUSICAL INSTRUMENT

BACKGROUND OF THE INVENTION

1. Field of the Invention

The present invention relates to a pedal apparatus of an electronic musical instrument, the pedal apparatus controlling the manner in which a musical tone is generated.

2. Description of the Related Art

Conventionally, it is known that a pedal apparatus of an electronic musical instrument is designed to provide a player with a feeling similar to that perceived by a player on manipulation of a pedal of an acoustic piano. For example, Japanese Unexamined Patent Publication No. 2004-334008 discloses a pedal apparatus which has a lever that pivots in response to a depression of a pedal and a first spring and a second spring provided in parallel in order to urge the lever. The disclosed pedal apparatus is designed such that only the first spring urges the lever if the lever is shallowly depressed, whereas the first spring and the second spring urge the lever if the lever is depressed by a certain amount or more. Therefore, the disclosed pedal apparatus provides a player with a feeling as if the pedal became heavier at a certain point of a depression of the pedal. By such a structure, the disclosed pedal apparatus imitates the feeling perceived by the player when he manipulates a half pedal on a damper pedal of an acoustic piano.

SUMMARY OF THE INVENTION

As for an acoustic piano, if a player depresses a damper pedal, the player recognizes stepwise changes in the rate of change in the reaction force of the pedal according to the amount of displacement of the pedal. The stepwise change will be explained, referring to FIG. 34. FIG. 34 shows characteristics of the reaction force of a pedal lever of a damper pedal of an acoustic piano, the reaction force being exerted when the damper pedal is depressed, not when the damper pedal is released. The damper pedal of the acoustic piano is connected with dampers through some connecting portions. These connecting portions are provided with play. In a range of A0 of FIG. 34 where the damper pedal is depressed shallowly, therefore, the manipulation of the pedal will not be conveyed to the dampers, resulting in a small rate of change in the reaction force of the pedal. If the amount of displacement of the damper pedal increases to move into a range of A1 of FIG. 34, the conveyance of the force of depression to the dampers through the connecting portions starts, resulting in the increase in the rate of change in the reaction force of the pedal because of the increase in the reaction force caused by elastic constituents of the connecting portions and the weight and frictions of the dampers which start being partially lifted from strings. If the amount of displacement increases further to move into a range of A2 of FIG. 34, the dampers fully leave the strings, resulting in no increase in the reaction force caused by the elastic constituents of the connecting portions. Therefore, the rate of change in the reaction force of the pedal reduces again. A range (a range AH in the figure) which extends from a later point in the range A1 across the border between the ranges A1, A2 to enter the range A2 is commonly referred to as a half pedal range. In the range AH, skilled players subtly change the depth of the depression of the damper pedal to delicately vary the timbre, resonance and the like of musical tones to be generated. Depending on models and manufacturers, furthermore, the respective structures of the damper pedal, the connecting portions and the dampers vary, and so do the respective widths of the ranges A0, A1, AH and A2 of FIG. 34. As shown in a dashed line in FIG. 34, in addition, there is no difference in the rate of change in the reaction force of the pedal between the ranges A0, A1 in some cases. However, the conventional pedal apparatus of an electronic musical instrument as described above fails to provide the player with the feeling that the player of an acoustic piano perceives at the range of A2 of FIG. 34 (the state where the rate of change in the reaction force reduces again) which follows the range A1 of FIG. 34.

The present invention was accomplished to solve the above-described problem, and an object thereof is to provide a pedal apparatus of an electronic musical instrument, the pedal apparatus achieving light weight and allowing a player to feel as if the player were manipulating a damper pedal of an acoustic piano.

In order to achieve the above-described object, it is a feature of the present invention to provide a pedal apparatus of an electronic musical instrument, the pedal apparatus including, a lever (40) which is supported by a fixed supporting member (FR) and pivots by a player's depression of the lever; a plurality of springs (45, 45A, 56, 56A, 82, 145, 152, 166; 46, 46A, 57, 57A, 83, 148, 158, 167; 47, 47A, 61, 61A, 90) which exert spring force on the lever (40); and a movable supporting member (48, 48A, 53, 53A, 58, 58A, 84, 85, 146, 153, 157, 161, 163, 165) which supports any of the plurality of springs (45, 45A, 56, 56A, 82, 145, 152, 166; 46, 46A, 57, 57A, 83, 148, 158, 167; 47, 47A, 61, 61A, 90) and is displaced in response to pivoting of the lever (40), and the displacement of the movable supporting member being restricted by the fixed supporting member (FR); and when an amount of depression of the lever (40) increases from an initial state to reach a first predetermined amount of depression, a rate of change in reaction force with respect to the depression is reduced because of collaboration of the plurality of springs (45, 45A, 56, 56A, 82, 145, 152, 166; 46, 46A, 57, 57A, 83, 148, 158, 167; 47, 47A, 61, 61A, 90) and the movable supporting member (48, 48A, 53, 53A, 58, 58A, 84, 85, 146, 153, 157, 161, 163, 165).

The present invention configured as described above can make the rate of change in the reaction force of the lever (40) vary from a greater rate of change to a smaller rate of change according to the amount of depression of the lever (40). Therefore, the present invention can provide the player with feeling similar to that the player perceives when he manipulates a damper pedal of an acoustic piano shown by the dashed line in FIG. 34.

It is another feature of the present invention to provide a pedal apparatus of an electronic musical instrument, the pedal apparatus including, a lever (40) which is supported by a fixed supporting member (FR) and pivots by a player's depression of the lever; first to third springs (45, 45A, 56, 56A, 82; 46, 46A, 57, 57A, 83; 47, 47A, 61, 61A, 90) which exert spring force on the lever (40); and a movable supporting member (48, 48A, 53, 53A, 58, 58A, 84, 85) which supports any of the first to third springs (45, 45A, 56, 56A, 82; 46, 46A, 57, 57A, 83; 47, 47A, 61, 61A, 90) and is displaced in response to pivoting of the lever (40), and the displacement of the movable supporting member being restricted by the fixed supporting member (FR), wherein the first spring (45, 45A, 56, 56A, 82) exerts spring force on the lever (40) at all times in a direction resisting the depression of the lever (40); and if an amount of depression of the lever (40) increases from an initial state to reach a first predetermined amount of depression, a rate of change in reaction force with respect to the depression is reduced because of collaboration of the second spring, the third spring (46, 46A, 57, 57A, 83; 47, 47A, 61, 61A, 90) and the movable supporting member (48, 48A, 53, 53A, 58, 58A, 84, 85).

The present invention configured as described above can make the rate of change in the reaction force of the lever (40) vary from a greater rate of change to a smaller rate of change according to the amount of depression of the lever (40). Therefore, the present invention can provide the player with feeling similar to that the player perceives when he manipulates a damper pedal of an acoustic piano shown by the dashed line in FIG. 34. Because the first spring (45, 45A, 56, 56A, 82) exerts spring force on the lever (40) at all times in the direction resisting the depression of the lever (40), furthermore, the present invention can stabilize the reaction force of the lever (40) even at the time of change in the reaction force in the first predetermined amount of depression.

More specifically, as shown in FIGS. 2A, 6, 7, for example, the present invention may be configured such that the displacement of the movable supporting member (48, 48A) from a predetermined position toward a first predetermined direction is restricted by the fixed supporting member (FR), while the displacement toward a second direction opposite to the first direction is allowed; the first spring (45, 45A) is provided between the fixed supporting member (FR) and the lever (40) to exert spring force on the lever (40) at all times in the direction resisting the depression of the lever (40); the second spring (46, 46A) is provided between the movable supporting member (48, 48A) and the lever (40) so that both ends of the second spring (46, 46A) are in contact with the movable supporting member (48, 48A) and the lever (40) in a state where the lever (40) is not depressed and that the second spring (46, 46A) exerts spring force on the lever (40) in the direction resisting the depression during depression of the lever (40); and the third spring (47, 47A) is provided between the fixed supporting member (FR) and the movable supporting member (48, 48A) so that the third spring (47, 47A) exerts spring force on the lever (40) in the direction resisting the depression during the displacement of the movable supporting member (48, 48A) from the predetermined position toward the second direction.

According to the specific invention configured as described above, if the amount of depression of the lever (40) is small, the movable supporting member (48, 48A) stands still at the predetermined position until the force exerted by the lever (40) through the second spring (46, 46A) to urge the movable supporting member (48, 48A) toward the second direction reaches the spring force exerted by the third spring (47, 47A) to urge the movable supporting member (48, 48A) toward the first direction. As for this configuration, the movable supporting member (48, 48A) may be either so light that the weight of the movable supporting member (48, 48A) can be ignored or so heavy that the weight cannot be ignored. In this description, however, it is considered that an influence caused by the weight of the movable supporting member (48, 48A) can be ignored. Hereinafter, the weight of the movable supporting member is similarly considered in the other specific inventions. In this state, therefore, not only the spring force exerted by the first spring (45, 45A) but also the spring force exerted by the second spring (46, 46A) is exerted on the lever (40) in parallel. Then, if the amount of depression of the lever (40) increases further, so that the force exerted by the lever (40) through the second spring (46, 46A) to urge the movable supporting member (48, 48A) toward the second direction exceeds the force exerted by the third spring (47, 47A) to urge the movable supporting member (48, 48A) toward the first direction, the movable supporting member (48, 48A) starts being displaced. The amount of depression of the lever (40) at the start of the displacement of the movable supporting member (48, 48A) corresponds to the first amount of depression.

Then, if the amount of depression of the lever (40) increases further from this state, the movable supporting member (48, 48A) is displaced toward the second direction, with the third spring (47, 47A) starting acting. In this state, it is considered that the second spring (46, 46A) and the third spring (47, 47A) are connected serially, so that the spring constant of the serial springs is smaller than that of the second spring (46, 46A). In this state, therefore, not only the spring force exerted by the first spring (45, 45A) but also the spring force exerted by the serial springs formed of the second spring (46, 46A) and the third spring (47, 47A) is applied to the lever (40) in parallel. As a result, the present invention can make the rate of change in the reaction force of the lever (40) vary from a greater rate of change to a smaller rate of change according to the amount of depression of the lever (40). Therefore, the present invention can provide the player with feeling similar to that the player perceives when he manipulates a damper pedal of an acoustic piano.

As described above, the movable supporting member (48, 48A) may be either so light that the weight of the movable supporting member (48, 48A) can be ignored or so heavy that the weight cannot be ignored. In a case where an influence caused by the weight of the movable supporting member (48, 48A) cannot be ignored, however, it is necessary to take the inertial force acting on the movable supporting member (48, 48A) into account. More specifically, in a case where the player deeply depresses the lever (40) and then sharply decreases the amount of depression, and in a case where the player periodically changes the amount of depression of the lever (40), the movable supporting member (48, 48A) can temporarily oscillate due to collaboration of the inertial force and spring force applied to the movable supporting member (48, 48A). Furthermore, the movable supporting member (48, 48A) can collide with the fixed supporting member (FR) to cause oscillation of the movable supporting member (48, 48A). The oscillation of the movable supporting member (48, 48A) is conveyed to the lever (40) through the second spring (46, 46A) to be perceived by the player as unnatural reaction force. As for the present invention configured as described above, however, the respective spring forces of the second spring (46, 46A) and the third spring (47, 47A) act on the movable supporting member (48, 48A) in the directions opposite to each other. Therefore, the present invention is able to suppress or quickly cease the oscillation. Furthermore, because the force of the springs acting on the lever (40) can be divided into the spring force exerted by the first spring (45, 45A), and the spring force exerted by the second spring (46, 46A) and the third spring (47, 47A), the spring force (spring constant) exerted by the second spring (46, 46A) and the third spring (47, 47A) can be reduced. As a result, the unnatural reaction force of the lever caused by the oscillation can be reduced. Therefore, the present invention can stabilize the reaction force of the lever (40).

In a case where the influence caused by the weight of the movable supporting member (48, 48A) can be ignored, it can be considered that the inertial force acting on the movable supporting member (48, 48A) can be also ignored. Therefore, the present invention can prevent the unnatural reaction force, also achieving reduction in weight of the pedal apparatus.

As shown in FIG. 8 and FIG. 9, in addition, the present invention may be configured such that the movable supporting member is formed of a first movable supporting member (53, 53A) whose displacement from a first predetermined position toward a first predetermined direction is restricted by the fixed supporting member (FR), and whose displacement toward a second direction opposite to the first direction is allowed, the first movable supporting member being connected to the lever (40) so that the first movable supporting member (53, 53A) conveys force to the lever (40), and a second movable supporting member (58, 58A) whose displacement toward the first direction from a second predetermined position which is apart from the first predetermined position toward the second direction is restricted by the fixed supporting member (FR) and whose displacement toward the second direction is allowed; the first spring (56, 56A) is provided between the fixed supporting member (FR) and the first movable supporting member (53, 53A) to exert spring force through the first movable supporting member (53, 53A) on the lever (40) at all times in the direction resisting the depression; the second spring (57, 57A) is provided between the first movable supporting member (53, 53A) and the second movable supporting member (58, 58A) so that in a state where the lever (40) is not depressed, both ends of the second spring (57, 57A) are in contact with the first movable supporting member (53, 53A) and the second movable supporting member (58, 58A), while the second spring (57, 57A) exerts spring force on the lever (40) in the direction resisting the depression of the lever (40) during depression of the lever (40); and the third spring (61, 61A) is provided between the fixed supporting member (FR) and the second movable supporting member (58, 58A) to exert spring force on the lever (40) in the direction resisting the depression during the displacement of the second movable supporting member (58, 58A) from the second predetermined position toward the second direction.

According to another specific invention configured as described above, if the amount of depression of the lever (40) is small, the second movable supporting member (58, 58A) stands still at the predetermined position until the force exerted by the lever (40) through the second spring (57, 57A) to urge the second movable supporting member (58, 58A) toward the second direction reaches the spring force exerted by the third spring (61, 61A) to urge the second movable supporting member (58, 58A) toward the first direction. In this state, therefore, not only the spring force exerted by the first spring (56, 56A) but also the spring force exerted by the second spring (57, 57A) is exerted on the lever (40) in parallel. Then, if the amount of depression of the lever (40) increases further, so that the force exerted by the lever (40) through the second spring (57, 57A) to urge the second movable supporting member (58, 58A) toward the second direction exceeds the force exerted by the third spring (61, 61A) to urge the second movable supporting member (58, 58A) toward the first direction, the second movable supporting member (58, 58A) starts being displaced toward the second direction. The amount of depression of the lever (40) at the start of the displacement of the second movable supporting member (58, 58A) corresponds to the first amount of depression.

Then, if the amount of depression of the lever (40) increases further from this state, the second movable supporting member (58, 58A) is displaced toward the second direction, with the third spring (61, 61A) starting acting. In this state, it is considered that the second spring (57, 57A) and the third spring (61, 61A) are connected serially, so that the spring constant of the serial springs is smaller than that of the second spring (57, 57A). In this state, therefore, not only the spring force exerted by the first spring (56, 56A) but also the spring force exerted by the serial springs formed of the second spring (57, 57A) and the third spring (61, 61A) is applied to the lever (40) in parallel. As a result, the another specific invention can make the rate of change in the reaction force of the lever (40) vary from a greater rate of change to a smaller rate of change according to the amount of depression of the lever (40). Therefore, the another specific invention can provide the player with feeling similar to that the player perceives when he manipulates a damper pedal of an acoustic piano.

As for the another specific invention as well, similarly to the specific invention described with reference to FIGS. 2A, 6, 7, if the influence caused by the weight of the second movable supporting member (58, 58A) is taken into account, in a case where the player deeply depresses the lever (40) and then sharply decreases the amount of depression, and in a case where the player periodically changes the amount of depression of the lever (40), the second movable supporting member (58, 58A) can temporarily oscillate due to collaboration of the inertial force and spring force applied to the second movable supporting member (58, 58A). Furthermore, the second movable supporting member (58, 58A) can collide with the fixed supporting member (FR) to cause oscillation of the second movable supporting member (58, 58A). As for the another specific invention as well, however, the respective spring forces of the second spring (57, 57A) and the third spring (61, 61A) act on the second movable supporting member (58, 58A) in the directions opposite to each other. Therefore, the another specific invention is able to suppress or quickly cease the oscillation. Furthermore, because the force of the springs acting on the lever (40) is divided into the spring force exerted by the first spring (56, 56A), and the spring force exerted by the second spring (57, 57A) and the third spring (61, 61A), the unnatural reaction force of the lever caused by the oscillation can be reduced. Therefore, the another specific invention can stabilize the reaction force of the lever (40). In a case where the influence caused by the weight of the second movable supporting member (58, 58A) can be ignored, it can be considered that the inertial force acting on the second movable supporting member (58, 58A) can be also ignored. Therefore, the another specific invention can prevent the unnatural reaction force, also achieving reduction in weight of the pedal apparatus.

As shown in FIG. 10 for example, furthermore, the present invention may be configured such that the movable supporting member is formed of a first movable supporting member (85) whose displacement between a first predetermined position and a second predetermined position which is away from the first predetermined position toward a first predetermined direction is allowed by the fixed supporting member (FR) and, a second movable supporting member (84) which is in contact with the lever (40), and whose displacement toward a second direction opposite to the first direction from a third predetermined position which is away from the first predetermined position toward the second direction is restricted by the fixed supporting member (FR), and which is in contact with the first movable supporting member (85) at all times to restrict displacement toward the first direction with respect to the first movable supporting member (85); the first spring (82) is provided between the fixed supporting member (FR) and the lever (40) to exert spring force on the lever (40) at all times in the direction resisting the depression; the second spring (83) is provided between the fixed supporting member (FR) and the second movable supporting member (84) to exert spring force on the lever (40) in a direction facilitating the depression until the displacement of the first movable supporting member (85) from the second predetermined position toward the first direction is restricted; and the third spring (90) is provided between the fixed supporting member (FR) and the first movable supporting member (85) to exert, during the displacement of the first movable supporting member (85)

from the first predetermined position to the second predetermined position, spring force on the lever (40) in the direction resisting the depression.

According to still another specific invention configured as described above, if the amount of depression of the lever (40) is small, the first movable supporting member (85) is displaced from the first predetermined position toward the first direction along with the second movable supporting member (84). The first spring (82) and the third spring (90) exert spring force in the direction resisting depression of the lever (40), whereas the second spring (83) exerts spring force in the direction facilitating depression of the lever (40). In this state, it can be considered that the first through third springs (82, 83, 90) are connected in parallel, so that the spring constant of the combined springs of the three springs is larger than the spring constant of the first spring (82). Then, if the amount of depression of the lever (40) increases further, the displacement of the first and second movable supporting members (84, 85) toward the first direction is restricted at the second predetermined position by the fixed supporting member (FR). The amount of depression of the lever (40) when the displacement of the first and second movable supporting members (84, 85) is restricted corresponds to the first amount of depression.

If the amount of depression of the lever (40) increases further from this state, the spring forces of the second and third springs (83, 90) will not affect the depression of the lever (40), with only the first spring (82) acting on the depression of the lever (40). As a result, the still another specific invention can make the rate of change in the reaction force of the lever (40) vary from a greater rate of change to a smaller rate of change according to the amount of depression of the lever (40). Therefore, the invention can provide the player with feeling similar to that the player perceives when he manipulates a damper pedal of an acoustic piano.

As for this case as well, in a case where the player deeply depresses the lever (40) and then sharply decreases the amount of depression, and in a case where the player periodically changes the amount of depression of the lever (40), the lever (40) collides with the second movable supporting member (84). The impact caused by the collision of the lever (40) with the second movable supporting member (84) is absorbed by the first spring (82) and the second spring (83) to be reduced. Therefore, the still another specific invention can lessen the impact on the lever (40) caused by the collision to stabilize the reaction force of the lever (40).

Another feature of the present invention is that in a range of the amount of depression which is smaller than the first amount of depression, when the amount of depression of the lever (40) increases from the initial state to reach a second predetermined amount of depression, the rate of change in reaction force with respect to the depression increases because of collaboration of the second spring the third spring (46, 46A, 57, 57A, 83; 47, 47A, 61, 61A, 90) and the movable supporting member (48, 48A, 53, 53A, 58, 58A, 84, 85).

According to the another feature of the present invention configured as above, the rate of change in the reaction force of the lever (40) can increase and decrease stepwise according to the amount of depression of the lever (40) to start with a low rate of change to increase to a high rate to be followed by a medium rate, for example. Therefore, the another feature can provide the player with feeling similar to that the player perceives when he manipulates a damper pedal of an acoustic piano shown by a solid line in FIG. 34. In this case as well, because the first spring (45, 45A, 56, 56A, 82) exerts spring force at all times in the direction resisting depression of the lever (40), the another feature can stabilize the reaction force of the lever (40) at the time of the change in the reaction force at the first and second amounts of depression as well.

As shown in FIGS. 12, 16, 17, more specifically, the present invention may be configured such that the displacement of the movable supporting member (48, 48A) from a predetermined position toward a first predetermined direction is restricted by the fixed supporting member(FR), while the displacement toward a second direction opposite to the first direction is allowed; the first spring (45, 45A) is provided between the fixed supporting member (FR) and the lever (40) to exert spring force on the lever (40) at all times in the direction resisting the depression of the lever (40); the second spring (46, 46A) is provided between the movable supporting member (48, 48A) and the lever (40) so that in a state where the lever (40) is not depressed, one end of the second spring (46, 46A) is away from the movable supporting member (48, 48A) or the lever (40), whereas a depression of the lever (40) causes both ends of the second spring (46, 46A) to come into contact with the movable supporting member (48, 48A) and the lever (40) to exert spring force on the lever (40) in the direction resisting the depression of the lever (40); and the third spring (47, 47A) is provided between the fixed supporting member (FR) and the movable supporting member (48, 48A) so that the third spring (47, 47A) exerts spring force on the lever (40) in the direction resisting the depression during the displacement of the movable supporting member (48, 48A) from the predetermined position toward the second direction.

According to a further specific invention configured as described above, if the amount of depression of the lever (40) is small, the both ends of the second spring (46, 46A) are not in contact with the movable supporting member (48, 48A) and the lever (40), so that the spring force of only the first spring (45, 45A) is exerted on the lever (40). If the amount of depression of the lever (40) increases from this state, the both ends of the second spring (46, 46A) come into contact with the movable supporting member (48, 48A) and the lever (40). The amount of depression of the lever (40) at the time of contact of the both ends of the second spring (46, 46A) with the movable supporting member (48, 48A) and the lever (40) corresponds to the second amount of depression. Even if the amount of depression of the lever (40) increases further from this state, the movable supporting member (48, 48A) stands still at the predetermined position until the force exerted by the lever (40) through the second spring (46, 46A) to urge the movable supporting member (48, 48A) toward the second direction reaches the force exerted by the third spring (47, 47A) to urge the movable supporting member (48, 48A) toward the first direction. In this state, therefore, not only the spring force of the first spring (45, 45A) but also the spring force of the second spring (46, 46A) is exerted on the lever (40) in parallel.

Then, if the amount of depression of the lever (40) increases further, so that the force exerted by the lever (40) through the second spring (46, 46A) to urge the movable supporting member (48, 48A) toward the second direction exceeds the force exerted by the third spring (47, 47A) to urge the movable supporting member (48, 48A) toward the first direction, the movable supporting member (48, 48A) starts being displaced toward the second direction. The amount of depression of the lever (40) at the start of the displacement of the movable supporting member (48, 48A) toward the second direction corresponds to the first amount of depression. Then, if the amount of depression of the lever (40) increases further from this state, the movable supporting member (48, 48A) is displaced toward the second direction, with the third spring (47, 47A) starting acting. In this state, it is considered that the second spring (46, 46A) and the third spring (47, 47A) are connected serially, so that the spring constant of the serial springs is smaller than that of the second spring (46, 46A). In this state, therefore, not only the spring force exerted by the first spring (45, 45A) but also the spring force exerted by the serial springs formed of the second spring (46, 46A) and the third spring (47, 47A) is applied to the lever (40) in parallel. As a result, the further specific invention can make the rate of change in the reaction force of the lever (40) increase and decrease stepwise according to the amount of depression of the lever (40) to start with a low rate of change to increase to a high rate to be followed by a medium rate. Therefore, the further specific invention can provide the player with feeling similar to that the player perceives when he manipulates a damper pedal of an acoustic piano. Similarly to the specific invention described with reference to FIGS. 2A, 6, 7, in addition, the further specific invention can stabilize the reaction force of the lever (40).

Furthermore, as shown in FIGS. 18, 19, for example, the present invention may be configured such that the movable supporting member is formed of a first movable supporting member (53, 53A) whose displacement from a first predetermined position toward a first predetermined direction is restricted by the fixed supporting member (FR), and whose displacement toward a second direction opposite to the first direction is allowed, the first movable supporting member (53, 53A) being connected to the lever (40) so that the first movable supporting member (53, 53A) conveys force to the lever (40), and a second movable supporting member (58, 58A) whose displacement toward the first direction from a second predetermined position which is away from the first predetermined position toward the second direction is restricted by the fixed supporting member (FR) and whose displacement toward the second direction is allowed; the first spring (56, 56A) is provided between the fixed supporting member (FR) and the first movable supporting member (53, 53A) to exert spring force through the first movable supporting member (53, 53A) on the lever (40) at all times in the direction resisting the depression; the second spring (57, 57A) is provided between the first movable supporting member (53, 53A) and the second movable supporting member (58, 58A) so that in a state where the lever (40) is not depressed, one end of the second spring (57, 57A) is away from the first movable supporting member (53, 53A) or the second movable supporting member (58, 58A), whereas a depression of the lever (40) causes both ends of the second spring (57, 57A) to come into contact with the first movable supporting member (53, 53A) and the second movable supporting member (58, 58A) to exert spring force on the lever (40) in the direction resisting the depression of the lever (40); and the third spring (61, 61A) is provided between the fixed supporting member (FR) and the second movable supporting member (58, 58A) to exert spring force on the lever (40) in the direction resisting the depression during the displacement of the second movable supporting member (58, 58A) from the second predetermined position toward the second direction.

According to a still further specific invention configured as described above, if the amount of depression of the lever (40) is small, the spring force of the first spring (56, 56A) is exerted on the lever (40) through the first movable supporting member (53, 53A), with the first movable supporting member (53, 53A) being displaced from the first predetermined position toward the second direction. In this state, the both ends of the second spring (57, 57A) are not in contact with the first movable supporting member (53, 53A) and the second movable supporting member (58, 58A), resulting in the spring force of only the first spring (56, 56A) being exerted on the lever (40). If the amount of depression of the lever (40) increases from this state, the both ends of the second spring (57, 57A) come into contact with the first movable supporting member (53, 53A) and the second movable supporting member (58, 58A). The amount of depression of the lever (40) at the time of contact of the both ends of the second spring (57, 57A) with the first movable supporting member (53, 53A) and the second movable supporting member (58, 58A) corresponds to the second amount of depression. Even if the amount of depression of the lever (40) increases further from this state, the second movable supporting member (58, 58A) stands still at the predetermined position until the force exerted by the lever (40) through the second spring (57, 57A) to urge the second movable supporting member (58, 58A) toward the second direction reaches the force exerted by the third spring (61, 61A) to urge the second movable supporting member (58, 58A) toward the first direction. In this state, therefore, not only the spring force of the first spring (56, 56A) but also the spring force of the second spring (57, 57A) is exerted on the lever (40) in parallel.

Then, if the amount of depression of the lever (40) increases further, so that the force exerted by the lever (40) through the second spring (57, 57A) to urge the second movable supporting member (58, 58A) toward the second direction exceeds the force exerted by the third spring (61, 61A) to urge the second movable supporting member (58, 58A) toward the first direction, the second movable supporting member (58, 58A) starts being displaced toward the second direction. The amount of depression of the lever (40) at the start of the displacement of the second movable supporting member (58, 58A) corresponds to the first amount of depression. Then, if the amount of depression of the lever (40) increases further from this state, the second movable supporting member (58, 58A) is displaced toward the second direction, with the third spring (61, 61A) starting acting. In this state, it is considered that the second spring (57, 57A) and the third spring (61, 61A) are connected serially, so that the spring constant of the serial springs is smaller than that of the second spring (57, 57A). In this state, therefore, not only the spring force exerted by the first spring (56, 56A) but also the spring force exerted by the serial springs formed of the second spring (57, 57A) and the third spring (61, 61A) is applied to the lever (40). As a result, the still further specific invention can make the rate of change in the reaction force of the lever (40) increase and decrease stepwise according to the amount of depression of the lever (40) to start with a low rate of change to increase to a high rate to be followed by a medium rate. Therefore, the still further specific invention can provide the player with feeling similar to that the player perceives when he manipulates a damper pedal of an acoustic piano. Similarly to the another specific invention described with reference to FIGS. 8, 9, in addition, the still further specific invention can stabilize the reaction force of the lever (40).

Furthermore, as shown in FIG. 20, for example, the present invention may be configured such that the movable supporting member is formed of a first movable supporting member (85) whose displacement between a first predetermined position and a second predetermined position which is away from the first predetermined position toward a first predetermined direction is allowed by the fixed supporting member (FR), and a second movable supporting member (84) which is in contact with the lever (40), and whose displacement toward a second direction opposite to the first direction from a third predetermined position which is away from the first predetermined position toward the second direction is restricted by the fixed supporting member (FR), and whose displacement toward the first direction with respect to the first movable supporting member (85) is restricted by contact with the first movable supporting member (85); the first spring (82) is provided between the fixed supporting member (FR) and the lever (40) to exert spring force on the lever (40) at all times in the direction resisting the depression; the second spring (83) is provided between the fixed supporting member (FR) and the second movable supporting member (84) to exert spring force on the lever (40) in a direction facilitating the depression until the displacement of the first movable supporting member (85) from the second predetermined position toward the first direction is restricted with the displacement of the second movable supporting member (84) with respect to the first movable supporting member (85) being restricted; and the third spring (90) is provided between the fixed supporting member (FR) and the first movable supporting member (85) to exert spring force on the lever (40) in the direction resisting the depression during the displacement of the first movable supporting member (85) from the first predetermined position to the second predetermined position caused by the contact of the second movable supporting member (84) with the first movable supporting member (85).

According to another specific invention configured as described above, if the amount of depression of the lever (40) is small, the spring forces of the first and second springs (82, 83) are exerted on the lever (40), with the second movable supporting member (84) being displaced toward the first direction. More specifically, the first spring (82) exerts the spring force in the direction resisting the depression of the lever (40) whereas the second spring (83) exerts the spring force which is smaller than that of the first spring (82) in the direction facilitating the depression of the lever (40). Therefore, the reaction force resisting the depression of the lever (40) is the spring force of the combined springs obtained by subtracting the spring force of the second spring (83) from the spring force of the first spring (82). Consequently, the spring constant of the combined springs is smaller than the spring constant of the first spring (82). If the amount of depression of the lever (40) increases from this state, the second movable supporting member (84) comes into contact with the first movable supporting member (85). The amount of depression of the lever (40) at the time of contact of the second movable supporting member (84) with the first movable supporting member (85) corresponds to the second amount of depression. If the amount of depression of the lever (40) increases further from this state, the first movable supporting member (85) starts being displaced along with the second movable supporting member (84) from the first predetermined position toward the first direction. This displacement causes the spring force of the third spring (90) in addition to the spring force of the combined springs to be exerted on the lever (40) in the direction resisting the depression of the lever (40).

Then, if the amount of depression of the lever (40) further increases, the displacement of the first and second movable supporting members (84, 85) toward the first direction is restricted at the second predetermined position by the fixed supporting member (FR). The amount of depression of the lever (40) at the time of restriction of the displacement of the first and second movable supporting members (84, 85) at the second predetermined position by the fixed supporting member (FR) corresponds to the first amount of depression. If the amount of depression of the lever (40) increases further from this state, the spring forces of the second and third springs (82, 83) will not affect the depression of the lever (40) with only the first spring (82) starting acting on the depression of the lever (40). As a result, the another specific invention can make the rate of change in the reaction force of the lever (40) increase and decrease stepwise according to the amount of depression of the lever (40) to start with a low rate of change to increase to a high rate to be followed by a medium rate. Therefore, the another specific invention can provide the player with feeling similar to that the player perceives when he manipulates a damper pedal of an acoustic piano.

Similarly to the still another specific invention described with reference to FIG. 10, in addition, the another specific invention can stabilize the reaction force of the lever (40).

It is still another feature of the present invention to provide a pedal apparatus of an electronic musical instrument, the pedal apparatus including a lever (140) which is supported by a fixed supporting member (FR) and pivots by a player's depression of the lever (140); first and second springs (145, 152, 166; 148, 158, 167) which exert spring force on the lever (140); and a movable supporting member (146, 153, 157, 161, 163, 165) which supports the second spring (148, 158, 167) and is displaced in response to pivoting of the lever (140), and the displacement of the movabale supporting member being restricted by the fixed supporting member (FR), wherein the first spring (145, 152, 166) exerts spring force on the lever (140) at all times in a direction resisting the depression of the lever (140); and if an amount of depression of the lever (140) increases from an initial state to reach a first predetermined amount of depression, a rate of change in reaction force with respect to the depression is reduced because of collaboration of the second spring (148, 158, 167) and the movable supporting member (146, 153, 157, 163, 165).

The present invention configured as described above can make the rate of change in the reaction force of the lever (140) vary from a greater rate of change to a smaller rate of change according to the amount of depression of the lever (140). Therefore, the present invention can provide the player with feeling similar to that the player perceives when he manipulates a damper pedal of an acoustic piano shown by the dashed line in FIG. 34. In addition, the present invention can realize desired capabilities with a simple structure. Because the first spring (145, 152, 166) exerts spring force on the lever (140) at all times in the direction resisting the depression of the lever (140), furthermore, the present invention can stabilize the reaction force of the lever (140) even at the time of change in the reaction force in the first amount of depression.

More specifically, as shown in FIGS. 22A, 26, for example, the present invention may be configured such that the downward displacement of the movable supporting member (146, 153, 157) from a predetermined position is restricted by the fixed supporting member (FR), while the upward displacement is allowed; the first spring (145, 152) is provided between the fixed supporting member (FR) and the lever (140) to exert spring force on the lever (140) at all times in the direction resisting the depression of the lever (140); and the second spring (148, 158) is provided between the movable supporting member (146, 153, 157) and the lever (140) so that both ends of the second spring (148, 158) are in contact with the movable supporting member (146, 153, 157) and the lever (140) in a state where the lever (140) is not depressed and that the second spring (148, 158) exerts spring force on the lever (140) in the direction resisting the depression during depression of the lever (140). In this case, the movable supporting member (146, 153, 157) may be a weight whose displacement is restricted by itself from the initial state of the amount of depression of the lever (140) until the first amount of depression.

According to a specific invention configured as described above, if the amount of depression of the lever (140) is small, the movable supporting member (146, 153, 157) stands still at the predetermined position until the force exerted by the lever (140) through the second spring (148, 158) to lift the movable supporting member (146, 153, 157) reaches the weight of the movable supporting member (146, 153, 157). In this state therefore, not only the spring force exerted by the first spring (145, 152) but also the spring force exerted by the second spring (148, 158) is exerted on the lever (140) in parallel. Then, if the amount of depression of the lever (140) increases further, so that the force exerted by the lever (140) through the second spring (148, 158) to lift the movable supporting member (146, 153, 157) exceeds the weight of the movable supporting member (146, 153, 157), the movable supporting member (146, 153, 157) starts being displaced upward. The amount of depression of the lever (140) at the start of the upward displacement of the movable supporting member (146, 153, 157) corresponds to the first amount of depression.

Then, if the amount of depression of the lever (140) increases further from this state, the movable supporting member (146, 153, 157) is displaced upward. In this state, the second spring (148, 158) will not be compressed any further. In this state, therefore, although the spring force exerted by the first spring (145, 152) and the spring force exerted by the second spring (148, 158) are applied to the lever (140) in parallel, the spring force of the second spring (148, 158) will not change, with the spring force of only the first spring (145, 152) increasing. As a result, the specific invention can make the rate of change in the reaction force of the lever (140) vary from a greater rate of change to a smaller rate of change according to the amount of depression of the lever (140). Therefore, the specific invention can provide the player with feeling similar to that the player perceives when he manipulates a damper pedal of an acoustic piano as shown by the dashed line in FIG. 34.

Furthermore, in a case where the player deeply depresses the lever (140) and then sharply decreases the amount of depression, and in a case where the player periodically changes the amount of depression of the lever (140), the movable supporting member (146, 153, 157) can temporarily oscillate due to collaboration of the inertial force and spring force. Furthermore, the movable supporting member (146, 153, 157) can collide with the fixed supporting member (FR) to cause oscillation of the movable supporting member (146, 153, 157). The oscillation of the movable supporting member (146, 153, 157) is conveyed to the lever (140) through the second spring (148, 158) to be perceived by the player as unnatural reaction force. As for the invention configured as described above, however, because the force of the springs acting on the lever (140) can be divided into the spring force exerted by the first spring (145, 152) and the spring force exerted by the second spring (148, 158), the spring force (spring constant) exerted by the second spring (148, 158) can be reduced. As a result, the unnatural reaction force of the lever caused by the oscillation can be reduced. Therefore, the specific invention can stabilize the reaction force of the lever (140). In addition, the specific invention can realize the desired capabilities with the simple structure formed of the two springs (145, 152; 148, 158) and the movable supporting member (146, 153, 157).

In addition, as shown in FIG. 27, for example, the present invention may be configured such that the movable supporting member is formed of a first movable supporting member (161) whose downward displacement from a first predetermined position is restricted by the fixed supporting member (FR), and whose upward displacement is allowed, the first movable supporting member (161) being connected to the lever (140) so that the first movable supporting member (161) conveys force to the lever (140), and a second movable supporting member (163, 165) whose downward displacement from a second predetermined position which is apart upward from the first predetermined position is restricted by the fixed supporting member (FR) and whose upward displacement is allowed; the first spring (166) is provided between the fixed supporting member (FR) and the first movable supporting member (161) to exert spring force through the first movable supporting member (161) on the lever (140) at all times in the direction resisting the depression; and the second spring (167) is provided between the first movable supporting member (161) and the second movable supporting member (163, 165) so that in a state where the lever (140) is not depressed, both ends of the second spring (167) are in contact with the first movable supporting member (161) and the second movable supporting member (163, 165), while the second spring (167) exerts spring force on the lever (140) in the direction resisting the depression of the lever (140) during depression of the lever (140). In this case, the second movable supporting member (163, 165) may be a weight whose displacement is restricted by itself from the initial state of the amount of depression of the lever (140) until the first amount of depression.

According to another specific invention configured as described above, if the amount of depression of the lever (140) is small, the second movable supporting member (163, 165) stands still at the predetermined position until the force exerted by the lever (140) through the second spring (167) to lift the second movable supporting member (163, 165) reaches the weight of the second movable supporting member (163, 165). In this state, therefore, not only the spring force exerted by the first spring (166) but also the spring force exerted by the second spring (167) is exerted on the lever (140) in parallel. Then, if the amount of depression of the lever (140) increases further, so that the force exerted by the lever (140) through the second spring (167) to lift the second movable supporting member (163, 165) exceeds the weight of the second movable supporting member (163, 165), the second movable supporting member (163, 165) starts being displaced upward. The amount of depression of the lever (140) at the start of the upward displacement of the second movable supporting member (163, 165) corresponds to the first amount of depression.

Then, if the amount of depression of the lever (140) increases further from this state, the second movable supporting member (163, 165) is displaced upward. In this state, the second spring (167) will not be compressed any further. In this state, therefore, although the spring force exerted by the first spring (166) and the spring force exerted by the second spring (167) are applied to the lever (140) in parallel, the spring force of the second spring (167) will not change, with the spring force of only the first spring (166) increasing. As a result, the another specific invention can make the rate of change in the reaction force of the lever (140) vary from a greater rate of change to a smaller rate of change according to the amount of depression of the lever (140). Therefore, the another specific invention can provide the player with feeling similar to that the player perceives when he manipulates a damper pedal of an acoustic piano as shown by the dashed line in FIG. 34.

As for the another specific invention, similarly to the specific invention described with reference to FIGS. 22A, 26, in a case where the player deeply depresses the lever (140) and then sharply decreases the amount of depression, and in a case where the player periodically changes the amount of depression of the lever (140), the second movable supporting member (163, 165) can temporarily oscillate due to collaboration of the inertial force and spring force. Furthermore, the second movable supporting member (163, 165) can collide with the fixed supporting member (FR) to cause oscillation of the second movable supporting member (163, 165). As for the another specific invention as well, however, because the force of the springs acting on the lever (140) can be divided into the spring force exerted by the first spring (166) and the spring force exerted by the second spring (167), the spring force exerted by the second spring (167) can be reduced. As a result, the unnatural reaction force of the lever caused by the oscillation can be reduced. Therefore, the another specific invention can stabilize the displacement of the first movable supporting member (161), resulting in the stable reaction force of the lever (140) connected with the first movable supporting member (161) so that the first movable supporting member (161) conveys force to the lever (140). In addition, the another specific invention can realize the desired capabilities with the simple structure.

It is a further feature of the present invention that in a range of the amount of depression which is smaller than the first amount of depression, when the amount of depression of the lever (140) increases from the initial state to reach a second predetermined amount of depression, the rate of change in reaction force with respect to the depression increases because of collaboration of the second spring (148, 158, 167) and the movable supporting member (146, 153, 157, 161, 163, 165).

According to the further feature of the present invention configured as above, the rate of change in the reaction force of the lever (140) can increase and decrease stepwise according to the amount of depression of the lever (140) to start with a low rate of change to increase to a high rate to be followed by a low rate, for example. Therefore, the further feature can provide the player with feeling similar to that the player perceives when he manipulates a damper pedal of an acoustic piano shown by the solid line in FIG. 34. In addition, the further feature can realize the desired capabilities with the simple structure. In this case as well, because the first spring (145, 152, 166) exerts spring force at all times in the direction resisting depression of the lever (140), the further feature can stabilize the reaction force of the lever (140) at the time of the change in the reaction force at the first and second amounts of depression as well.

More specifically, as shown in FIGS. 28, 32, for example, the present invention may be configured such that the downward displacement of the movable supporting member (146, 153, 157) from a predetermined position is restricted by the fixed supporting member (FR), while the upward displacement is allowed; the first spring (145, 152) is provided between the fixed supporting member (FR) and the lever (140) to exert spring force on the lever (140) at all times in the direction resisting the depression of the lever (140); and the second spring (148, 158) is provided between the movable supporting member (146, 153, 157) and the lever (140) so that in a state where the lever (140) is not depressed, one end of the second spring (148, 158) is away from the movable supporting member (146, 153, 157) or the lever (140), whereas a depression of the lever (140) causes both ends of the second spring (148, 158) to come into contact with the movable supporting member (146, 153, 157) and the lever (140) to exert spring force on the lever (140) in the direction resisting the depression of the lever (140). In this case, the movable supporting member (146, 153, 157) may be a weight whose displacement is restricted by itself from the initial state of the amount of depression of the lever (140) until the first amount of depression.

According to still another specific invention configured as described above, if the amount of depression of the lever (140) is small, the both ends of the second spring (148, 158) are not in contact with the movable supporting member (146, 153, 157) and the lever (140), so that the spring force of only the first spring (145, 152) is exerted on the lever (140). If the amount of depression of the lever (140) increases from this state, the both ends of the second spring (148, 158) come into contact with the movable supporting member (146, 153, 157) and the lever (140). The amount of depression of the lever (140) at the time of contact of the both ends of the second spring (148, 158) with the movable supporting member (146, 153, 157) and the lever (140) corresponds to the second amount of depression.

Even if the amount of depression of the lever (140) increases further from this state, the movable supporting member (146, 153, 157) stands still at the predetermined position until the force exerted by the lever (140) through the second spring (148, 158) to lift the movable supporting member (146, 153, 157) reaches the weight of the movable supporting member (146, 153, 157). In this state, therefore, not only the spring force of the first spring (145, 152) but also the spring force of the second spring (148, 158) is exerted on the lever (140) in parallel. Then, if the amount of depression of the lever (140) increases further, so that the force exerted by the lever (140) through the second spring (148, 158) to lift the movable supporting member (146, 153, 157) exceeds the weight of the movable supporting member (146, 153, 157), the movable supporting member (146, 153, 157) starts being displaced upward. The amount of depression of the lever (140) at the start of the upward displacement of the movable supporting member (146, 153, 157) corresponds to the first amount of depression.

Then, if the amount of depression of the lever (140) increases further from this state, the movable supporting member (146, 153, 157) is displaced upward. In this state, the second spring (148, 158) will not be compressed any further. In this state, therefore, although the spring force exerted by the first spring (145, 152) and the spring force exerted by the second spring (148, 158) are applied to the lever (140) in parallel, the spring force of the second spring (148, 158) will not change, with the spring force of only the first spring (145, 152) increasing. As a result, the still another specific invention can make the rate of change in the reaction force of the lever (140) increase and decrease stepwise according to the amount of depression of the lever (140) to start with a low rate of change to increase to a high rate to be followed by a low rate. Therefore, the still another specific invention can provide the player with feeling similar to that the player perceives when he manipulates a damper pedal of an acoustic piano as shown by the solid line in FIG. 34. Similarly to the specific invention described with reference to FIGS. 22A, 26, in addition, the still another specific invention can stabilize the reaction force of the lever (140). Furthermore, the still another specific invention can realize the desired capabilities with the simple structure.

Furthermore, as shown in FIG. 33, for example, the present invention may be configured such that the movable supporting member is formed of a first movable supporting member (161) whose downward displacement from a first predetermined position is restricted by the fixed supporting member (FR), and whose upward displacement is allowed, the first movable supporting member (161) being connected to the lever (140) so that the first movable supporting member (161) conveys force to the lever (140), and a second movable supporting member (163, 165) whose downward displacement from a second predetermined position which is away upward from the first predetermined position is restricted by the fixed supporting member (FR) and whose upward displacement is allowed; the first spring (166) is provided between the fixed supporting member (FR) and the first movable supporting member (161) to exert spring force through the first movable supporting member (161) on the lever (140) at all times in the direction resisting the depression; and the second spring (167) is provided between the first movable supporting member (161) and the second movable supporting member (163, 165) so that in a state where the lever (140) is not depressed, one end of the second spring (167) is away from the first movable supporting member(161) or the second movable supporting member (163, 165), whereas a depression of the lever (140) causes both ends of the second spring (167) to come into contact with the first movable supporting member (161) and the second movable supporting member (163, 165) to exert spring force on the lever (140) in the direction resisting the depression of the lever (140). In this case, the second movable supporting member (163, 165) may be a weight whose displacement is restricted by itself from the initial state of the amount of depression of the lever (140) until the first amount of depression.

According to a further specific invention configured as described above, if the amount of depression of the lever (140) is small, the spring force of the first spring (166) is exerted on the lever (140) through the first movable supporting member (161), with the first movable supporting member (161) being displaced upward from the first predetermined position. In this state, the both ends of the second spring (167) are not in contact with the first movable supporting member (161) and the second movable supporting member (163, 165), resulting in the spring force of only the first spring (166) being exerted on the lever (140). If the amount of depression of the lever (140) increases from this state, the both ends of the second spring (167) come into contact with the first movable supporting member (161) and the second movable supporting member (163, 165). The amount of depression of the lever (140) at the time of contact of the both ends of the second spring (167) with the first movable supporting member (161) and the second movable supporting member (163, 165) corresponds to the second amount of depression. Even if the amount of depression of the lever (140) increases further from this state, the second movable supporting member (163, 165) stands still at the predetermined position until the force exerted by the lever (140) through the second spring (167) to lift the second movable supporting member (163, 165) reaches the weight of the second movable supporting member (163, 165). In this state, therefore, not only the spring force of the first spring (166) but also the spring force of the second spring (167) is exerted on the lever (140) in parallel.

Then, if the amount of depression of the lever (140) increases further, so that the force exerted by the lever (140) through the second spring (167) to lift the second movable supporting member (163, 165) exceeds the weight of the second movable supporting member (163, 165), the second movable supporting member (163, 165) starts being displaced upward. The amount of depression of the lever (140) at the start of the upward displacement of the second movable supporting member (163, 165) corresponds to the first amount of depression. Then, if the amount of depression of the lever (140) increases further from this state, the second movable supporting member (163, 165) is displaced upward. In this state, the second spring (167) will not be compressed any further. In this state, therefore, although the spring force of the first spring (166) and the spring force of the second spring (167) are exerted on the lever (140) in parallel, the spring force of the second spring (167) will not change, with the spring force of only the first spring (166) increasing. As a result, the further specific invention can make the rate of change in the reaction force of the lever (140) increase and decrease stepwise according to the amount of depression of the lever (140) to start with a low rate of change to increase to a high rate to be followed by a low rate. Therefore, the further specific invention can provide the player with feeling similar to that the player perceives when he manipulates a damper pedal of an acoustic piano as shown by the solid line in FIG. 34. Similarly to the another specific invention described with reference to FIG. 27, in addition, the further specific invention can stabilize the reaction force of the lever (140). Furthermore, the further specific invention can realize the desired capabilities with the simple structure.

DESCRIPTION OF THE PREFERRED EMBODIMENT a. General Configuration of Electronic Musical Instrument

Figure 1:
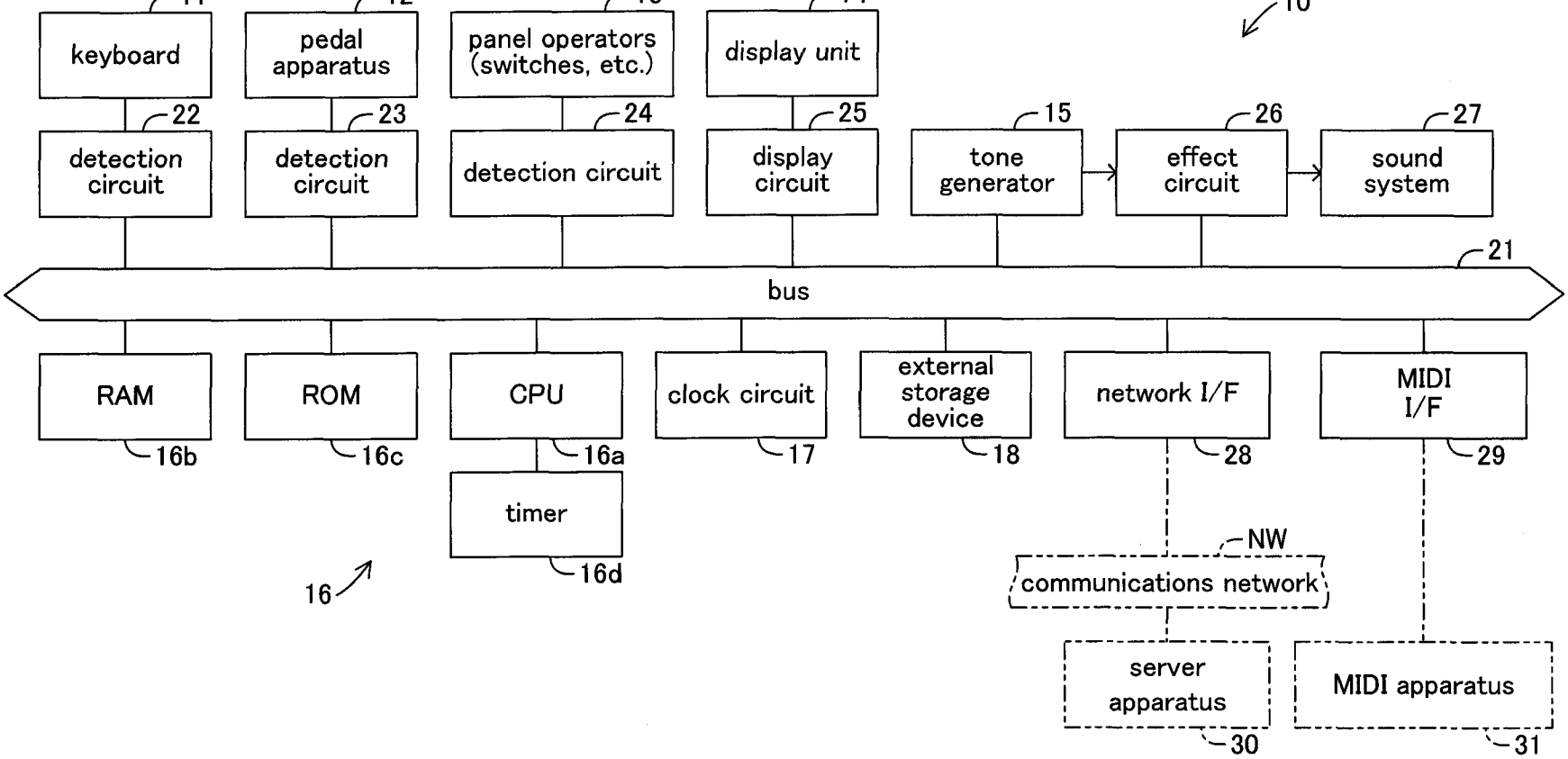
FIG. 1 is a block diagram showing an example general configuration of an electronic musical instrument to which a pedal apparatus according to first to six embodiments of the present invention is applied.

Before a pedal apparatus according to respective embodiments of the present invention is described, a general configuration of an electronic musical instrument to which the pedal apparatus according to the embodiments is applied will now be described. FIG. 1 is a block diagram showing an example general configuration of an electronic musical instrument to which the pedal apparatus of the respective embodiments is applied. An electronic musical instrument 10 has a keyboard 11, a pedal apparatus 12, a plurality of panel operators 13, a display unit 14, a tone generator 15, a computer portion 16, a clock circuit 17 and an external storage device 18.

The keyboard 11 is manipulated by a player with his hands to specify the tone pitch of respective musical tones to be generated. The manipulation of the keyboard 11 is detected by a detection circuit 22 connected to a bus 21, so that data (e.g., note data, key-on data, key-off data, etc.) indicative of the player's manipulation is supplied to the computer portion 16 through the bus 21. The pedal apparatus 12 is manipulated by the player with his foot to control the manner in which musical tones are generated by the electronic musical instrument. In the respective embodiments which will be described later, the pedal apparatus 12 is a damper pedal which adds a damper effect to a musical tone to be generated by a depression of the damper pedal by the player's foot. The manipulation of the pedal apparatus 12 is detected by a detection circuit 23 connected to the bus 21, as described in detail later, so that data indicative of the manipulation is supplied to the computer portion 16 through the bus 21. The plurality of panel operators 13 are used in order to specify the operation of the electronic musical instrument. The manipulation of the panel operators 13 is detected by a detection circuit 24 connected to the bus 21, so that data indicative of the manipulation is supplied to the computer portion 16 through the bus 21. The display unit 14 is configured by a liquid crystal display, a CRT or the like to display characters, numerals, graphics and the like on a screen. The display unit 14 is controlled by a display circuit 25 connected to the bus 21. More specifically, what is to be displayed on the screen is specified on the basis of display instruction signals and display data supplied to the display circuit 25 through the bus 21.

The tone generator 15, which is connected to the bus 21, generates digital musical tone signals on the basis of musical tone control data (note data, key-on data, key-off data, tone color control data, tone volume control data, etc.) supplied from the computer portion 16 through the bus 21 and then supplies the generated digital musical tone signals to an effect circuit 26. The effect circuit 26, which is connected to the bus 21, adds an effect to the supplied digital musical tone signals on the basis of effect control data supplied from the computer portion 16 through the bus 21, and then supplies the digital musical tone signals to which the effect has been added to a sound system 27. The above-described damper effect is added to the digital musical tone signals in the tone generator 15 or in the effect circuit 26. The sound system 27, which is configured by a D/A converter, amplifiers, speakers and the like, converts the supplied digital musical tone signals having the effect to analog musical tone signals, and then emits musical tones corresponding to the analog musical tone signals.

The computer portion 16, which is formed of a CPU 16*a*, a RAM 16*b* and a ROM 16*c* connected to the bus 21. The computer portion 16 also includes a timer 16*d* which is connected to the CPU 16*a*. By execution of programs, the computer portion 16 controls the electronic musical instrument 10. The clock circuit 17 continuously measures date and time. The external storage device 18 includes various kinds of storage media such as a hard disk and a flash memory incorporated into the electronic musical instrument 10, and a compact disk which can be connected to the electronic musical instrument 10. The external storage device 18 also includes drive units provided for the various storage media, so that the external storage device 18 can store and read out large amounts of data and programs.

The electronic musical instrument 10 also has a network interface circuit 28 and a MIDI interface circuit 29. The network interface circuit 28 connects the electronic musical instrument 10 to a server apparatus 30 through a communications network NW so that the electronic musical instrument 10 can communicate with the server apparatus 30. The MIDI interface circuit 29 connects the electronic musical instrument 10 to an external MIDI apparatus 31 such as the other electronic musical instrument or a sequencer so that the electronic musical instrument 10 can communicate with the external MIDI apparatus 31.

b. First Embodiment

Figure 2A:
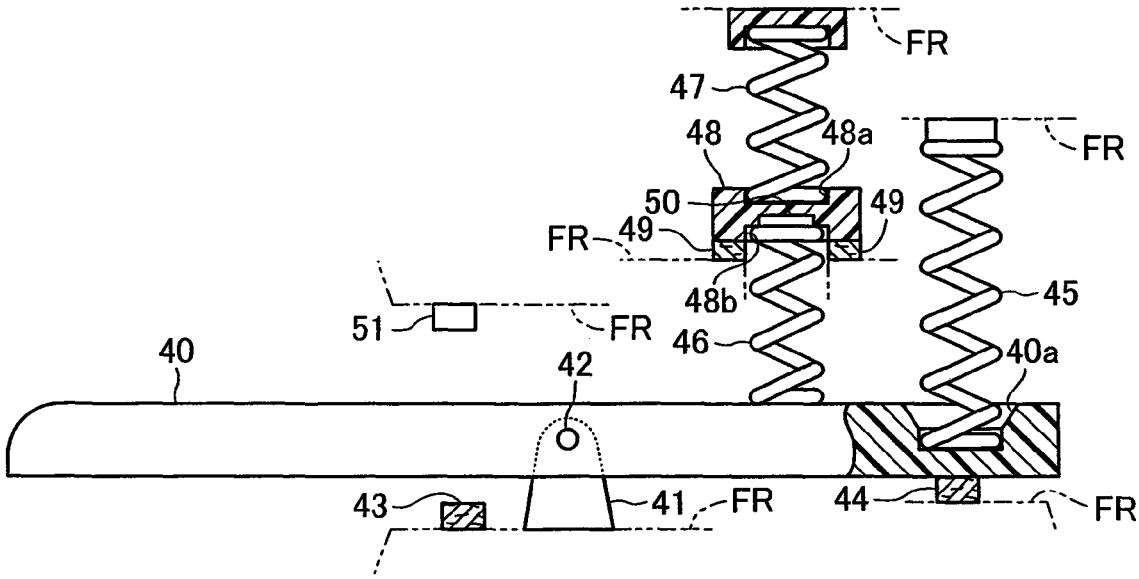
FIG. 2A is a side view of the pedal apparatus according to the first embodiment of the present invention.

Next, a first embodiment of the pedal apparatus 12 according to the present invention will be described in detail. FIG. 2A shows a side view of the pedal apparatus of the electronic musical instrument according to the present embodiment. A lever 40 is a long plate-shaped member. The forward part (left side in FIG. 2A) of the lever 40 is a wide depression part on which a player steps. The lever 40 is supported at a middle part thereof by a lever supporting portion 41 provided on a frame FR which serves as a fixed supporting member so that the front end of the lever 40 can pivot upward and downward about a rotary shaft 42. Below the middle part of the lever 40, a long lower limit stopper 43 made of a shock-absorbing member such as felt extends in a lateral direction to be fixed to the frame FR. The lower limit stopper 43 restricts downward displacement of the forward part of the lever 40. The frame FR is a structural body for supporting various parts of the pedal apparatus 12 and a housing itself of the pedal apparatus 12. Below the rear part of the lever 40, an upper limit stopper 44 which is similar to the lower limit stopper 43 is fixed to the frame FR to restrict upward displacement of the forward part of the lever 40.

Behind the rotary shaft 42 of the lever 40, the top end of a first spring 45 is fixed to the frame FR so that the top end of the first spring 45 is situated above the rear part of the lever 40. The lower end of the first spring 45 is inserted into a concave portion 40*a* provided on the top surface of the rear part of the lever 40 to be in contact with the bottom surface of the concave portion 40*a*, so that the first spring 45 urges the rear part of the lever 40 downward. The first spring 45 is a compression spring. Behind the rotary shaft 42 of the lever 40, furthermore, a second spring 46, a third spring 47 and a movable supporting member 48 are provided so that the second and third springs 46, 47 and the movable supporting member 48 are situated above the rear part of the lever 40. The movable supporting member 48 is shaped like a cylinder having concave portions 48*a*, 48*b* on its upper surface and lower surface. The top end of the third spring 47 is fixed to the frame FR situated above the rear part of the lever 40. The lower end of the third spring 47 is inserted into the concave portion 48*a* of the movable supporting member 48 to be fixed to the bottom surface of the concave portion 48*a* to be supported by the movable supporting member 48. The top end of the second spring 46 is inserted into the concave portion 48*b* of the movable supporting member 48 to be fixed to the upper bottom surface of the concave portion 48*b* to be supported by the movable supporting member 48. The lower end of the second spring 46 is in contact with the top surface of the lever 40. The second spring 46 and the third spring 47 are compression springs. If comparisons of spring constant are made among the first spring 45, the second spring 46 and the third spring 47, the first spring 45 has the largest spring constant. The spring constant of the third spring 47 is sufficiently small when compared with the spring constant of the first spring 45 and the second spring 46. The relationship of the magnitude of the spring constant among the first to third springs 45, 46, 47 is not limited to that of the present embodiment, but can vary according to desired characteristics of reaction force of the lever 40. In a case where the difference of the rate of change in the reaction force is small between range A1 and range A2 shown in FIG. 34, for instance, the third spring 47 may have a larger spring constant than the second spring 46. The movable supporting member 48, which is a plate-shaped member, is allowed to move only upward and downward by a guide member which is not shown. By a movable supporting member lower limit stopper 49 fixed to the frame FR, furthermore, the downward displacement of the movable supporting member 48 is restricted. The movable supporting member lower limit stopper 49, which is made of a shock-absorbing member such as felt, prevents shock noise that would be generated when the movable supporting member 48 collides with the frame FR.

Into the concave portion 48*b* of the movable supporting member 48, a load sensor 50 for sensing the urging force of the second spring 46 (load applied to the lever 40 which is the pedal apparatus 12) is incorporated. By electrically sensing elastic deformation caused by the urging force of the second spring 46 (e.g., with a strain gauge), the load sensor 50 obtains the urging force of the second spring 46. Above the middle part of the lever 40, furthermore, a displacement sensor 51 for sensing the amount of displacement of the lever 40 is provided. By electrically or optically sensing the distance to the top surface of the lever 40 (e.g., by reflection of laser light), the displacement sensor 51 obtains the amount of displacement of the lever 40. The displacement sensor 51 may be replaced with a sensor for mechanically and electrically sensing the amount of upward and downward displacement of the lever 40 (e.g., variable resistance).

Figure 3A:
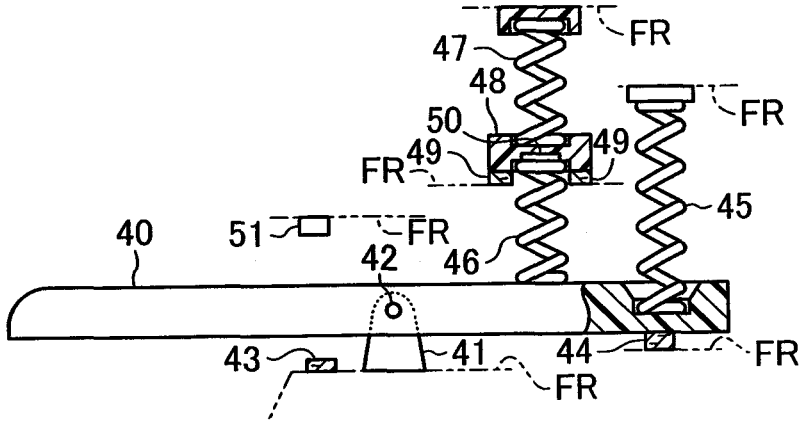
FIG. 3A is a diagram showing the position of a lever and the state where a first spring, a second spring and a third spring are compressed in a state where the lever is not depressed according to the first embodiment.
Figure 3B:
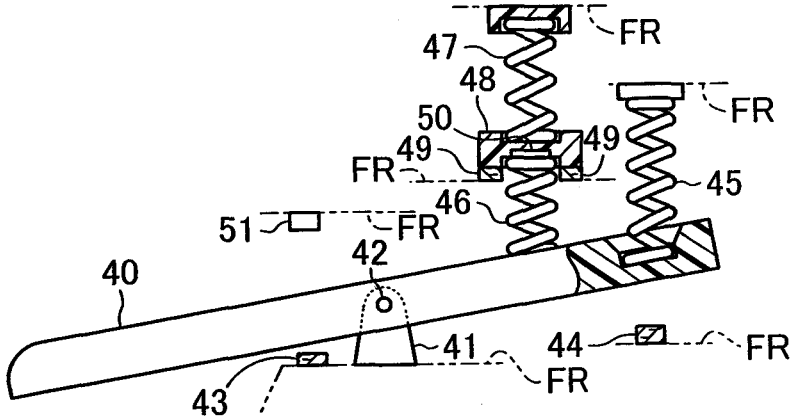
FIG. 3B is a diagram showing the position of the lever and the state where the first spring, the second spring and the third spring are compressed in a state where a movable supporting member starts being displaced according to the first embodiment.
Figure 3C:
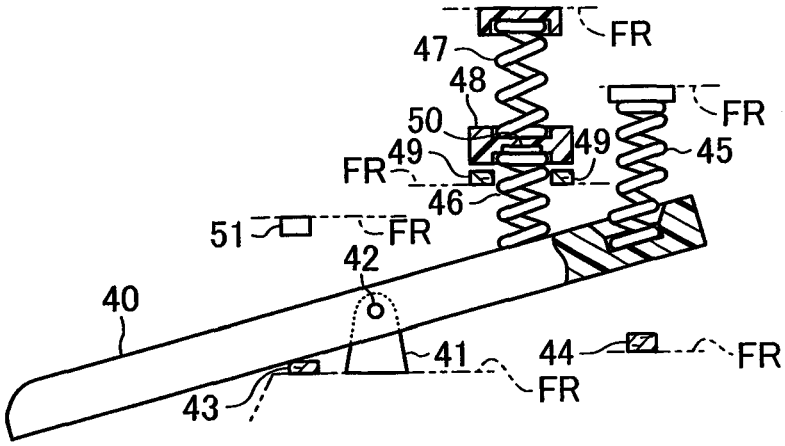
FIG. 3C is a diagram showing the position of the lever and the state where the first spring, the second spring and the third spring are compressed in a state where the amount of depression of the lever is at the maximum according to the first embodiment.
Figure 4A:
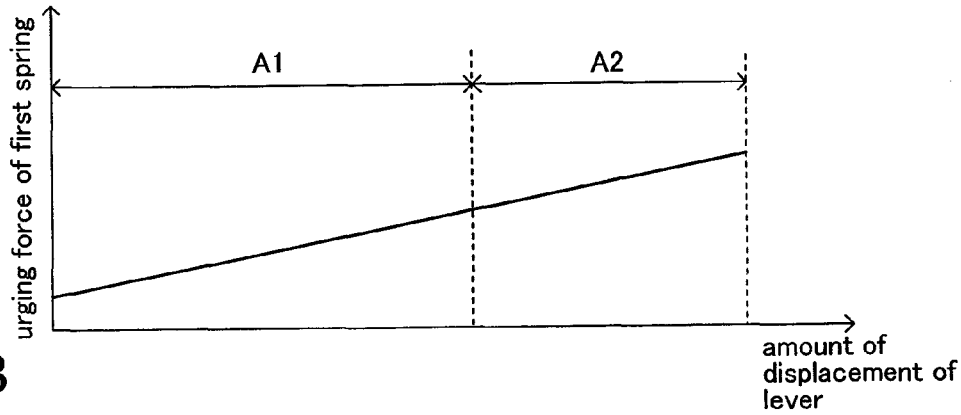
FIG. 4A is a graph showing characteristics of changes in the urging force of the first spring with respect to the amount of displacement of the lever according to the first embodiment.
Figure 4B:
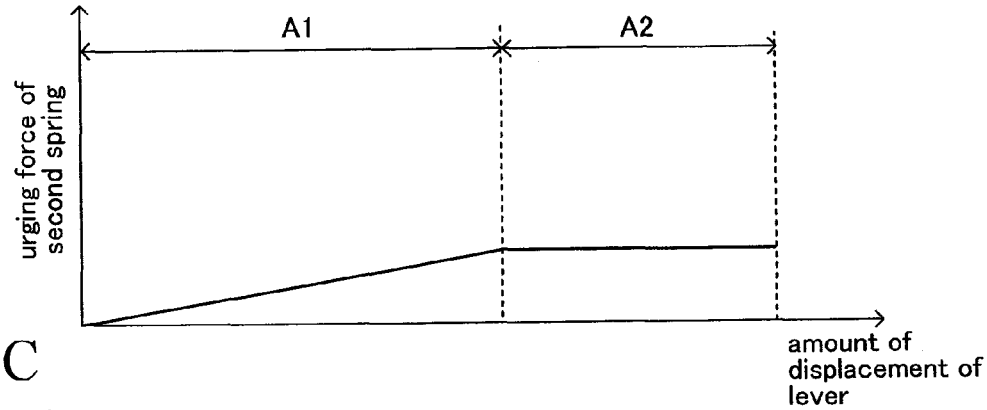
FIG. 4B is a graph showing characteristics of changes in the urging force of the second spring with respect to the amount of displacement of the lever according to the first embodiment.
Figure 4C:
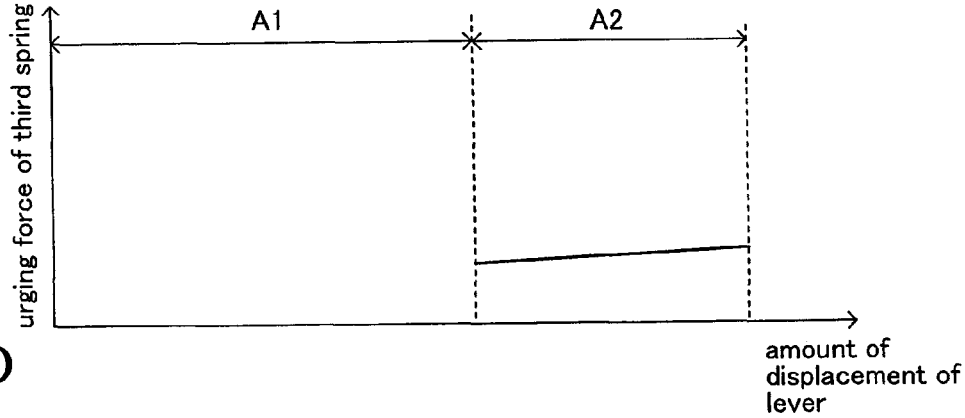
FIG. 4C is a graph showing characteristics of changes in the urging force of the third spring with respect to the amount of displacement of the lever according to the first embodiment.
Figure 4D:
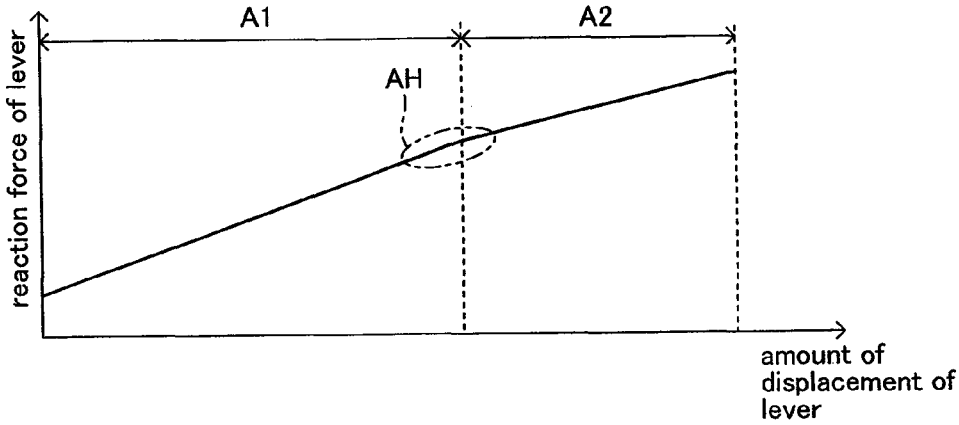
FIG. 4D is a graph showing characteristics of changes in the reaction force of the lever with respect to the amount of displacement of the lever according to the first embodiment.

Next, the operation of the pedal apparatus 12 configured as described above will be explained. FIG. 3A through FIG. 3C show various states in which the lever 40 is displaced, with the first spring 45, the second spring 46 and the third spring 47 being compressed. FIG. 4A, FIG. 4B and FIG. 4C show the urging force of the first spring 45, the second spring 46 and the third spring 47 with respect to the amount of displacement of the lever 40. FIG. 4D shows the reaction force generated by the lever 40 according to the displacement of the lever 40. In a state where the lever 40 is not depressed, the rear part of the lever 40 is urged downward by the first spring 45. As a result, the undersurface of the rear part of the lever 40 is in contact with the upper limit stopper 44, so that the lever 40 stands still to be in a state shown in FIG. 3A. In this state, the second spring 46 is in its natural length, resulting in the urging force exerted on the lever 40 of "0". In this state, furthermore, the movable supporting member 48 is in contact with the movable supporting member lower limit stopper 49 by the urging force of the third spring 47 and the weight of the movable supporting member 48, so that the movable supporting member 48 stands still. In this state, although the second spring 46 may be slightly compressed to urge the lever 40, the urging force of the second spring 46 is designed to be smaller than a combined force in which the urging force of the third spring 47 and the weight of the movable supporting member 48 are combined so that the movable supporting member 48 is in contact with the movable supporting member lower limit stopper 49.

If the player depresses the lever 40 in spite of the urging force exerted by the first spring 45, the lever 40 starts pivoting counterclockwise about the rotary shaft 42 in FIG. 3A, so that the rear part of the lever 40 is displaced upward. This displacement causes compression of the first spring 45 to increase the urging force exerted by the first spring 45 (A1 of FIG. 4A). If the urging force exerted by the second spring 46 is smaller than the combined force formed of the urging force exerted by the third spring 47 to urge the movable supporting member 48 downward and the weight of the movable supporting member 48, furthermore, the movable supporting member 48 remains to be in contact with the movable supporting member lower limit stopper 49. By the pivoting of the lever 40, as a result, the second spring 46 also starts compressing to increase the urging force exerted by the second spring 46 as well (A1 of FIG. 4B). In this operational range (from FIG. 3A to FIG. 3B), therefore, the reaction force of the lever 40 and the change in the reaction force are brought about by the first spring 45 and the second spring 46 (A1 of FIG. 4D).

Then, if the urging force exerted by the second spring 46 exceeds the combined force formed of the urging force exerted by the third spring 47 to urge the movable supporting member 48 downward and the weight of the movable supporting member 48, the movable supporting member 48 leaves the movable supporting member lower limit stopper 49 to move upward. The amount of depression of the lever 40 at the time of the start of upward move of the movable supporting member 48 is referred to as a first amount of depression. As described above, the spring constant of the third spring 47 is sufficiently small, compared with the second spring 46. If the amount of displacement of the lever 40 increases, therefore, the third spring 47 is compressed to increase the urging force of the third spring 47. However, the second spring 46 will be hardly compressed any further with little increase in the urging force of the second spring 46 (A2 of FIGS. 4B and A2 of FIG. 4C). In this operational range (from FIG. 3B to FIG. 3C), therefore, the reaction force of the lever 40 is brought about by the first spring 45, the second spring 46 and the third spring 47. Strictly speaking, the change in the reaction force is brought about by the first spring 45, the second spring 46 and the third spring 47. However, the spring constant of the third spring 47 is sufficiently smaller than that of the second spring 46, resulting in little compression of the second spring 46 and little increase in the urging force exerted by the second spring 46. Therefore, it can be considered that the change in the reaction force is brought about by the first spring 45 and the third spring 47 (A2 of FIG. 4D).

Then, the undersurface of the middle part of the lever 40 comes into contact with the lower limit stopper 43 to restrict downward displacement of the forward part of the lever 40. If the depression of the lever 40 is released, the urging forces exerted by the first spring 45, the second spring 46 and the third spring 47 cause the lever 40 to operate in the order opposite to that in which the lever 40 has operated on the depression of the lever 40. More specifically, the lever 40 pivots clockwise about the rotary shaft 42 in FIG. 3C, so that the undersurface of the rear part of the lever 40 comes into contact with the upper limit stopper 44 to recover to the original state (FIG. 3A). In the above-described explanation, the weight of the movable supporting member 48 is taken into account. In a case where the movable supporting member 48 is made of a light material such as resin, however, the weight of the movable supporting member 48 can be ignored.

The detection circuit 23 detects a point where the rate of change in the reaction force of the lever 40 changes on the basis of the change in the urging force exerted by the second spring 46 detected by the load sensor 50. Furthermore, the displacement sensor 51 detects the amount of displacement of the lever 40. In accordance with the changing point of the rate of change of the reaction force and the information on the amount of displacement of the lever 40, the electronic musical instrument 10 adds a damper effect to a musical tone to be generated, also controlling musical tone elements such as timbre and resonance (acoustic effect) of the musical tone to be generated. In a range AH of FIG. 4D corresponding to the above-described half pedal range AH of FIG. 34, particularly, on the basis of the load detected by the load sensor 50 and the amount of displacement detected by the displacement sensor 51, the tone generator 15 and the effect circuit 26 subtly change the musical tone elements such as timbre and resonance (acoustic effect) of musical tones to be generated in accordance with pedal manipulation of the player. The above-described control of the musical tone elements may be done on the basis of either of the load detected by the load sensor 50 or the amount of displacement detected by the displacement sensor 51.

Figure 34:
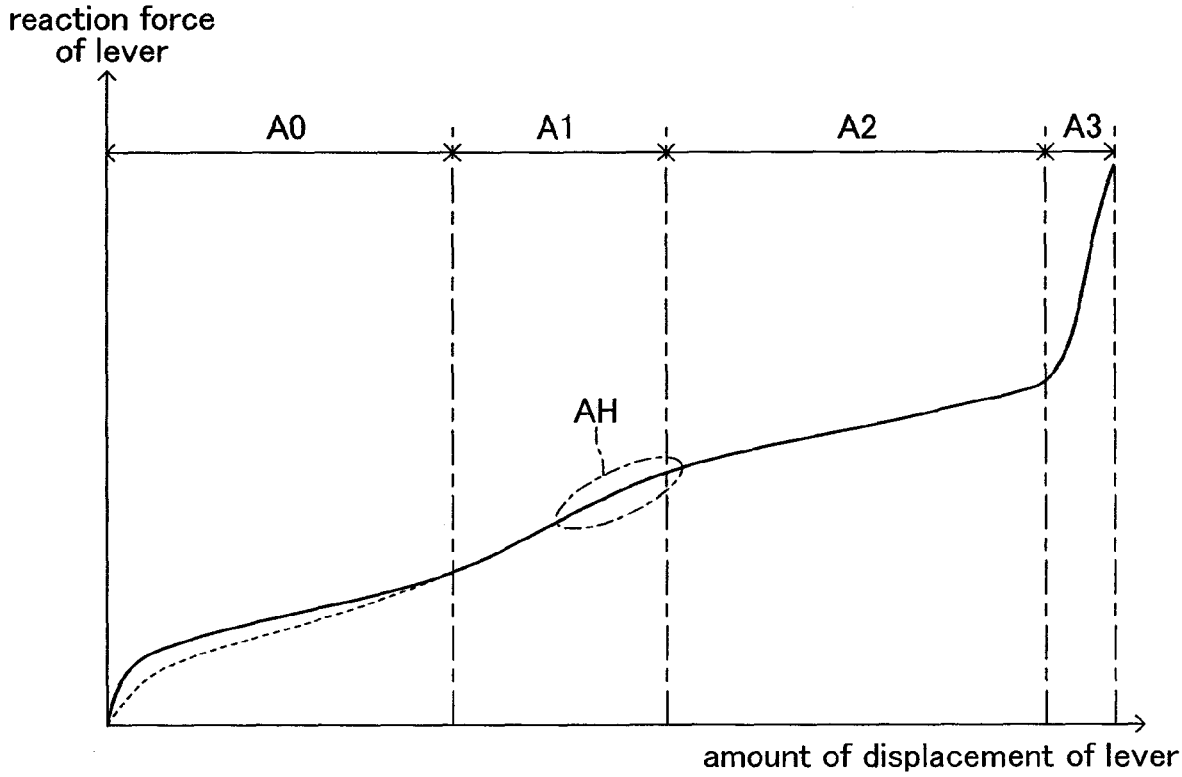
FIG. 34 is a graph showing characteristics of changes in the reaction force of the lever of an acoustic piano with respect to the amount of displacement of the lever.

The pedal apparatus according to the present embodiment configured as described above can achieve the characteristics (FIG. 4D) similar to those of the relationship between the amount of displacement of the lever from the start to the end of a depression of a pedal of an acoustic piano and the reaction force perceived by the player through the pedal as shown by the dashed line in FIG. 34. In the operational range (A1 of FIG. 4D) equivalent to A0 and A1 of FIG. 34, more specifically, the urging force exerted by the first spring 45 and the second spring 46 to urge the lever 40 changes, whereas in the operational range (A2 of FIG. 4D) equivalent to A2 of FIG. 34, the urging force exerted by the third spring 47 changes in addition to the urging force of the first spring 45. Because the spring constant of the third spring 47 is sufficiently smaller than that of the second spring 46, the rate of change in the reaction force in the operational range (A2 of FIG. 4D) equivalent to the range of A2 of FIG. 34 can be reduced, compared with the operational range (A1 of FIG. 4D) equivalent to the range of A0 and A1 of FIG. 34. Even if the spring constant of the third spring 47 is not sufficiently smaller than that of the second spring 46, or is larger than that of the second spring 46, in the operational range (A2 of FIG. 4D) equivalent to the range of A2 of FIG. 34, the serial connection of the second spring 46 and the third spring 47 results in the spring constant of the combined springs of the second spring 46 and the third spring 47 being smaller than the spring constant of the second spring 46. In this case as well, therefore, the rate of change in the reaction force in the operational range (A2 of FIG. 4D) can be reduced, compared with the rate of change in the reaction force of the operational range of A1 of FIG. 4D.

As for the acoustic piano, the range of A3 of FIG. 34 indicates a relationship between the amount of displacement of the lever caused by the lever and a linkage mechanism coming into contact with various stopper members to slightly compress the stopper members and the reaction force. This range is equivalent to a state of the pedal apparatus 12 of the present embodiment where the undersurface of the forward part of the lever 40 is in contact with the lower limit stopper 43. Therefore, the pedal apparatus 12 of the embodiment can realize the characteristics of the acoustic piano as shown by the dashed line in FIG. 34.

In a case where the player deeply depresses the lever 40 and then sharply decreases the amount of depression, and in a case where the player periodically changes the amount of depression of the lever 40, the movable supporting member 48 can temporarily oscillate due to collaboration of inertial force and spring force applied to the movable supporting member 48. Furthermore, the movable supporting member 48 can collide with the movable supporting member lower limit stopper 49 to cause oscillation of the movable supporting member 48. In a case where the player periodically changes the amount of depression of the lever 40 in the neighborhood of the range AH of FIG. 4, particularly, if the frequency of the periodic changes is close to the natural frequency of the second spring 46 or the third spring 47, the amplitude of the movable supporting member 48 can grow to cause periodic collision of the movable supporting member 48 with the movable supporting member lower limit stopper 49. The oscillation of the movable supporting member 48 is conveyed to the lever 40 through the second spring 46 to be perceived by the player as unnatural reaction force. As for the pedal apparatus 12 configured as described above, however, the respective spring forces of the second spring 46 and the third spring 47 act on the movable supporting member 48 in the directions opposite to each other. Therefore, the pedal apparatus 12 is able to suppress or quickly cease the oscillation. Furthermore, because the force of the springs acting on the lever 40 is divided into the spring force exerted by the first spring 45, and the spring force exerted by the second spring 46 and the third spring 47, the spring force exerted by the second spring 46 and the third spring 47 is small. As a result, the unnatural reaction force of the lever caused by the oscillation can be reduced. Therefore, the pedal apparatus 12 configured as described above can stabilize the reaction force of the lever 40.

In the above description, the weight of the movable supporting member 48 is taken into account. However, if the movable supporting member 48 is made of a light material such as resin, the weight of the movable supporting member 48 can be ignored. In this case, because the inertial force acting on the movable supporting member 48 can be also ignored, such a light movable supporting member 48 prevents the unnatural reaction force, also achieving reduction in weight of the pedal apparatus 12.

Due to variations in the spring constant of the first spring 45, the second spring 46 and the third spring 47, and depending on assembling accuracy of various parts, variations occur in the relationship between the amount of displacement of the lever 40 and the reaction force. As for the pedal apparatus 12 of the present embodiment, however, the load sensor 50 detects the reaction force of the lever 40 to find out a point where the rate of change in the reaction force changes. Therefore, the pedal apparatus 12 of the embodiment can reliably distinguish a range equivalent to the current amount of displacement of the lever 40 from among the ranges of FIG. 34. As a result, the pedal apparatus 12 of the embodiment can synchronize the feeling perceived by the player on the manipulation of the lever 40 with the start and the end of musical tone elements including damper effect to be added to musical tones to be generated and timbre, resonance (acoustic effect) and the like of musical tones to be generated.

Figure 2B:
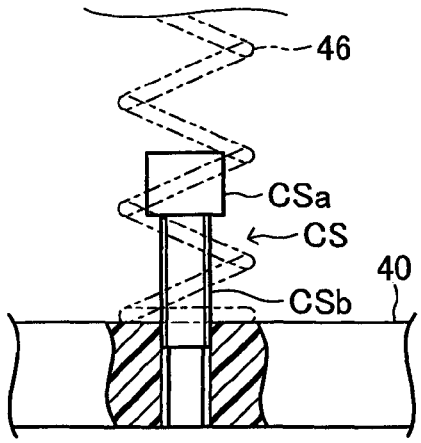
FIG. 2B is an enlarged view of a portion on which a capstan is mounted according to a modification of the first embodiment.

As shown in FIG. 2B, furthermore, a capstan CS may be added. The capstan CS has a cylindrical head portion CSa. Downward from the undersurface of the head portion CSa, a screw portion CSb whose diameter is slightly smaller than that of the head portion CSa extends. With a screw hole being provided on the top surface of the lever 40, the screw portion CSb is screwed into the screw hole to fix the capstan CS to the lever 40. The capstan CS is designed to have an outer diameter smaller than the interior diameter of the second spring 46 so that the central axis of the second spring 46 is overlaid with the central axis of the capstan CS. In other words, the capstan CS is situated inside the second spring 46. In a state where the lever 40 is not depressed, the top end of the head portion CSa is apart from the movable supporting member 48 to oppose to the undersurface of the movable supporting member 48. The length of the capstan CS is adjusted such that when the lever 40 is depressed to balance between the combined force formed of the urging force of the third spring 47 and the weight of the movable supporting member 48 and the urging force of the second spring 46, the capstan CS comes into contact with the undersurface of the movable supporting member 48.

In the case where the pedal apparatus 12 is configured as described above, while the movable supporting member 48 is apart from the movable supporting member lower limit stopper 49 to be displaced upward, the movable supporting member 48 is supported by the capstan CS to prevent further compression of the second spring 46. Therefore, the movable supporting member 48 can stably move upward and downward, resulting in stable reaction force exerted by the lever 40.

Figure 5A:
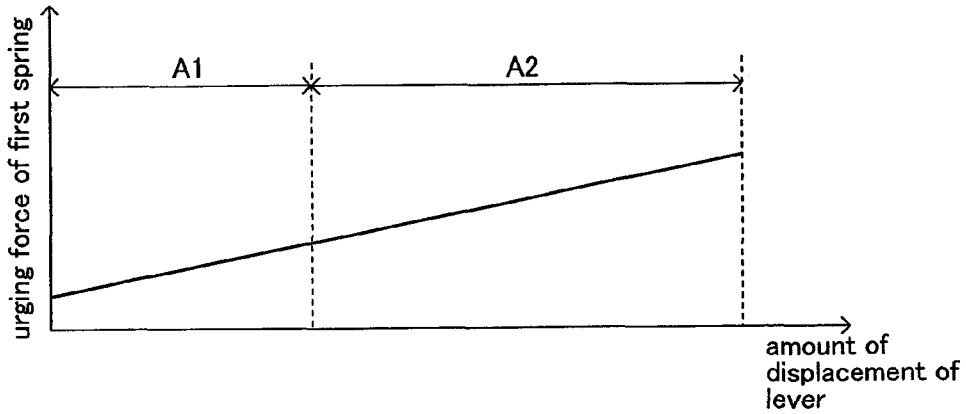
FIG. 5A is a graph showing characteristics of changes in the urging force of the first spring with respect to the amount of displacement of the lever according to the modification of the first embodiment.
Figure 5B:
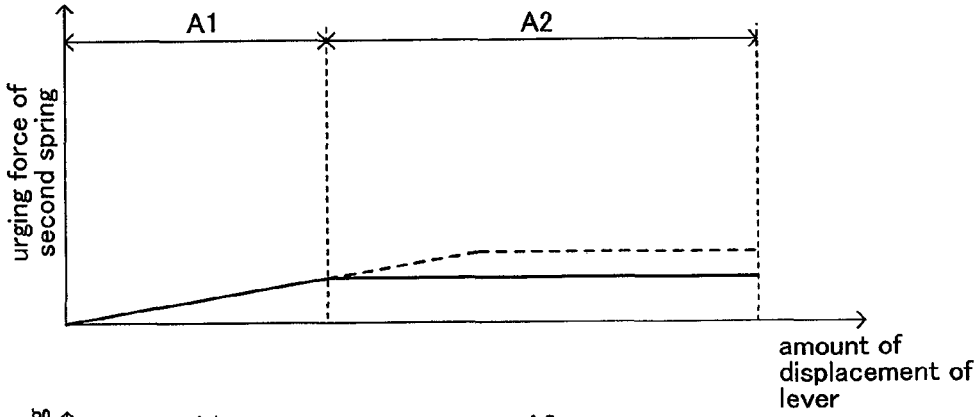
FIG. 5B is a graph showing characteristics of changes in the urging force of the second spring with respect to the amount of displacement of the lever according to the modification of the first embodiment.
Figure 5C:
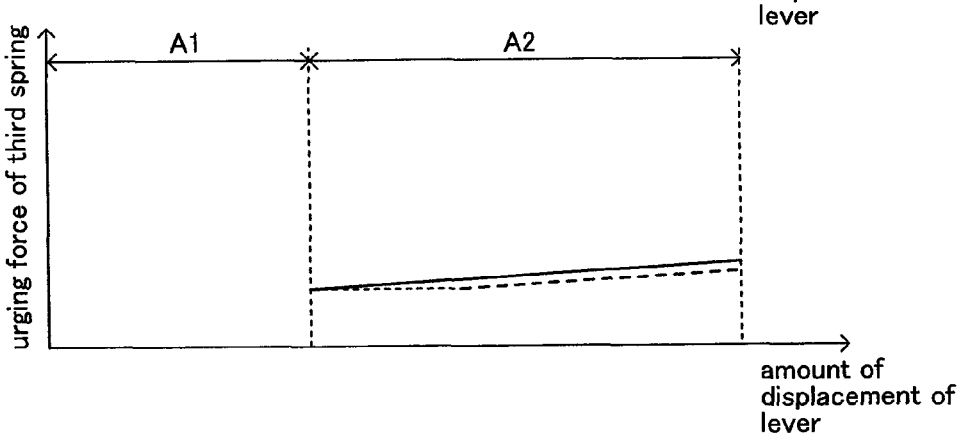
FIG. 5C is a graph showing characteristics of changes in the urging force of the third spring with respect to the amount of displacement of the lever according to the modification of the first embodiment.
Figure 5D:
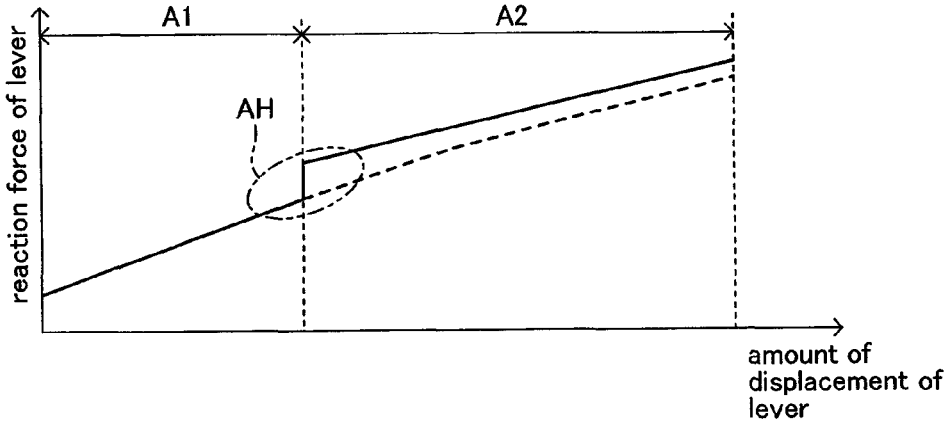
FIG. 5D is a graph showing characteristics of changes in the reaction force of the lever with respect to the amount of displacement of the lever according to the modification of the first embodiment.

The length of the capstan CS may be adjusted such that before the urging force of the second spring 46 exceeds the combined force formed of the urging force of the third spring 47 and the weight of the movable supporting member 48 after the depression of the lever 40, the capstan CS comes into contact with the undersurface of the movable supporting member 48. The respective urging forces of the first spring 45, the second spring 46 and the third spring 47 with respect to the amount of displacement of the lever 40 configured as described above are shown in FIG. 5A, FIG. 5B and FIG. 5C. The reaction force exerted by the lever 40 according to the displacement of the lever 40 is shown in FIG. 5D. For comparison, the respective urging forces of the respective springs and the reaction force of the lever 40 without the capstan CS are shown by dashed lines in FIG. 5A through FIG. 5D. In this case, from the start of a depression of the lever 40 until the contact of the capstan CS with the movable supporting member 48, the urging forces of the first spring 45 and the second spring 46 increase (A1 of FIG. 5A and FIG. 5B). Once the capstan CS comes into contact with the movable supporting member 48, the second spring 46 will not be compressed any further with no increase in the urging force any more (A2 of FIG. 5B). As a result, as long as the combined force formed of the force exerted by the lever 40 to urge the movable supporting member 48 upward through the capstan CS and the urging force of the second spring 46 is smaller than the combined force formed of the urging force of the third spring 47 and the weight of the movable supporting member 48, the movable supporting member 48 is in contact with the movable supporting member lower limit stopper 49 to stand still. If the combined force formed of the force exerted by the lever 40 to urge the movable supporting member 48 upward through the capstan CS and the urging force of the second spring 46 exceeds the combined force formed of the urging force of the third spring 47 and the weight of the movable supporting member 48, the movable supporting member 48 starts being displaced upward. Then, the third spring 47 is compressed to increase the urging force of the third spring 47 (A2 of FIG. 5C). In addition, the urging force of the first spring 45 also increases with the increase in the amount of depression of the lever 40 (A2 of FIG. 5A). Therefore, the reaction force of the lever 40 increases stepwise when the capstan CS comes into contact with the movable supporting member 48. Compared with the rate of change in the reaction force before the contact of the capstan CS with the movable supporting member 48, the rate of change in the reaction force after the contact is small (FIG. 5D).

As for this modification, on the boundary between the range where the rate of change in the reaction force is great and the range where the rate of change is small, the reaction force of the lever 40 changes stepwise. The stepwise change in the reaction force facilitates player's perception of the boundary. Compared with the pedal apparatus 12 without the capstan CS, furthermore, the pedal apparatus 12 having the capstan CS can narrow the range where the rate of change in the reaction force is great (A1 of FIG. 5D) and widen the range where the rate of change in the reaction force is small (A2 of FIG. 5D).

Although this modification is designed such that the capstan CS is situated inside the second spring 46, the capstan CS may be placed anywhere as long as the top end of the capstan CS opposes to the undersurface of the movable supporting member 48. Alternatively, the capstan CS may be placed on the movable supporting member 48 side so that the head portion CSa of the capstan CS opposes to the top surface of the lever 40.

The above-described first embodiment is designed such that the top end of the first spring 45 is fixed to the frame FR situated above the rear part of the lever 40, with the lower end of the first spring 45 being in contact with the top surface of the rear part of the lever 40. However, the first embodiment may be modified such that the lower end of the first spring 45 is fixed to the frame FR situated below the forward part of the lever 40, with the top end of the first spring 45 being contact with the undersurface of the forward part of the lever 40. Furthermore, the first embodiment is designed such that the top end of the third spring 47 is fixed to the frame FR situated above the rear part of the lever 40, with the lower end of the third spring 47 being inserted into the concave portion 48*a* of the movable supporting member 48 to be fixed to the bottom surface of the concave portion 48*a* so that the third spring 47 is supported by the movable supporting member 48. However, the first embodiment may be modified such that the movable supporting member 48 has a spring supporting portion so that the spring supporting portion supports the top end of an extension spring with the lower end of the spring being fixed to the frame FR situated below the movable supporting member 48.

In the first embodiment, furthermore, the mechanism which urges the lever 40 is provided behind the rotary shaft 42 of the lever 40 to be situated above the lever 40. However, the first embodiment may be modified to turn the mechanism which urges the lever 40 upside down. More specifically, the mechanism which urges the lever 40 may be provided in front of the rotary shaft 42 of the lever 40 to be situated below the lever 40. Unlike the first embodiment, the upward displacement of the movable supporting member 48 is restricted in this modification. In this modification as well, the first spring 45, the second spring 46 and the third spring 47 urge upward the undersurface of the lever 40 on a point situated in front of the rotary shaft 42 to achieve the effect similar to that achieved by the first embodiment. In this modification, oppositely to the first embodiment, the weight of the movable supporting member 48 acts in a direction in which the displacement of the movable supporting member 48 is allowed. In this modification as well, in a case where the movable supporting member 48 is made of a light material, the weight of the movable supporting member 48 can be ignored.

Figure 6:
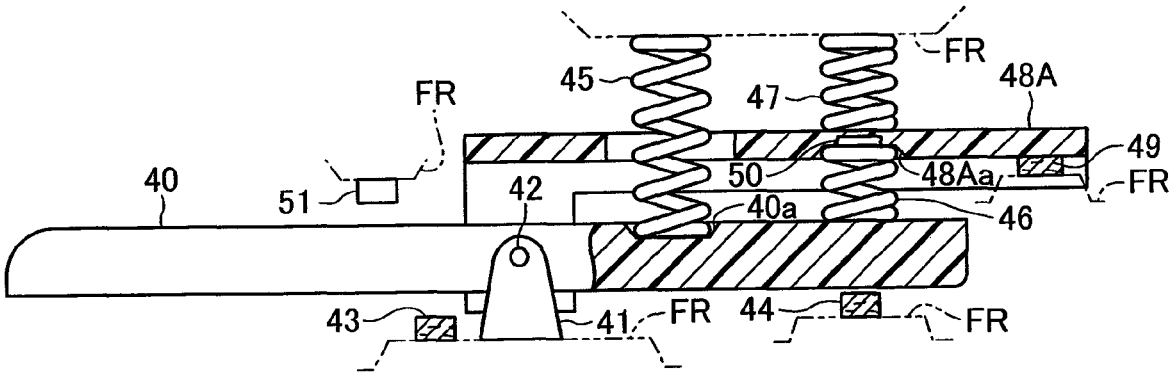
FIG. 6 is a side view of the pedal apparatus according to a modification of the first embodiment.

The first embodiment is designed such that the movable supporting member 48 can move upward and downward. However, the embodiment may be modified to have a movable supporting member 48A which pivots in response to the lever 40 as shown in FIG. 6. The movable supporting member 48A is formed of an upper plate extending toward the front and the rear and a side plate extending downward from the left end or the right end of the upper plate. The forward part of the movable supporting member 48A is supported by the lever supporting portion 41 so that the rear end of the movable supporting member 48A can pivot upward and downward about the rotary shaft 42. The downward displacement of the rear end of the movable supporting member 48A is restricted by the movable supporting member lower limit stopper 49 fixed to the frame FR. Into the concave portion 40*a* provided on the top surface of the lever 40 behind the lever supporting portion 41, the lower end of the first spring 45 is inserted to be fixed to the bottom surface of the concave portion 40*a* to be supported. In the middle of the upper plate of the movable supporting member 48A, a hole penetrating from the top surface to the undersurface is provided. The first spring 45 passes through the hole so that the top end of the first spring 45 is fixed to the frame FR situated above. Although the modification is designed such that the movable supporting member 48A is provided with the hole so that the first spring 45 passes through the hole, this configuration is not necessarily required. More specifically, the first spring 45 may be provided outside the movable supporting member 48A. Into a concave portion 48Aa provided on the undersurface of the rear part of the upper plate of the movable supporting member 48A, the top end of the second spring 46 is inserted to be fixed to the upper bottom surface of the concave portion 48Aa, with the lower end of the second spring 46 being in contact with the top surface of the rear part of the lever 40. With the top surface of the rear part of the movable supporting member 48A, the lower end of the third spring 47 is in contact, with the top end of the third spring 47 being fixed to the frame FR situated above. Such a modification can also achieve the effect similar to that achieved by the first embodiment.

Figure 7:
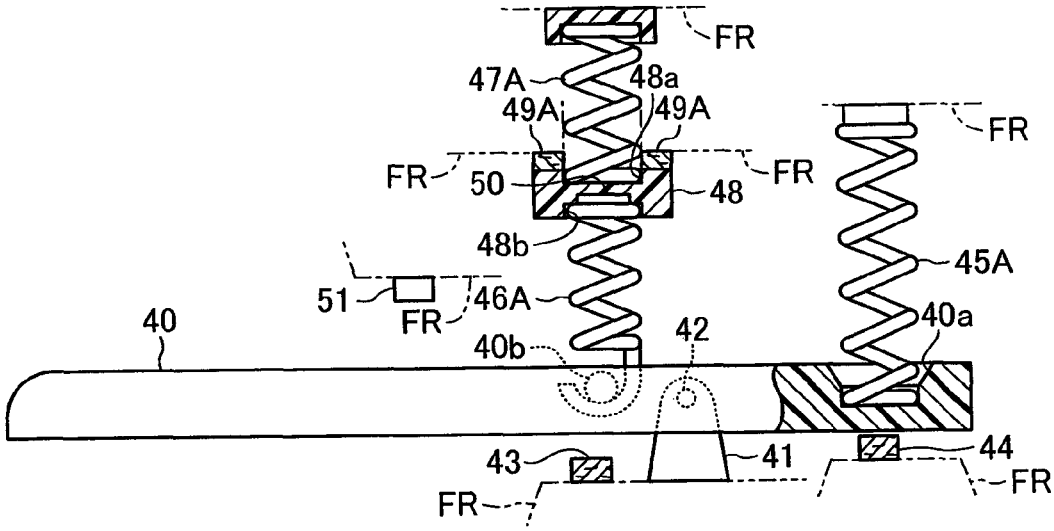
FIG. 7 is a side view of the pedal apparatus according to the other modification of the first embodiment.

In the first embodiment and its modifications, the second spring 46 and the third spring 47 are compression springs. However, the second spring 46 and the third spring 47 may be replaced with a second spring 46A and a third spring 47A, respectively, which are extension springs as shown in FIG. 7. In this modification, the second spring 46A and the third spring 47A are provided in front of the rotary shaft 42 of the lever 40 to be situated above the lever 40. Into the concave portion 48*a* of the movable supporting member 48, the lower end of the third spring 47A is inserted to be fixed to the bottom surface of the concave portion 48*a* to be supported. The top end of the third spring 47A is fixed to the frame FR situated above the movable supporting member 48. The top end of the second spring 46A is inserted into the concave portion 48*b* of the movable supporting member 48 to be fixed to the upper bottom surface of the concave portion 48*b* to be supported. The lower end of the second spring 46A is shaped like a hook. The lever 40 is provided with a spring supporting portion 40*b* which engages the hook provided on the lower end of the second spring 46A. The hook provided on the lower end of the second spring 46A is in contact with the spring supporting portion 40*b* at all times. The upward displacement of the movable supporting member 48 is restricted by a movable supporting member upper limit stopper 49A fixed to the frame FR. Such a modification can also achieve the effect similar to that achieved by the first embodiment. In this modification as well, oppositely to the first embodiment, the weight of the movable supporting member 48 acts in the direction in which the displacement of the movable supporting member 48 is allowed. Therefore, this modification is designed such that the extension spring force exerted by the second spring 46A is smaller than the extension spring force exerted by the third spring 47A so that the movable supporting member 48 will not be displaced downward in a state where the amount of displacement of the lever 40 is small (A1 of FIG. 4D). In this modification as well, in a case where the movable supporting member 48 is made of a light material, the weight of the movable supporting member 48 can be ignored.

c. Second Embodiment

Figure 8:
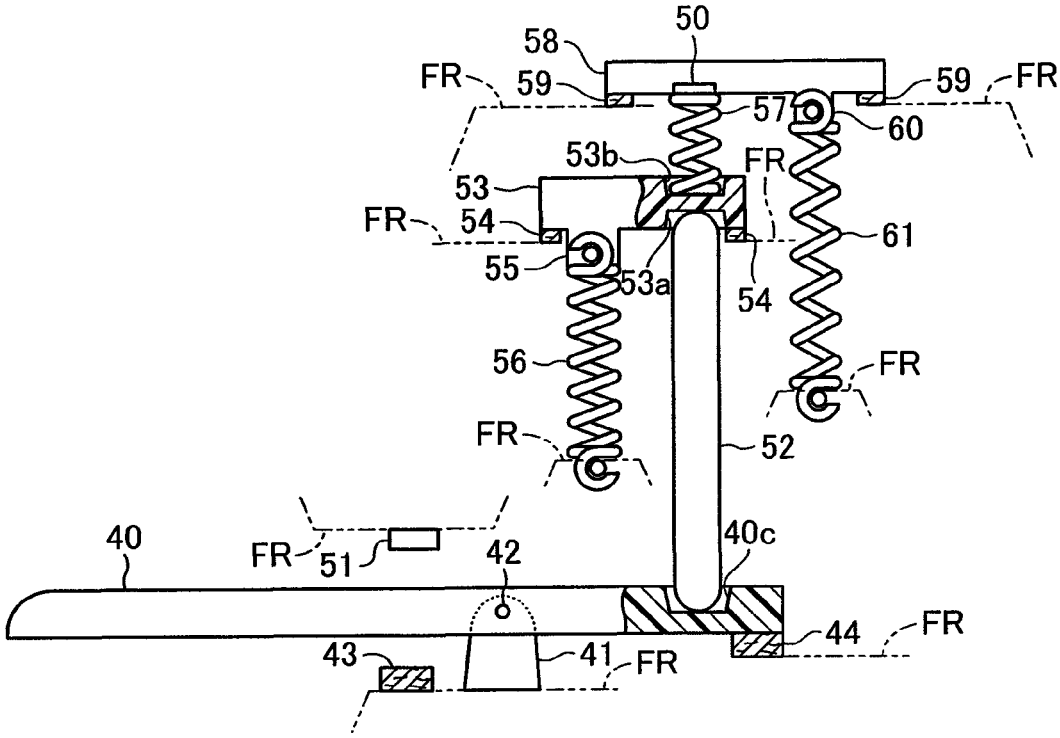
FIG. 8 is a side view of the pedal apparatus according to the second embodiment.

Next, a second embodiment of the pedal apparatus 12 according to the present invention will be described in detail. FIG. 8 is a side view of the pedal apparatus 12 according to the present embodiment. The lever 40, the lever supporting portion 41, the lower limit stopper 43 and the upper limit stopper 44 are similar to those of the first embodiment. Into a concave portion 40*c* provided on the top surface of the rear part of the lever 40 to be situated behind the rotary shaft 42 of the lever 40, the lower end of a drive rod 52 is inserted to be in contact with the bottom surface of the concave portion 40*c*. The drive rod 52, which is a long member, extends upward from the rear part of the lever 40. The top end of the drive rod 52 is inserted into a concave portion 53*a* provided on the undersurface of a first movable supporting member 53 to be in contact with the upper bottom surface of the concave portion 53*a*. By a guide member which is not shown, the drive rod 52 is allowed to move only upward and downward.

The first movable supporting member 53, which is a plate-shaped member, is allowed to move only upward and downward by a guide member which is not shown. The downward displacement of the first movable supporting member 53 is restricted by a first movable supporting member lower limit stopper 54 fixed to the frame FR. The first movable supporting member lower limit stopper 54 is also made of a shock-absorbing member such as felt in order to prevent shock noise. On the undersurface of the first movable supporting member 53, a spring supporting portion 55 is provided so that the top end of a first spring 56 is fixed to the spring supporting portion 55 to be supported by the spring supporting portion 55. The lower end of the first spring 56 is fixed to the frame FR situated below the first movable supporting member 53. The first spring 56 is an extension spring. Into a concave portion 53*b* provided on the top surface of the first movable supporting member 53, the lower end of a second spring 57 is inserted to be fixed to the concave portion 53*b* to be supported. The second spring 57 is a compression spring.

Above the second spring 57, a second movable supporting member 58 is provided. The second movable supporting member 58, which is a plate-shaped member, is allowed to move only upward and downward by a guide member which is not shown. The downward displacement of the second movable supporting member 58 is restricted by a second movable supporting member lower limit stopper 59 fixed to the frame FR. The second movable supporting member lower limit stopper 59 is also made of a shock-absorbing member such as felt in order to prevent shock noise. The top end of the second spring 57 is in contact with the undersurface of the second movable supporting member 58. On the undersurface of the second movable supporting member 58, a spring supporting portion 60 is provided so that the top end of a third spring 61 is fixed to the spring supporting portion 60 to be supported. The lower end of the third spring 61 is fixed to the frame FR situated below the second movable supporting member 58. The third spring 61 is an extension spring. If comparisons of spring constant are made among the first spring 56, the second spring 57 and the third spring 61, the first spring 56 has the largest spring constant. The spring constant of the third spring 61 is sufficiently small when compared with the spring constant of the first spring 56 and the second spring 57. In this embodiment, similarly to the first embodiment, the relationship of the magnitude of the spring constant among the first to third springs 56, 57, 61 is not limited to that of the present embodiment, but can vary according to desired characteristics of reaction force of the lever 40. In a case where the difference of rate of change in the reaction force is small between range A1 and range A2 shown in FIG. 34, for instance, the third spring 61 may have a larger spring constant than the second spring 57. Similarly to the first embodiment, the load sensor 50 is provided on the undersurface of the second movable supporting member 58, while the displacement sensor 51 is provided on the frame FR.

Next, the operation of the pedal apparatus 12 configured as described above will be described. In a state where the lever 40 is not depressed, the first movable supporting member 53 is urged downward by the first spring 56 to be in contact with the first movable supporting member lower limit stopper 54. As a result, the rear part of the lever 40 is urged downward through the drive rod 52. Resultantly, the undersurface of the rear part of the lever 40 is in contact with the upper limit stopper 44, so that the lever 40 stands still to be in the state shown in FIG. 8. In this state, the second spring 57 is in its natural length, resulting in the urging force exerted on the lever 40 of "0". In this state, furthermore, the second movable supporting member 58 is in contact with the second movable supporting member lower limit stopper 59 by the urging force of the third spring 61 and the weight of the second movable supporting member 58. In this state, although the second spring 57 may be slightly compressed to urge the lever 40 through the drive rod 52, the urging force of the second spring 57 is designed to be smaller than a combined force in which the urging force of the third spring 61 and the weight of the second movable supporting member 58 are combined so that the second movable supporting member 58 is in contact with the second movable supporting member lower limit stopper 59.

If the player depresses the lever 40 in spite of the urging force exerted by the first spring 56, the lever 40 starts pivoting counterclockwise about the rotary shaft 42 in FIG. 8, so that the rear part of the lever 40 is displaced upward. By this displacement, the drive rod 52 causes the first movable supporting member 53 to be displaced upward. As a result, the first spring 56 is extended to increase the urging force exerted on the lever 40 by the first spring 56 (A1 of FIG. 4A). If the urging force exerted by the second spring 57 is smaller than the combined force formed of the urging force exerted by the third spring 61 to urge the second movable supporting member 58 downward and the weight of the second movable supporting member 58, furthermore, the second movable supporting member 58 remains to be in contact with the second movable supporting member lower limit stopper 59. By the upward displacement of the first movable supporting member 53, as a result, the second spring 57 also starts compressing to increase the urging force exerted by the second spring 57 (A1 of FIG. 4B). In this operational range, therefore, the reaction force of the lever 40 and the change in the reaction force are brought about by the first spring 56 and the second spring 57 (A1 of FIG. 4D).

Then, if the urging force exerted by the second spring 57 exceeds the combined force formed of the urging force exerted by the third spring 61 to urge the second movable supporting member 58 downward and the weight of the second movable supporting member 58, the second movable supporting member 58 moves upward. The amount of depression of the lever 40 at the time of the start of upward move of the second movable supporting member 58 is referred to as the first amount of depression. As described above, the spring constant of the third spring 61 is sufficiently small, compared with the second spring 57. If the amount of displacement of the lever 40 increases, therefore, the third spring 61 is extended to increase the urging force of the third spring 61. However, the second spring 57 will be hardly compressed any further with little increase in the urging force of the second spring 57 (A2 of FIG. 4B and A2 of FIG. 4C). In this operational range, therefore, the reaction force of the lever 40 is brought about by the first spring 56, the second spring 57 and the third spring 61. Strictly speaking, the change in the reaction force is brought about by the first spring 56, the second spring 57 and the third spring 61. However, the spring constant of the third spring 61 is sufficiently smaller than that of the second spring 57, resulting in little compression of the second spring 57 and little increase in the urging force exerted by the second spring 57. Therefore, it can be considered that the change in the reaction force is brought about by the first spring 56 and the third spring 61 (A2 of FIG. 4D).

Then, the undersurface of the middle part of the lever 40 comes into contact with the lower limit stopper 43 to restrict downward displacement of the forward part of the lever 40. If the depression of the lever 40 is released, the urging forces exerted by the first spring 56, the second spring 57 and the third spring 61 cause the lever 40 to operate in the order opposite to that in which the lever 40 has operated on the depression of the lever 40. More specifically, the lever 40 pivots clockwise about the rotary shaft 42 in FIG. 8, so that the undersurface of the rear part of the lever 40 comes into contact with the upper limit stopper 44 to recover to the original state (FIG. 8). The load sensor 50 and the displacement sensor 51 operate similarly to the first embodiment to control the damper effect and musical tone elements of musical tones to be generated as in the case of the first embodiment. In the above-described explanation, the weight of the second movable supporting member 58 is taken into account. In a case where the second movable supporting member 58 is made of a light material such as resin, however, the weight of the second movable supporting member 58 can be ignored.

Similarly to the first embodiment, as for the pedal apparatus according to the embodiment configured as described above, the urging forces exerted by the first spring 56, the second spring 57 and the third spring 61 change according to the ranges equivalent to the respective operational ranges shown in FIG. 34. As a result, the pedal apparatus according to the present embodiment can achieve the characteristics (FIG. 4D) similar to those of the relationship between the amount of displacement of the lever from the start to the end of a depression of a pedal of an acoustic piano and the reaction force perceived by the player through the pedal as shown by the dashed line in FIG. 34.

In the present embodiment, similarly to the first embodiment, in the case where the player deeply depresses the lever 40 and then sharply decreases the amount of depression, and in the case where the player periodically changes the amount of depression of the lever 40, the second movable supporting member 58 can temporarily oscillate due to collaboration of inertial force and spring force. Furthermore, the second movable supporting member 58 can collide with the second movable supporting member lower limit stopper 59. As for the present embodiment as well, however, the respective spring forces of the second spring 57 and the third spring 61 act on the second movable supporting member 58 in the directions opposite to each other. Therefore, the pedal apparatus 12 is able to suppress or quickly cease the oscillation. Furthermore, because the force of the springs acting on the lever 40 is divided into the spring force exerted by the first spring 56, and the spring force exerted by the second spring 57 and the third spring 61, the spring force exerted by the second spring 57 and the third spring 61 is small. As a result, the unnatural reaction force of the lever caused by the oscillation can be reduced. Therefore, the pedal apparatus 12 can stabilize the reaction force of the lever 40.

In the above description, the weight of the second movable supporting member 58 is taken into account. However, if the second movable supporting member 58 is made of a light material such as resin, the weight of the second movable supporting member 58 can be ignored. In this case, because the inertial force acting on the second movable supporting member 58 can be also ignored, such a light second movable supporting member 58 prevents the unnatural reaction force, also achieving reduction in weight of the pedal apparatus 12.

In addition, because the load sensor 50 and the displacement sensor 51 operate similarly to the first embodiment, the pedal apparatus 12 of the present embodiment can synchronize the feeling perceived by the player on the manipulation of the lever 40 with the start and the end of musical tone elements including damper effect to be added to musical tones to be generated, and timbre, resonance (acoustic effect) and the like of musical tones to be generated.

Between the first movable supporting member 53 and the second movable supporting member 58, the capstan CS similar to that of the modification of the first embodiment may be provided. Such a modification also achieves the effect similar to the modification of the first embodiment.

In the second embodiment, the top end of the first spring 56 is supported by the spring supporting portion 55 provided on the first movable supporting member 53, with the lower end of the first spring 56 being fixed to the frame FR situated below the first movable supporting member 53. However, the second embodiment may be modified such that the top end of a compression spring is fixed to the frame FR situated above the first movable supporting member 53, with the lower end of the compression spring being in contact with the top surface of the first movable supporting member 53. The second embodiment is designed such that the lower end of the second spring 57 is inserted into the concave portion 53*b* of the first movable supporting member 53 to be fixed to the upper bottom surface of the concave portion 53*b* to be supported. However, the second embodiment may be modified such that a concave portion is provided on the undersurface of the second movable supporting member 58 so that the top end of the second spring 57 is fixed to the upper bottom surface of the concave portion to be supported, with the lower end of the second spring 57 being inserted into the concave portion 53*b* of the first movable supporting member 53 to be in contact with the concave portion 53*b*. Furthermore, the second embodiment is designed such that the top end of the third spring 61 is supported by the spring supporting portion 60 of the second movable supporting portion 58, with the lower end of the third spring 61 being fixed to the frame FR situated below the second movable supporting member 58. However, the second embodiment may be modified such that the top end of a compression spring is fixed to the frame FR situated above the second movable supporting member 58, with the lower end of the compression spring being in contact with the top surface of the second movable supporting member 58.

In the second embodiment, furthermore, the mechanism which urges the lever 40 is provided behind the rotary shaft 42 of the lever 40 to be situated above the lever 40. However, the second embodiment may be modified to turn the mechanism which urges the lever 40 upside down. More specifically, the mechanism which urges the lever 40 may be provided in front of the rotary shaft 42 of the lever 40 to be situated below the lever 40. Unlike the second embodiment, the upward displacement of the first movable supporting member 53 and the second movable supporting member 58 is restricted in this modification. In this modification as well, the first spring 56, the second spring 57 and the third spring 61 urge upward the undersurface of the lever 40 on a point situated in front of the rotary shaft 42 to achieve the effect similar to that achieved by the second embodiment. In this modification, oppositely to the second embodiment, the weight of the second movable supporting member 58 acts in a direction in which the displacement of the second movable supporting member 58 is allowed. In this modification as well, in a case where the second movable supporting member 58 is made of a light material, the weight of the second movable supporting member 58 can be ignored.

Figure 9:
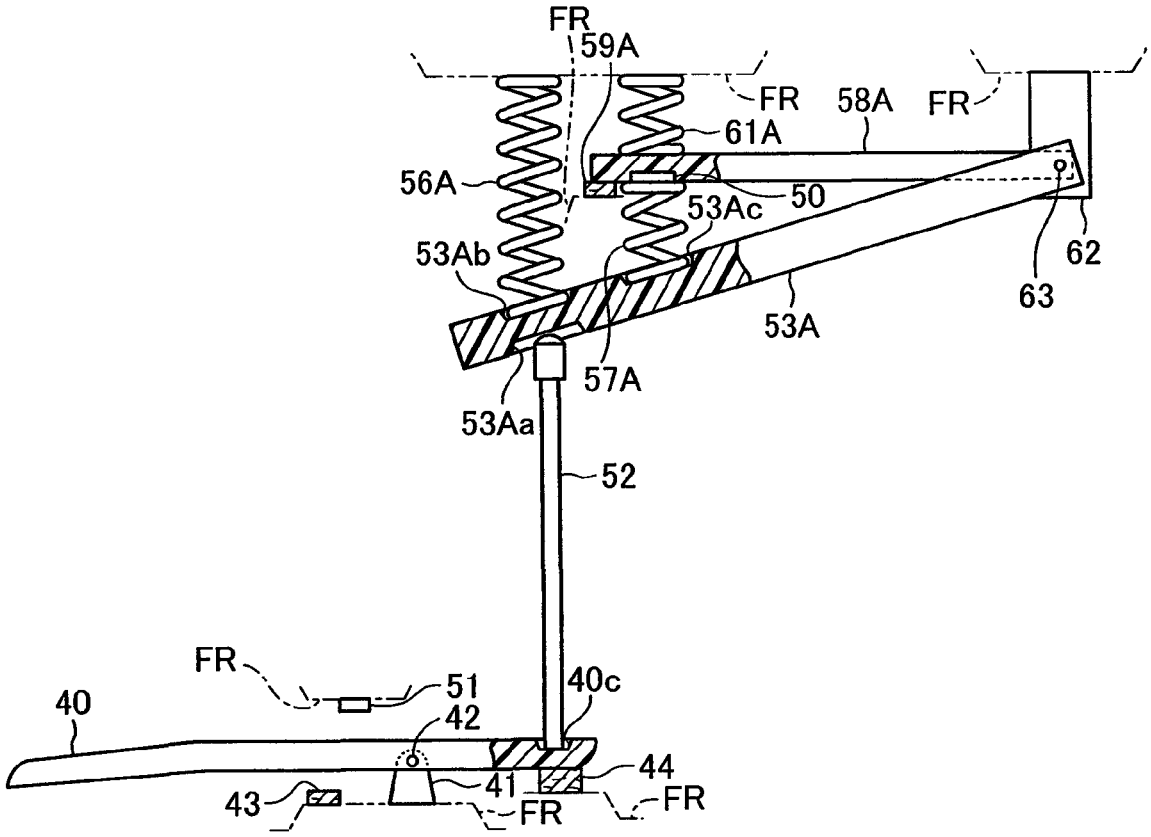
FIG. 9 is a side view of the pedal apparatus according to a modification of the second embodiment.

The second embodiment is designed such that the first movable supporting member 53 and the second movable supporting member 58 can move only upward and downward. However, the embodiment may be modified to have a first movable supporting member 53A and a second movable supporting member 58A which pivot in response to the lever 40 as shown in FIG. 9. Each of the first movable supporting member 53A and the second movable supporting member 58A is a plate-shaped member which extends from the front toward the rear of the pedal apparatus 12. The respective first and second movable supporting members 53A, 58A are supported by a supporting portion 62 on their rear part so that the front end of the respective movable supporting members 53A, 58A can pivot upward and downward about a rotary shaft 63. The second movable supporting member 58A is situated above the first movable supporting member 53A. The downward displacement of the front end of the second movable supporting member 58A is restricted by the second movable supporting member lower limit stopper 59A fixed to the frame FR. The top end of the drive rod 52 is in contact with a concave portion 53Aa provided on the undersurface of the forward part of the first movable supporting member 53A. On the top surface of the forward part of the first movable supporting member 53A, a concave portion 53Ab is provided so that the lower end of a first spring 56A is inserted into the concave portion 53Ab to be fixed to the concave portion 53Ab to be supported, with the top end of the first spring 56A being fixed to the frame FR situated above to be supported by the frame FR. The first spring 56A is a compression spring. The first spring 56A urges the front end of the lever 40 upward through the drive rod 52. On the top surface of the middle part of the first movable supporting member 53A, a concave portion 53Ac is provided so that the lower end of a second spring 57A is inserted into the concave portion 53Ac to be fixed to the concave portion 53Ac, with the top end of the second spring 57A being in contact with the undersurface of the middle part of the second movable supporting member 58A. To the top surface of the middle part of the second movable supporting member 58A, the lower end of a third spring 61A is fixed, with the top end of the third spring 61A being fixed to the frame FR situated above. In this modification as well, in the operational range of A1 of FIG. 4D, the urging force of the third spring 61A and the weight of the second movable supporting member 58A cause the second movable supporting member 58A to be in contact with a second movable supporting member lower limit stopper 59A so that the second movable supporting member 58A stands still. Such a modification can also achieve the effect similar to that achieved by the second embodiment. In this modification as well, the second spring 57A is designed to have a spring force smaller than that of the third spring 61A to prevent upward displacement of the second movable supporting member 58A in a state where the amount of displacement of the lever 40 is small (A1 of FIG. 4D). In this modification as well, in a case where the second movable supporting member 58A is made of a light material, the weight of the second movable supporting member 58A can be ignored.

Between the first movable supporting member 53A and the second movable supporting member 58A, the capstan CS similar to that of the modification of the first embodiment may be provided. Such a modification also achieves the effect similar to the modification of the first embodiment.

d. Third Embodiment

Figure 10:
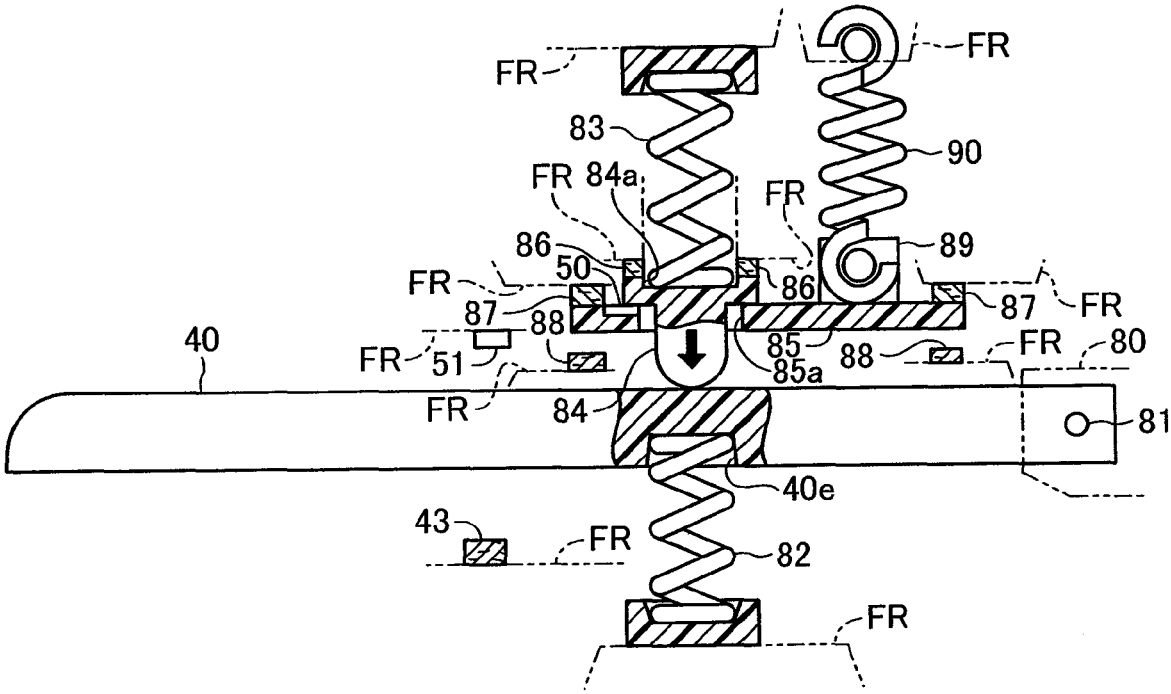
FIG. 10 is a side view of the pedal apparatus according to the third embodiment.

Next, a third embodiment of the pedal apparatus 12 according to the present invention will be described in detail. FIG. 10 is a side view of the pedal apparatus 12 according to the present embodiment. The lever 40 and the lower limit stopper 43 are similar to those of the first embodiment. The rear end of the lever 40 is supported by a lever supporting portion 80 provided on the frame FR so that the front end of the lever 40 can pivot upward and downward about a rotary shaft 81. Below the middle part of the lever 40, the lower end of a first spring 82 is fixed to the frame FR, with the top end of the first spring 82 being inserted into a concave portion 40*e* provided on the undersurface of the lever 40 to be in contact with the upper bottom surface of the concave portion 40*e* to urge the forward part of the lever 40 upward. The first spring 82 is a compression spring.

Above the middle part of the lever 40, the top end of a second spring 83 is fixed to the frame FR, with the lower end of the second spring 83 being inserted into a concave portion 84*a* provided on the top surface of a pressing member 84 situated above the lever 40 to be fixed to the bottom surface of the concave portion 84*a*. The second spring 83 is a compression spring. The pressing member 84 is included in a movable supporting member of the present invention. The upper portion of the pressing member 84 is shaped like a circular plate, while the lower portion from the middle of the pressing member 84 is shaped like a cylinder of smaller diameter than the upper portion. The lower end of the pressing member 84 is shaped like a hemisphere. The pressing member 84 is provided on a movable supporting member 85 so that the pressing member 84 passes through a penetrating hole 85*a* which penetrates from the top surface to the undersurface of the movable supporting member 85 to be in contact with the top surface of the lever 40. The undersurface of the upper circular plate portion of the pressing member 84 is always in contact with the top surface of the movable supporting member 85. The pressing member 84 is allowed to move only upward and downward by a guide member which is not shown. In addition, the upward move of the pressing member 84 is restricted by a pressing member upper limit stopper 86. Although this embodiment is designed to provide the penetrating hole 85*a* on the movable supporting member 85 so that the pressing member 84 penetrates the penetrating hole 85*a*, such a configuration is not necessarily required. More specifically, the pressing member 84 may be provided outside the movable supporting member 85.

The movable supporting member 85, which is a plate-shaped member, is allowed to move only upward and downward by a guide member which is not shown. The upward and downward move of the movable supporting member 85 is restricted to a certain range by a movable supporting member upper limit stopper 87 and a movable supporting member lower limit stopper 88. The movable supporting member upper limit stopper 87 and the movable supporting member lower limit stopper 88 are also made of a shock-absorbing member such as felt in order to prevent shock noise. On the top surface of the movable supporting member 85, a spring supporting portion 89 is provided so that the lower end of a third spring 90 is fixed to the spring supporting portion 89 to be supported by the spring supporting portion 89. The top end of the third spring 90 is fixed to the frame FR situated above the movable supporting member 85. The third spring 90 is an extension spring. If comparisons of spring constant are made among the first spring 82, the second spring 83 and the third spring 90, the first spring 82 has the smallest spring constant. The spring constant of the second spring 83 and the third spring 90 is larger than the spring constant of the first spring 82. The spring constant of the third spring 90 is slightly larger than the spring constant of the second spring 83. In this embodiment, similarly to the first embodiment, the relationship of the magnitude of the spring constant among the first to third springs 82, 83, 90 is not limited to that of the present embodiment, but can vary according to desired characteristics of the reaction force of the lever 40. In the case where the difference of rate of change in the reaction force is small between range A1 and range A2 shown in FIG. 34, for instance, the second spring 83 and the third spring 90 may have a smaller spring constant. Similarly to the first embodiment, the load sensor 50 is provided on a part of the top surface of the movable supporting member 85, the part of the top surface coming into contact with the pressing member 84. Similarly to the first embodiment, in addition, the displacement sensor 51 is provided on the frame FR.

Figure 11A:
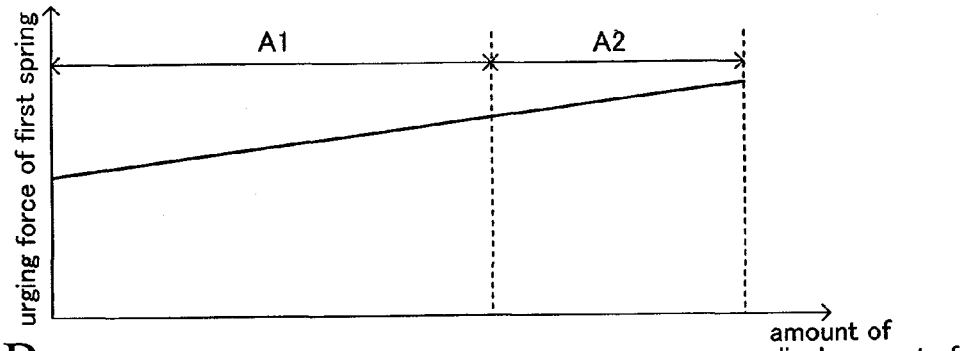
FIG. 11A is a graph showing characteristics of changes in the urging force of the first spring with respect to the amount of displacement of the lever according to the third embodiment.
Figure 11B:
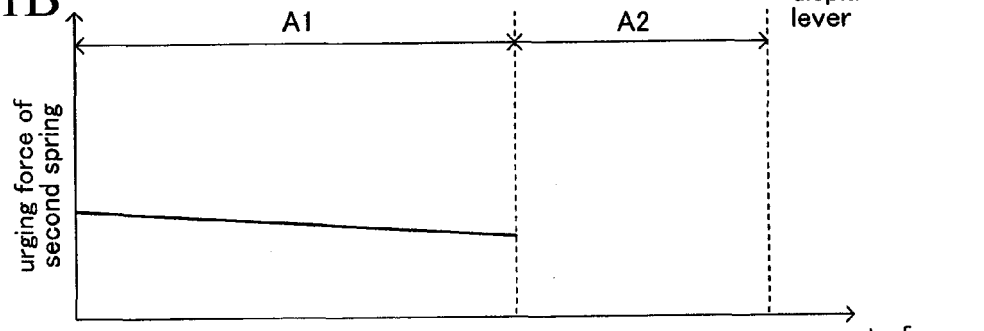
FIG. 11B is a graph showing characteristics of changes in the urging force of the second spring with respect to the amount of displacement of the lever according to the third embodiment.
Figure 11C:
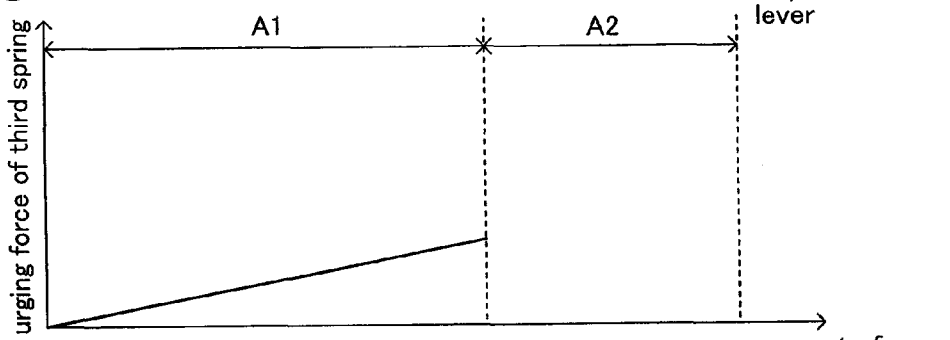
FIG. 11C is a graph showing characteristics of changes in the urging force of the third spring with respect to the amount of displacement of the lever according to the third embodiment.
Figure 11D:
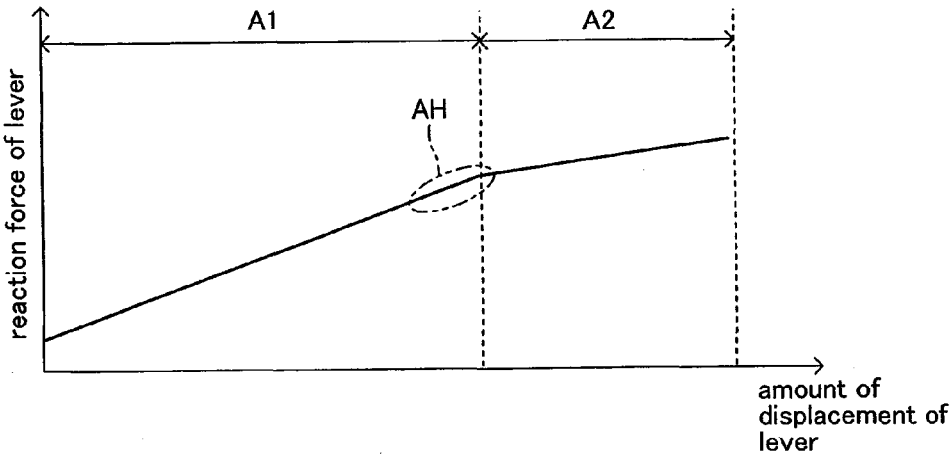
FIG. 11D is a graph showing characteristics of changes in the reaction force of the lever with respect to the amount of displacement of the lever according to the third embodiment.

Next, the operation of the pedal apparatus 12 configured as described above will be explained. FIG. 11A, FIG. 11B, and FIG. 11C show the urging force exerted by the first spring 82, the second spring 83 and the third spring 90 with respect to the amount of displacement of the lever 40. FIG. 11D shows the reaction force generated by the lever 40 according to displacement of the lever 40. In FIG. 11A and FIG. 11C, the urging force exerted in a direction resisting depression of the lever 40 is regarded as positive. In FIG. 11B, the urging force exerted in a direction facilitating depression of the lever 40 is regarded as positive. In a state where the lever 40 is not depressed, the urging force exerted by the first spring 82 to urge the lever 40 upward causes the lever 40 to pivot clockwise about a rotary shaft 81 in FIG. 10 to push up the pressing member 84 so that the top surface of the pressing member 84 comes into contact with the pressing member upper limit stopper 86 to make the lever 40 stand still to be in the state of FIG. 10. Furthermore, the movable supporting member 85 comes into contact with the movable supporting member upper limit stopper 87, also being in contact with the pressing member 84 as well. In this state, both the first spring 82 and the second spring 83 are compressed.

If the player depresses the lever 40 in spite of the urging force exerted by the first spring 82, the lever 40 starts pivoting counterclockwise about the rotary shaft 81 in FIG. 10, so that the forward part of the lever 40 is displaced downward. On this displacement, the first spring 82 is compressed to increase the urging force exerted by the first spring 82 (A1 of FIG. 11A). Because the second spring 83 is released from compression, the urging force exerted by the second spring 83 decreases (A1 of FIG. 11B). The direction in which the first spring 82 urges the lever 40 is the direction resisting the depression of the lever 40, while the direction in which the second spring 83 urges the lever 40 is the direction facilitating the depression.

The second spring 83 urges the lever 40 downward, also urging the movable supporting member 85 downward. As a result, the third spring 90 is extended to increase its urging force (A1 of FIG. 11C). The urging force of the second spring 83 and the third spring 90 at the start of depression of the lever 40 is adjusted such that, in this operational range (A1 of FIG. 11A through FIG. 11D), the urging force of the third spring 90 is smaller than the urging force of the second spring 83. The reaction force of the lever 40 is obtained by subtracting the urging force of the second spring 83 from the force in which the urging force of the third spring 90 is added to the urging force of the first spring 82. Therefore, the change in the reaction force is brought about by the first spring 82, the second spring 83 and the third spring 90 (A1 of FIG. 11D).

If the amount of displacement of the lever 40 increases further, the urging force exerted by the first spring 82 also increases further (A2 of FIG. 11A). The undersurface of the movable supporting member 85 comes into contact with the movable supporting member lower limit stopper 88 to restrict downward displacement of the movable supporting member 85, so that the tip of the pressing member 84 leaves the top surface of the lever 40. The amount of depression of the lever which triggers the restriction of downward displacement of the movable supporting member 85 is referred to as the first amount of depression. In this operational range, therefore, the reaction force which resists depression of the lever 40 is brought about only by the first spring 82, while the change in the reaction force is also brought about only by the first spring (A2 of FIG. 11D).

Then, the undersurface of the middle part of the lever 40 comes into contact with the lower limit stopper 43 to restrict downward displacement of the forward part of the lever 40. If the depression of the lever 40 is released, the urging forces exerted by the first spring 82, the second spring 83 and the third spring 90 cause the lever 40 to operate in the order opposite to that in which the lever 40 has operated on the depression of the lever 40. More specifically, the lever 40 pivots clockwise about the rotary shaft 81 in FIG. 10 to push up the pressing member 84, so that the top surface of the pressing member 84 comes into contact with the pressing member upper limit stopper 86 to stand still. As a result, the pedal apparatus 12 recovers to the original state (FIG. 10). The load sensor 50 and the displacement sensor 51 operate similarly to the first embodiment.

The pedal apparatus according to the present embodiment configured as described above can achieve the characteristics similar to those of the relationship between the amount of displacement of the lever from the start to the end of a depression of a pedal of an acoustic piano and the reaction force perceived by the player through the pedal as shown by the dashed line in FIG. 34. In the operational range (A1 of FIG. 11D) equivalent to A0 and A1 of FIG. 34, more specifically, although part of the urging force exerted by the first spring 82 is canceled by the urging force exerted by the second spring 83, part of the urging force of the second spring 83 is canceled by the third spring 90. The parallel connection of the first to third springs 82, 83, 90 results in the spring constant of the combined springs being larger than the spring constant of the first spring 82.

In the operational range (A2 of FIG. 11D) equivalent to A2 of FIG. 34, the urging force of the first spring 82 is designed not to be canceled by the second spring 83 and the third spring 90. Compared with the operational range (A1 of FIG. 11D) equivalent to A0 and A1 of FIG. 34, therefore, the rate of change in the reaction force in the operational range (A2 of FIG. 11D) equivalent to A2 of FIG. 34 can be reduced. As a result, the pedal apparatus 12 according to the present embodiment achieves the characteristics of the acoustic piano shown in FIG. 34.

In the case where the player sharply decreases the amount of depression of the lever 40 or in the case where the player periodically changes the amount of depression of the lever 40, the lever 40 occasionally collides with the pressing member 84. The impact caused by the collision of the lever 40 with the pressing member 84 is absorbed by the first spring 82 and the second spring 83. Therefore, the present embodiment can stabilize the reaction force of the lever 40.

In addition, because the load sensor 50 and the displacement sensor 51 operate similarly to the first embodiment, the pedal apparatus 12 of the present embodiment can synchronize the feeling perceived by the player on the manipulation of the lever 40 with the start and the end of musical tone elements including damper effect to be added to musical tones to be generated and timbre, resonance (acoustic effect) and the like of musical tones to be generated.

In the third embodiment, the lower end of the first spring 82 is fixed to the frame FR situated below the middle part of the lever 40, with the top end of the first spring 82 being inserted into the concave portion 40*e* provided on the undersurface of the middle part of the lever 40 to be in contact with the bottom surface of the concave portion 40*e*. However, the third embodiment may be modified such that a spring supporting portion is provide on the top surface of the middle part of the lever 40 so that the lower end of an extension spring is supported by the spring supporting portion, with the top end of the extension spring being fixed to the frame FR situated above the middle part of the lever 40. In the third embodiment, furthermore, the lower end of the third spring 90 is supported by the spring supporting portion 89 of the movable supporting member 85, with the top end of the third spring 90 being fixed to the frame FR. However, the third embodiment may be modified such that a concave portion is provided on the undersurface of the movable supporting member 85 so that the top end of a compression spring is fixed to the upper bottom surface of the concave portion to be supported by the movable supporting member 85, with the lower end of the compression spring being fixed to the frame FR situated below the movable supporting member 85.

In the third embodiment, furthermore, the mechanism which urges the lever 40 is provided in front of the rotary shaft 81 of the lever 40. However, the third embodiment may be modified such that the lever 40 is supported on the middle part of the lever 40 as in the case of the first embodiment to provide the mechanism which urges the lever 40 behind the fulcrum. In this modification, the first spring 82 is turned upside down, compared with the third embodiment, so that the first spring 82 is provided behind and above the fulcrum of the lever 40. The second spring 83, the third spring 90, the pressing member 84, the second movable supporting member 85 and the stoppers thereof are also turned upside down, compared with the third embodiment, so that they are provided behind and below the fulcrum of the lever 40. In this modification, unlike the third embodiment, downward displacement of the pressing member 84 is restricted, whereas upward displacement of the movable supporting member 85 is restricted. In this modification as well, the first spring 82 and the third spring 90 generate the spring force resisting depression of the lever 40, with the second spring 83 generating the spring force facilitating depression of the lever 40 to achieve the effect similar to the third embodiment.

e. Fourth Embodiment

Figure 12:
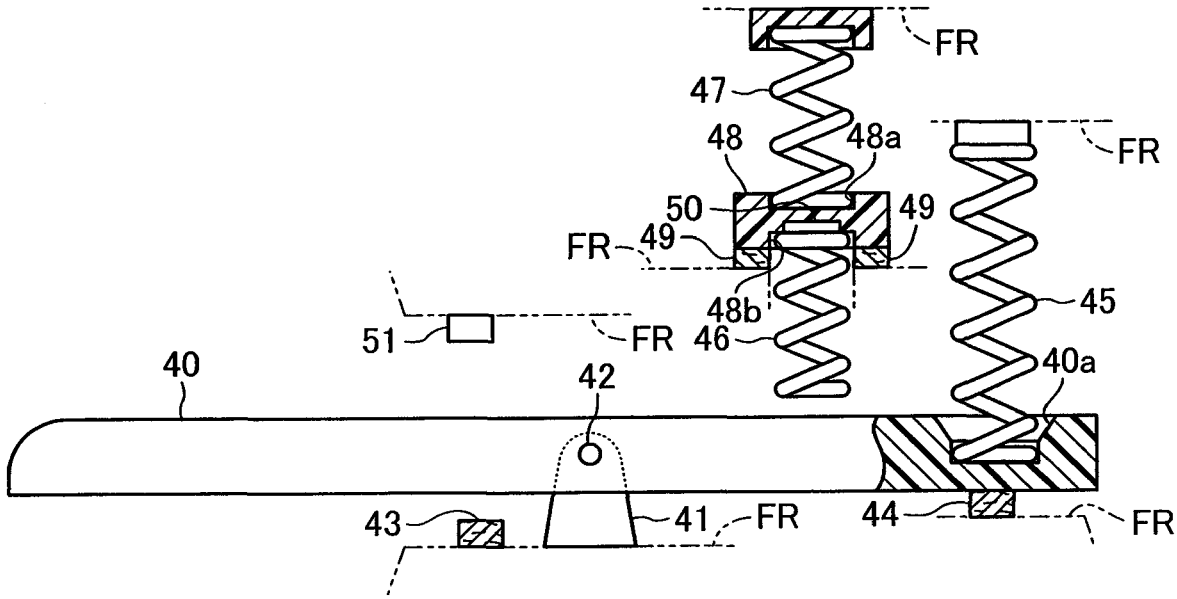
FIG. 12 is a side view of the pedal apparatus according to the fourth embodiment.

Next, a fourth embodiment of the pedal apparatus 12 according to the present invention will be described in detail. FIG. 12 is a side view of a pedal apparatus of an electronic musical instrument according to the present embodiment. This embodiment is configured almost similarly to the first embodiment shown in FIG. 2A. Unlike the first embodiment, however, in a state where the lever 40 is not depressed, the lower end of the second spring 46 is apart from the lever 40.

Next, the operation of the pedal apparatus 12 configured as described above will be explained. FIG. 13A through FIG. 13D shows various states in which the lever 40 is displaced, with the first spring 45, the second spring 46 and the third spring 47 being compressed. FIG. 14A, FIG. 14B and FIG. 14C show the urging force of the first spring 45, the second spring 46 and the third spring 47 with respect to the amount of displacement of the lever 40. FIG. 14D shows the reaction force generated by the lever 40 according to the displacement of the lever 40. In a state where the lever 40 is not depressed, the rear part of the lever 40 is urged downward by the first spring 45. As a result, the undersurface of the rear part of the lever 40 is in contact with the upper limit stopper 44, so that the lever 40 stands still to be in a state shown in FIG. 13A. In this state, the movable supporting member 48 is in contact with the movable supporting member lower limit stopper 49 by the urging force of the third spring 47, so that the movable supporting member 48 stands still.

Figure 13A:
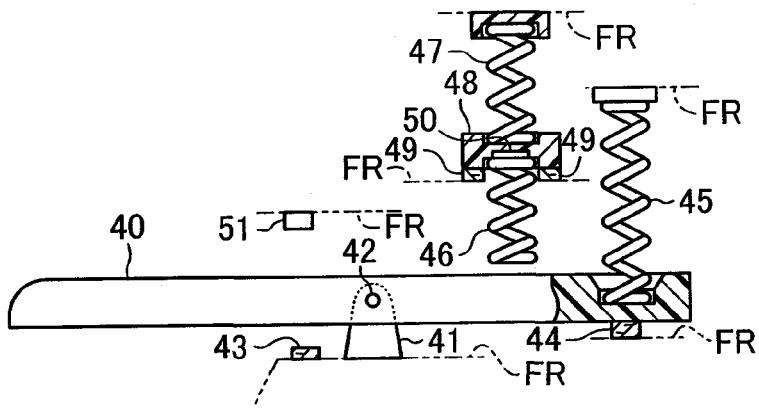
FIG. 13A is a diagram showing the position of the lever and the state where the first spring, the second spring and the third spring are compressed in a state where the lever is not depressed according to the fourth embodiment.
Figure 13B:
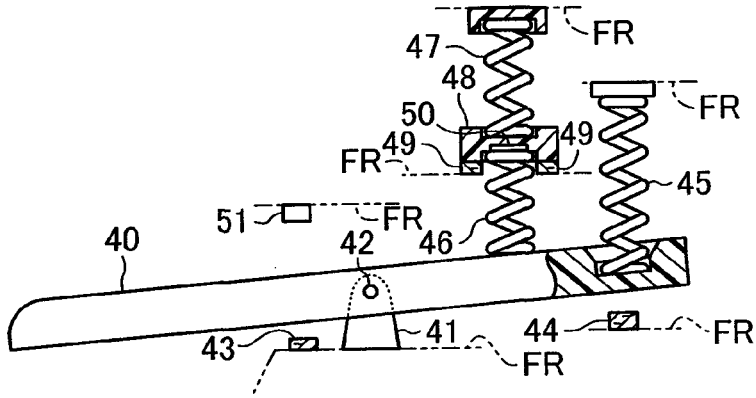
FIG. 13B is a diagram showing the position of the lever and the state where the first spring, the second spring and the third spring are compressed in a state where the lever comes into contact with the second spring according to the fourth embodiment.
Figure 13C:
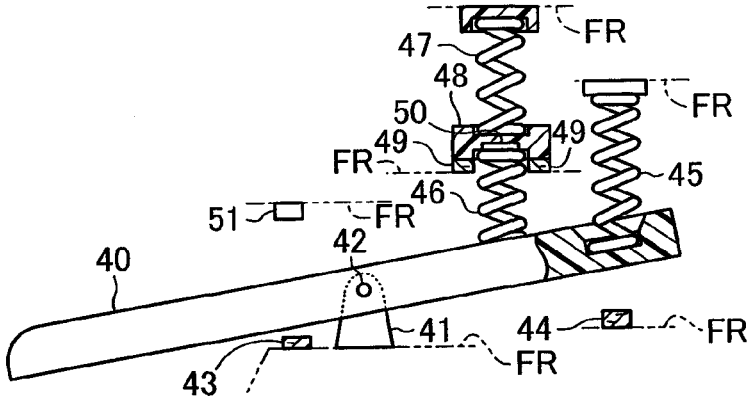
FIG. 13C is a diagram showing the position of the lever and the state where the first spring, the second spring and the third spring are compressed in a state where the movable supporting member starts being displaced according to the fourth embodiment.
Figure 13D:
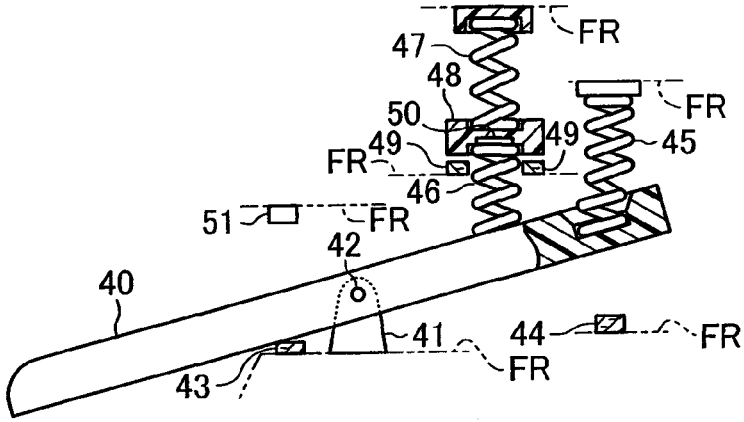
FIG. 13D is a diagram showing the position of the lever and the state where the first spring, the second spring and the third spring are compressed in a state where the amount of depression of the lever is at the maximum according to the fourth embodiment.
Figure 14A:
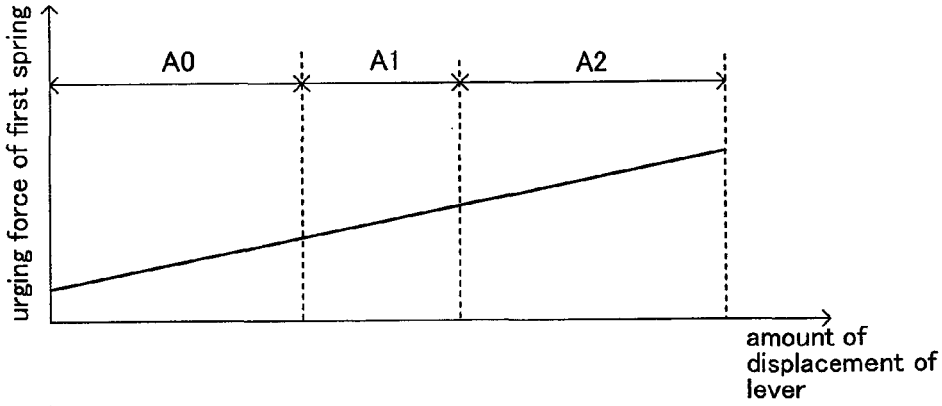
FIG. 14A is a graph showing characteristics of changes in the urging force of the first spring with respect to the amount of displacement of the lever according to the fourth embodiment.
Figure 14B:
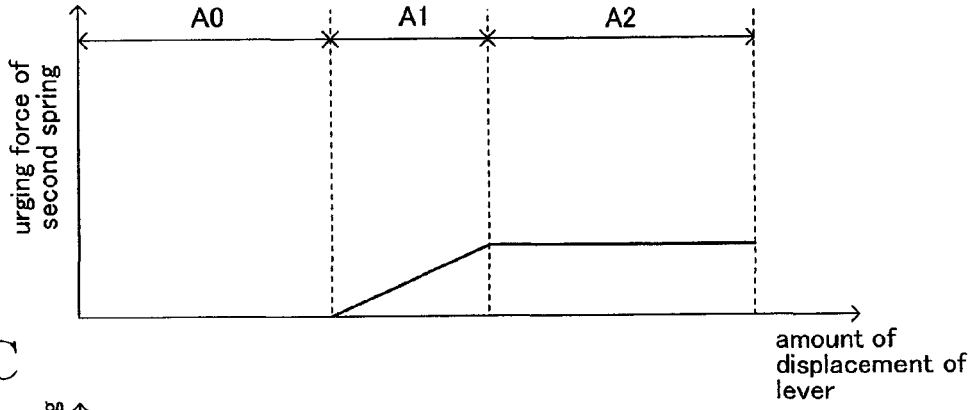
FIG. 14B is a graph showing characteristics of changes in the urging force of the second spring with respect to the amount of displacement of the lever according to the fourth embodiment.
Figure 14C:
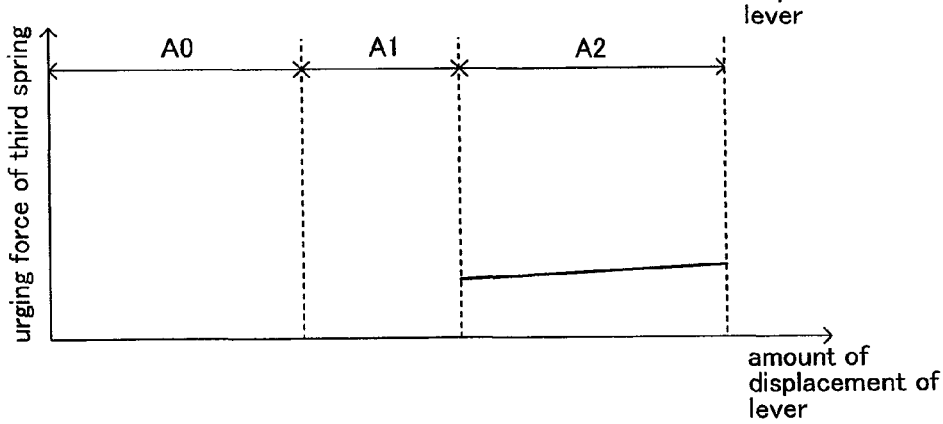
FIG. 14C is a graph showing characteristics of changes in the urging force of the third spring with respect to the amount of displacement of the lever according to the fourth embodiment.
Figure 14D:
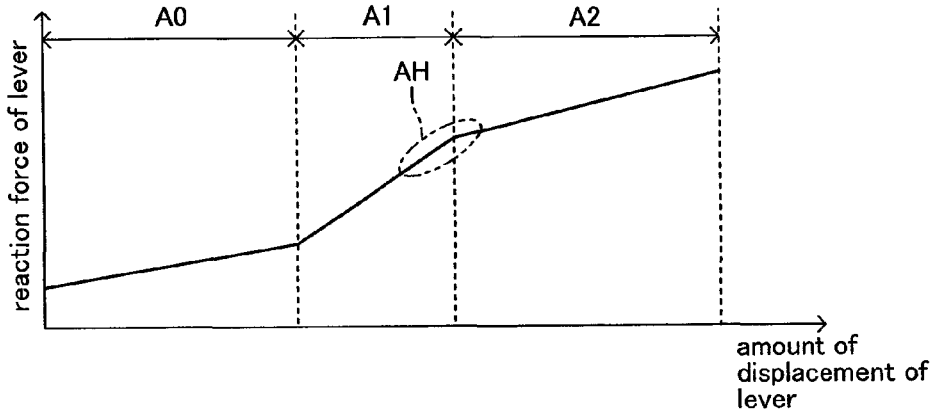
FIG. 14D is a graph showing characteristics of changes in the reaction force of the lever with respect to the amount of displacement of the lever according to the fourth embodiment.

If the player depresses the lever 40 in spite of the urging force exerted by the first spring 45, the lever 40 starts pivoting counterclockwise about the rotary shaft 42 in FIG. 13A, so that the rear part of the lever 40 is displaced upward. This displacement causes compression of the first spring 45 to increase the urging force exerted by the first spring 45 (A0 of FIG. 14A). In this operational range (from FIG. 13A to FIG. 13B), the lower end of the second spring 46 is not in contact with the lever 40. In this operational range, therefore, the reaction force of the lever 40 and the change in the reaction force are brought about by the first spring 45 (A0 of FIG. 14D).

If the player depresses the lever 40 further to increase the amount of the displacement of the lever 40, the urging force exerted by the first spring 45 on the lever 40 increases further (A1 of FIG. 14A). The lower end of the second spring 46 comes into contact with the top surface of the lever 40. The amount of depression of the lever 40 at the time of the contact of the lower end of the second spring 46 with the top surface of the lever 40 is referred to as a second amount of depression. If the urging force exerted by the second spring 46 is smaller than the combined force formed of the urging force exerted by the third spring 47 to urge the movable supporting member 48 downward and the weight of the movable supporting member 48, the movable supporting member 48 remains to be in contact with the movable supporting member lower limit stopper 49. By the pivoting of the lever 40, as a result, the second spring 46 also starts compressing to increase the urging force exerted by the second spring 46 (A1 of FIG. 14B). In this operational range (from FIG. 13B to FIG. 13C), therefore, the reaction force of the lever 40 and the change in the reaction force are brought about by the first spring 45 and the second spring 46 (A1 of FIG. 14D).

If the amount of the displacement of the lever 40 increases further, the urging force of the first spring 45 also increases further (A2 of FIG. 14A). Then, if the urging force exerted by the second spring 46 exceeds the combined force formed of the urging force exerted by the third spring 47 to urge the movable supporting member 48 downward and the weight of the movable supporting member 48, the movable supporting member 48 leaves the movable supporting member lower limit stopper 49 to move upward. The amount of depression of the lever 40 at the time of the start of upward move of the movable supporting member 48 is referred to as the first amount of depression. Similarly to the first embodiment, the spring constant of the third spring 47 is sufficiently small, compared with the second spring 46. If the amount of displacement of the lever 40 increases, therefore, the third spring 47 is compressed to increase the urging force of the third spring 47. However, the second spring 46 will be hardly compressed any further with little increase in the urging force of the second spring 46 (A2 of FIG. 14B and FIG. 14C). In this operational range (from FIG. 13C to FIG. 13D), therefore, the reaction force of the lever 40 is brought about by the first spring 45, the second spring 46 and the third spring 47. Strictly speaking, the change in the reaction force is brought about by the first spring 45, the second spring 46 and the third spring 47. However, the spring constant of the third spring 47 is sufficiently smaller than that of the second spring 46, resulting in little compression of the second spring 46 and little increase in the urging force exerted by the second spring 46. Therefore, it can be considered that the change in the reaction force is brought about by the first spring 45 and the third spring 47 (A2 of FIG. 14D).

Then, the undersurface of the middle part of the lever 40 comes into contact with the lower limit stopper 43 to restrict downward displacement of the forward part of the lever 40. If the depression of the lever 40 is released, the urging forces exerted by the first spring 45, the second spring 46 and the third spring 47 cause the lever 40 to operate in the order opposite to that in which the lever 40 has operated on the depression of the lever 40. More specifically, the lever 40 pivots clockwise about the rotary shaft 42 in FIG. 13D, so that the undersurface of the rear part of the lever 40 comes into contact with the upper limit stopper 44 to recover to the original state (FIG. 13A). The load sensor 50 and the displacement sensor 51 operate similarly to the first embodiment to control the damper effect and musical tone elements of musical tones to be generated as in the case of the first embodiment. In the above-described explanation, the weight of the movable supporting member 48 is taken into account. In a case where the movable supporting member 48 is made of a light material such as resin, however, the weight of the movable supporting member 48 can be ignored.

The pedal apparatus according to the embodiment configured as described above can achieve the characteristics (FIG. 14D) similar to those of the relationship between the amount of displacement of the lever from the start to the end of a depression of a pedal of an acoustic piano and the reaction force perceived by the player through the pedal as shown by a solid line in FIG. 34. In the operational range (A0 of FIG. 14D) equivalent to A1 of FIG. 34, more specifically, the urging force exerted by the first spring 45 to urge the lever 40 changes, whereas in the operational range (A1 of FIG. 14D) equivalent to A1 of FIG. 34, the urging force exerted by the second spring 46 also changes in addition to the urging force of the first spring 45. Compared with the operational range (A0 of FIG. 14D) equivalent to A0 of FIG. 34, therefore, the rate of change in the reaction force can be increased in the operational range (A1 of FIG. 14D) equivalent to A1 of FIG. 34. In the operational range (A2 of FIG. 14D) equivalent to A2 of FIG. 34, the urging force of not only the first spring 45 but also the third spring 47 changes. Because the spring constant of the third spring 47 is sufficiently smaller than that of the second spring 46, the rate of change in the reaction force in the operational range (A2 of FIG. 14D) equivalent to the range of A2 of FIG. 34 can be reduced, compared with the operational range (A1 of FIG. 14D) equivalent to the range of A1 of FIG. 34. Even if the spring constant of the third spring 47 is not sufficiently smaller than that of the second spring 46, or is larger than that of the second spring 46, in the operational range (A2 of FIG. 14D) equivalent to the range of A2 of FIG. 34, the serial connection of the second spring 46 and the third spring 47 results in the spring constant of the combined springs of the second spring 46 and the third spring 47 being smaller than the spring constant of the second spring 46. In this case as well, therefore, the rate of change in the reaction force in the operational range (A2 of FIG. 14D) can be reduced, compared with the rate of change in the reaction force of the operational range of A1 of FIG. 14D. Therefore, the pedal apparatus 12 of the embodiment can realize the characteristics of the acoustic piano as shown by the solid line in FIG. 34.

In the present embodiment, similarly to the first embodiment, in a case where the player deeply depresses the lever 40 and then sharply decreases the amount of depression, and in a case where the player periodically changes the amount of depression of the lever 40, the movable supporting member 48 can temporarily oscillate due to collaboration of inertial force and spring force applied to the movable supporting member 48. Furthermore, the movable supporting member 48 can collide with the movable supporting member lower limit stopper 49 to cause oscillation of the movable supporting member 48. The oscillation of the movable supporting member 48 is conveyed to the lever 40 through the second spring 46 to be perceived by the player as unnatural reaction force. As for the pedal apparatus 12 configured as described above, however, the respective spring forces of the second spring 46 and the third spring 47 act on the movable supporting member 48 in the directions opposite to each other. Therefore, the pedal apparatus 12 is able to suppress or quickly cease the oscillation. Furthermore, because the force of the springs acting on the lever 40 is divided into the spring force exerted by the first spring 45, and the spring force exerted by the second spring 46 and the third spring 47, the unnatural reaction force conveyed to the lever 40 through the second spring 46 can be reduced. Therefore, the pedal apparatus 12 configured as described above can stabilize the reaction force of the lever 40.

In the above description, the weight of the movable supporting member 48 is taken into account. However, if the movable supporting member 48 is made of a light material such as resin, the weight of the movable supporting member 48 can be ignored. In this case, because the inertial force acting on the movable supporting member 48 can be also ignored, such a light movable supporting member 48 prevents the unnatural reaction force, also achieving reduction in weight of the pedal apparatus 12.

In addition, because the load sensor 50 and the displacement sensor 51 operate similarly to the first embodiment, the pedal apparatus 12 of the present embodiment can synchronize the feeling perceived by the player on the manipulation of the lever 40 with the start and the end of musical tone elements including damper effect to be added to musical tones to be generated and timbre, resonance (acoustic effect) and the like of musical tones to be generated.

Figure 15A:
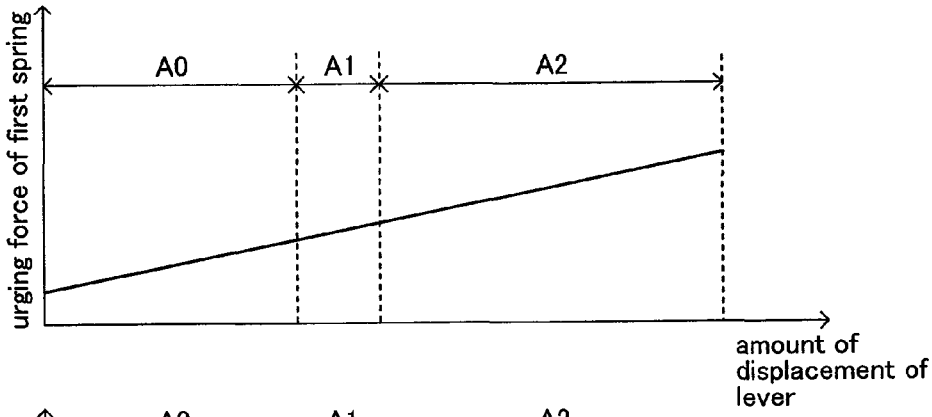
FIG. 15A is a graph showing characteristics of changes in the urging force of the first spring with respect to the amount of displacement of the lever according to a modification of the fourth embodiment.
Figure 15B:
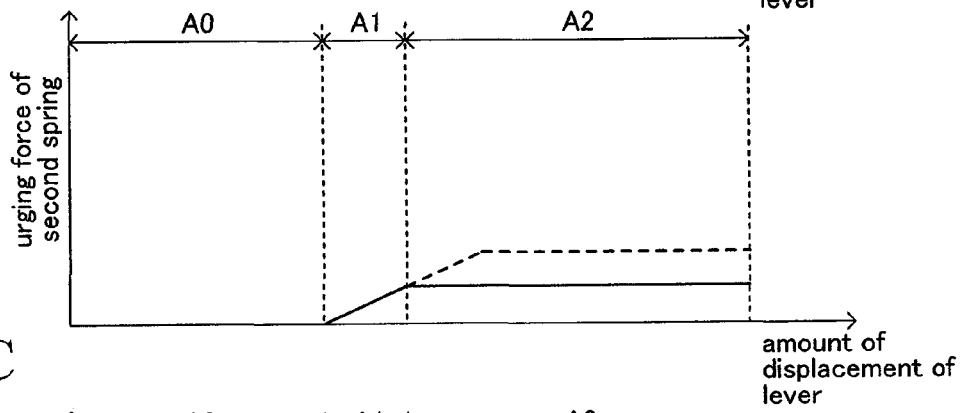
FIG. 15B is a graph showing characteristics of changes in the urging force of the second spring with respect to the amount of displacement of the lever according to the modification of the fourth embodiment.
Figure 15C:
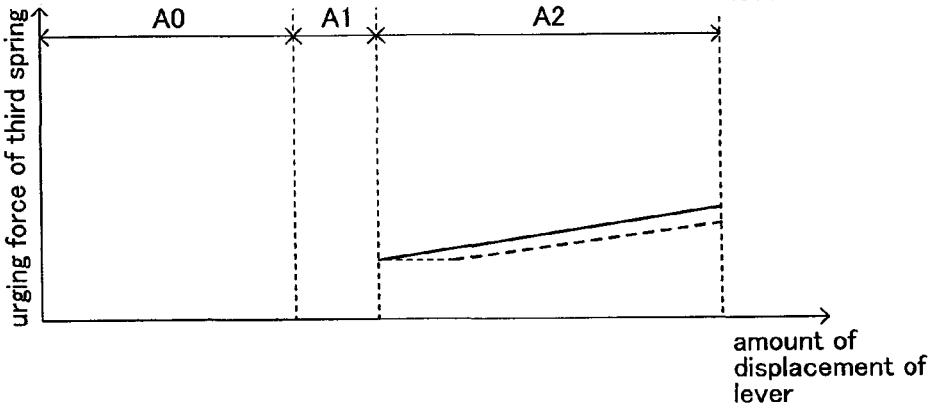
FIG. 15C is a graph showing characteristics of changes in the urging force of the third spring with respect to the amount of displacement of the lever according to the modification of the fourth embodiment.
Figure 15D:
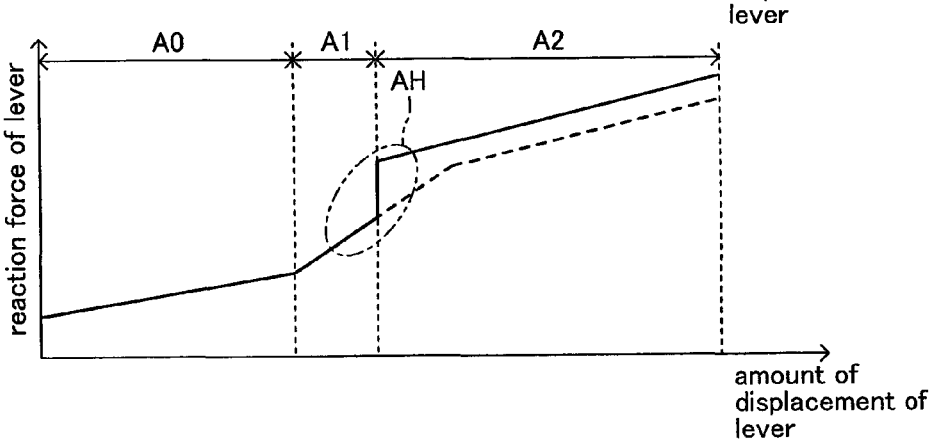
FIG. 15D is a graph showing characteristics of changes in the reaction force of the lever with respect to the amount of displacement of the lever according to the modification of the fourth embodiment.

Between the movable supporting member 48 and the lever 40, the capstan CS similar to that of the modification of the first embodiment may be provided. Such a modification can stabilize reaction force of the lever 40 as in the case of the modification of the first embodiment. In addition, the modification of the fourth embodiment may be further modified such that the capstan CS comes into contact with the movable supporting member 48 before the urging force of the second spring 46 exceeds the combined force formed of the urging force of the third spring 47 and the weight of the movable supporting member 48. The respective urging forces of the first spring 45, the second spring 46 and the third spring 47 with respect to the amount of displacement of the lever 40 in this modification are shown in FIG. 15A, FIG. 15B and FIG. 15C. FIG. 15D shows the reaction force generated by the lever 40 according to the displacement of the lever 40. For comparison, the respective urging forces of the respective springs and the reaction force of the lever 40 without the capstan CS are shown by dashed lines in FIG. 15A to FIG. 15D. From the start of a depression of the lever 40 until the contact of the second spring 46 with the lever 40, the urging force of only the first spring 45 increases (A0 of FIG. 15A). From the contact of the second spring 46 with the lever 40 until the capstan CS comes into contact with the movable supporting member 48, the urging forces of the first spring 45 and the second spring 46 increase (A1 of FIG. 15A and A1 of FIG. 15B). If the contact of the capstan CS with the movable supporting member 48 is followed by the further increase in the amount of the depression of the lever 40, the urging forces of the first spring 45 and the third spring 47 increase according to the increase in the amount of the depression, without any further increase in the urging force of the second spring 46 (A2 of FIG. 15A to FIG. 15C). As for this modification, on the boundary between the range where the rate of change in the reaction force is great and the range where the rate of change is small, the reaction force of the lever 40 changes stepwise. The stepwise change in the reaction force facilitates player's perception of the boundary. Compared with the pedal apparatus 12 without the capstan CS, furthermore, the pedal apparatus 12 having the capstan CS can narrow the range where the rate of change in the reaction force is great (A1 of FIG. 15D) and widen the range where the rate of change in the reaction force is small (A2 of FIG. 1 SD).

Figure 16:
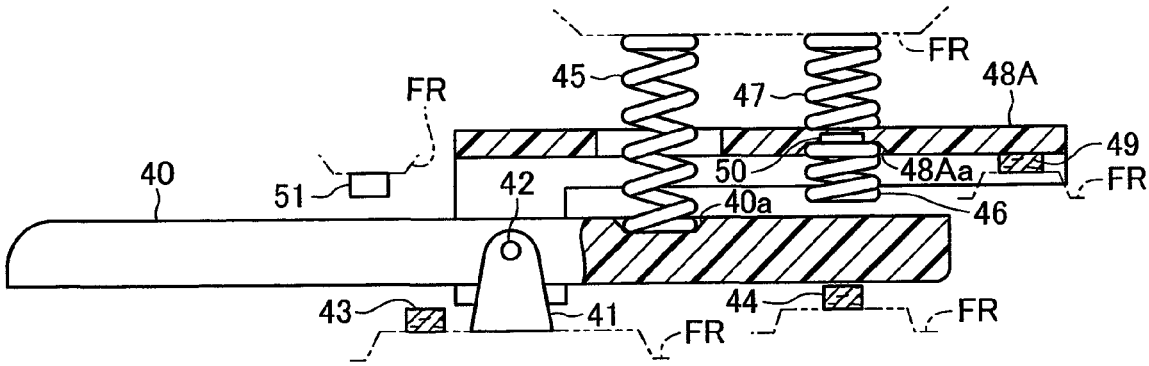
FIG. 16 is a side view of the pedal apparatus according to a modification of the fourth embodiment.
Figure 17:
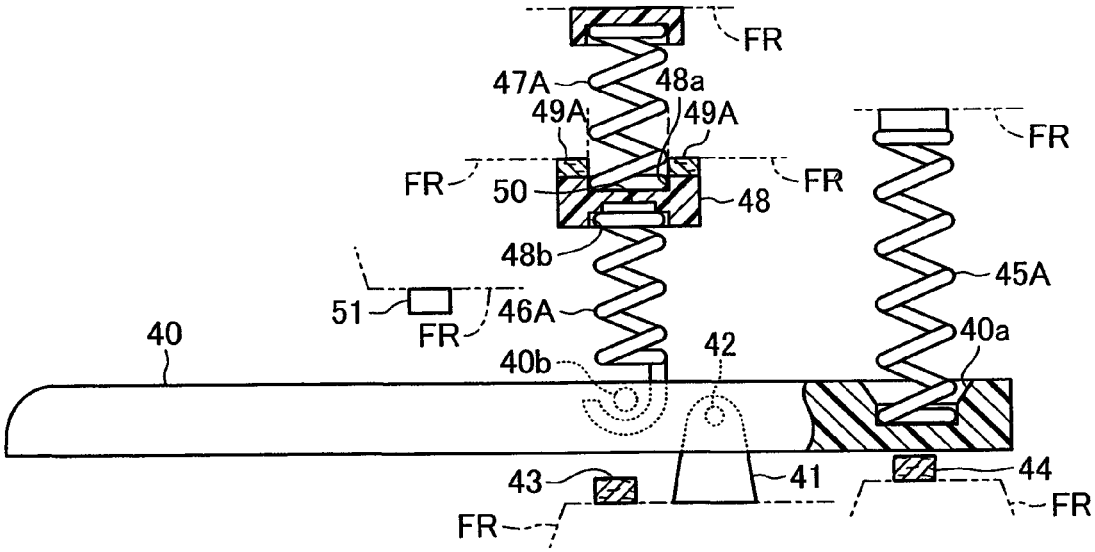
FIG. 17 is a side view of the pedal apparatus according to the other modification of the fourth embodiment.

Similarly to the modification of the first embodiment, in addition, the respective positions where the first to the third springs 45, 46, 47 are provided may be changed. As shown in FIG. 16, furthermore, the movable supporting member 48 may be replaced with a movable supporting member 48A which pivots in response to the lever 40. The modification shown in FIG. 16 is obtained by modifying the modification of the first embodiment shown in FIG. 6 such that the lower end of the second spring 46 in a state where the lever 40 is not depressed is apart from the top surface of the lever 40. As shown in FIG. 17, furthermore, an extension spring may be employed. The modification shown in FIG. 17 is obtained by modifying the modification of the first embodiment shown in FIG. 7 such that the lower end of the second spring 46A in a state where the lever 40 is not depressed is apart from the supporting portion 40*b* provided on the lever 40. Such modifications can also achieve the effect similar to that of the fourth embodiment.

f. Fifth Embodiment

Figure 18:
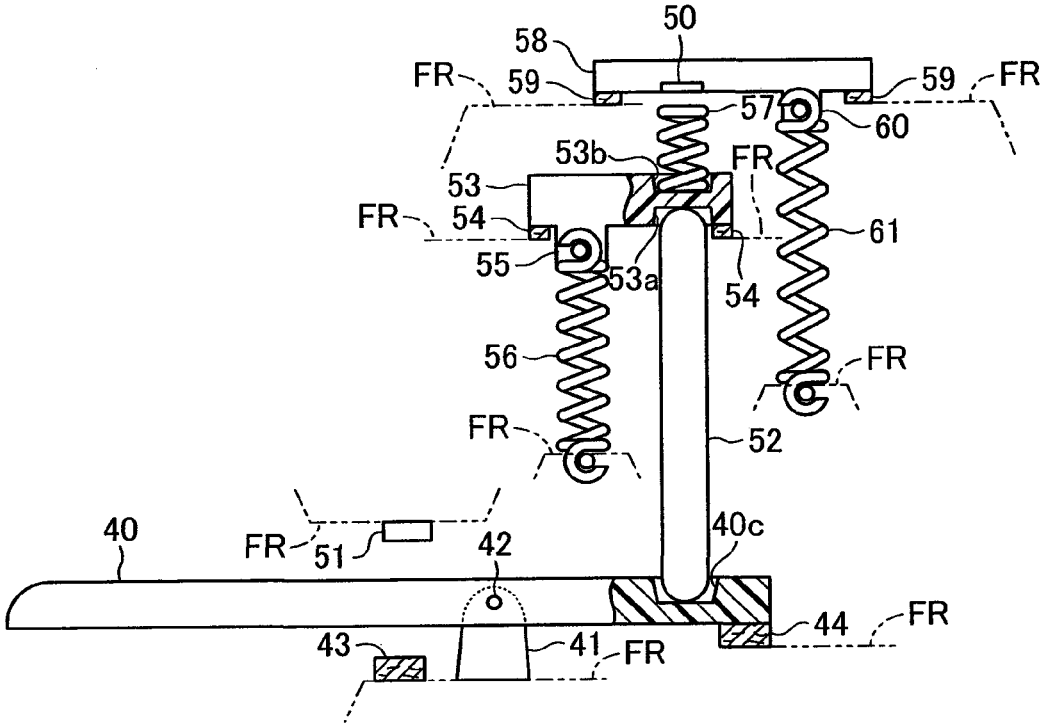
FIG. 18 is a side view of the pedal apparatus according to the fifth embodiment.

Next, a fifth embodiment of the pedal apparatus 12 according to the present invention will be described in detail. FIG. 18 is a side view of the pedal apparatus 12 of the present embodiment. This embodiment is configured almost similarly to the second embodiment shown in FIG. 8. Unlike the second embodiment, however, in a state where the lever 40 is not depressed, the upper end of the second spring 57 is apart from the second movable supporting member 58.

Next, the operation of the pedal apparatus 12 configured as described above will be explained. In a state where the lever 40 is not depressed, the first movable supporting member 53 is urged downward by the first spring 56 to be in contact with the first movable supporting member lower limit stopper 54. Resultantly, the rear part of the lever 40 is urged downward through the drive rod 52. As a result, the undersurface of the rear part of the lever 40 is in contact with the upper limit stopper 44, so that the lever 40 stands still to be in a state shown in FIG. 18. In this state, the second movable supporting member 58 is in contact with the second movable supporting member lower limit stopper 59 by the urging force of the third spring 61 and the weight of the second movable supporting member 58.

If the player depresses the lever 40 in spite of the urging force exerted by the first spring 56, the lever 40 starts pivoting counterclockwise about the rotary shaft 42 in FIG. 18, so that the rear part of the lever 40 is displaced upward. By this displacement, the drive rod 52 causes the first movable supporting member 53 to be displaced upward. As a result, the first spring 56 is extended to increase the urging force exerted on the lever 40 by the first spring 56 (A0 of FIG. 14A). At this time, the upper end of the second spring 57 is apart from the undersurface of the second movable supporting member 58. In this operational range, therefore, the reaction force of the lever 40 and the change in the reaction force are brought about by the first spring 56 (A0 of FIG. 14D).

If the player depresses the lever 40 further to increase the amount of the displacement of the lever 40, the urging force exerted by the first spring 56 on the lever 40 increases further (A1 of FIG. 14A). The upper end of the second spring 57 comes into contact with the undersurface of the second movable supporting member 58. The amount of depression of the lever 40 at the time of the contact of the upper end of the second spring 57 with the undersurface of the second movable supporting member 58 is referred to as the second amount of depression. If the urging force exerted by the second spring 57 is smaller than the combined force formed of the urging force exerted by the third spring 61 to urge the second movable supporting member 58 downward and the weight of the second movable supporting member 58, the second movable supporting member 58 remains to be in contact with the second movable supporting member lower limit stopper 59. By the upward displacement of the first movable supporting member 53, as a result, the second spring 57 also starts compressing to increase the urging force exerted by the second spring 57 (A1 of FIG. 14B). In this operational range, therefore, the reaction force of the lever 40 and the change in the reaction force are brought about by the first spring 56 and the second spring 57 (A1 of FIG. 14D).

If the amount of the displacement of the lever 40 increases further, the urging forces of the first spring 56 and the second spring 57 also increase further (A1 of FIG. 14A and FIG. 14B). Then, if the urging force exerted by the second spring 57 exceeds the combined force formed of the urging force exerted by the third spring 61 to urge the second movable supporting member 58 downward and the weight of the second movable supporting member 58, the second movable supporting member 58 moves upward. The amount of depression of the lever 40 at the time of the start of upward move of the second movable supporting member 58 is referred to as the first amount of depression. Similarly to the second embodiment, the spring constant of the third spring 61 is sufficiently small, compared with the second spring 57. If the amount of displacement of the lever 40 increases, therefore, the third spring 61 is extended to increase the urging force of the third spring 61. However, the second spring 57 will be hardly compressed any further with little increase in the urging force of the second spring 57 (A2 of FIG. 14B and FIG.

14C). In this operational range, therefore, the reaction force of the lever 40 is brought about by the first spring 56, the second spring 57 and the third spring 61. Strictly speaking, the change in the reaction force is brought about by the first spring 56, the second spring 57 and the third spring 61. However, the spring constant of the third spring 61 is sufficiently smaller than that of the second spring 57, resulting in little compression of the second spring 57 and little increase in the urging force exerted by the second spring 57. Therefore, it can be considered that the change in the reaction force is brought about by the first spring 56 and the third spring 61 (A2 of FIG. 14D). In this case as well, therefore, the rate of change in the reaction force in the operational range (A2 of FIG. 14D) can be reduced, compared with the reaction force of the operational range of A1 of FIG. 14D. Even if the spring constant of the third spring 61 is not sufficiently smaller than that of the second spring 57, or is larger than that of the second spring 57, in the operational range (A2 of FIG. 14D) equivalent to the range of A2 of FIG. 34, the serial connection of the second spring 57 and the third spring 61 results in the spring constant of the combined springs of the second spring 57 and the third spring 61 being smaller than the spring constant of the second spring 57. In this case as well, therefore, the rate of change in the reaction force in the operational range (A2 of FIG. 14D) can be reduced, compared with the reaction force of the operational range of A1 of FIG. 14D. Therefore, the pedal apparatus 12 of the embodiment can realize the characteristics of the acoustic piano as shown by the solid line in FIG. 34.

Then, the undersurface of the middle part of the lever 40 comes into contact with the lower limit stopper 43 to restrict downward displacement of the forward part of the lever 40. If the depression of the lever 40 is released, the urging forces exerted by the first spring 56, the second spring 57 and the third spring 61 cause the lever 40 to operate in the order opposite to that in which the lever 40 has operated on the depression of the lever 40. More specifically, the lever 40 pivots clockwise about the rotary shaft 42 in FIG. 18, so that the undersurface of the rear part of the lever 40 comes into contact with the upper limit stopper 44 to recover to the original state (FIG. 18). The load sensor 50 and the displacement sensor 51 operate similarly to the first embodiment to control the damper effect and musical tone elements of musical tones to be generated as in the case of the first embodiment. In the above-described explanation, the weight of the second movable supporting member 58 is taken into account. In a case where the second movable supporting member 58 is made of a light material such as resin, however, the weight of the second movable supporting member 58 can be ignored.

Similarly to the fourth embodiment, as for the pedal apparatus according to the embodiment configured as described above, the urging forces exerted by the first spring 56, the second spring 57 and the third spring 61 change according to the ranges equivalent to the respective operational ranges shown in FIG. 34. As a result, the pedal apparatus according to the present embodiment can achieve the characteristics (FIG. 14D) similar to those of the relationship between the amount of displacement of the lever from the start to the end of a depression of a pedal of an acoustic piano and the reaction force perceived by the player through the pedal as shown by the solid line in FIG. 34.

In the present embodiment, similarly to the second embodiment, in the case where the player deeply depresses the lever 40 and then sharply decreases the amount of depression, and in the case where the player periodically changes the amount of depression of the lever 40, the second movable supporting member 58 can temporarily oscillate due to collaboration of inertial force and spring force. Furthermore, the second movable supporting member 58 can collide with the second movable supporting member lower limit stopper 59 to cause oscillation of the second movable supporting member 58. As for the present embodiment as well, however, the respective spring forces of the second spring 57 and the third spring 61 act on the second movable supporting member 58 in the directions opposite to each other. Therefore, the pedal apparatus 12 is able to suppress or quickly cease the oscillation. Furthermore, because the force of the springs acting on the lever 40 is divided into the spring force exerted by the first spring 56, and the spring force exerted by the second spring 57 and the third spring 61, the spring force exerted by the second spring 57 and the third spring 61 is small. As a result, the unnatural reaction force of the lever caused by the oscillation can be reduced. Therefore, the pedal apparatus 12 can stabilize the reaction force of the lever 40.

In the above description, the weight of the second movable supporting member 58 is taken into account. However, if the second movable supporting member 58 is made of a light material such as resin, the weight of the second movable supporting member 58 can be ignored. In this case, because the inertial force acting on the second movable supporting member 58 can be also ignored, such a light second movable supporting member 58 prevents the unnatural reaction force, also achieving reduction in weight of the pedal apparatus 12.

In addition, because the load sensor 50 and the displacement sensor 51 operate similarly to the first embodiment, the pedal apparatus 12 of the present embodiment can synchronize the feeling perceived by the player on the manipulation of the lever 40 with the start and the end of musical tone elements including damper effect to be added to musical tones to be generated and timbre, resonance (acoustic effect) and the like of musical tones to be generated.

Between the first movable supporting member 53 and the second movable supporting member 58, the capstan CS similar to that of the modification of the first embodiment may be provided. Such a modification also achieves the effect similar to the modification of the first embodiment.

Figure 19:
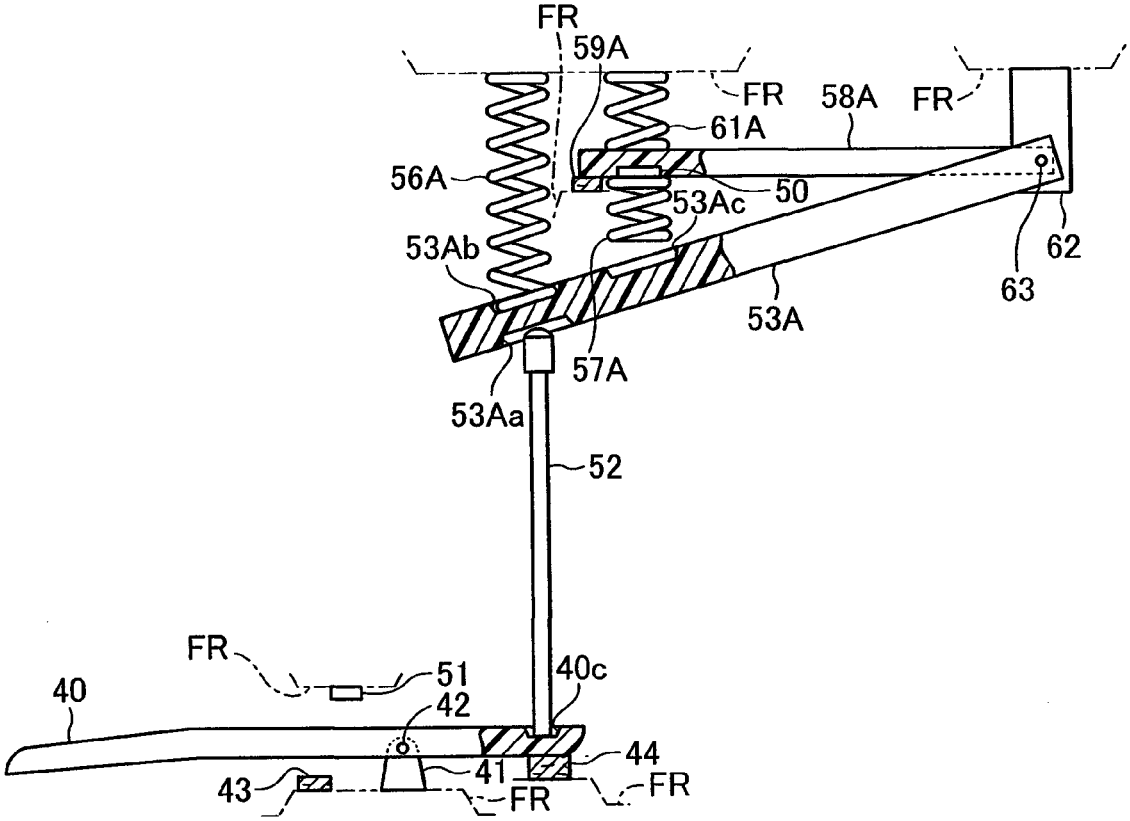
FIG. 19 is a side view of the pedal apparatus according to a modification of the fifth embodiment.

Similarly to the modification of the second embodiment, in addition, the respective positions where the first to third springs 56, 57, 61 are provided may be changed. As shown in FIG. 19, furthermore, the first movable supporting member 53 and the second movable supporting member 58 may be replaced with a first movable supporting member 53A and a second movable supporting member 58A which pivot in response to the lever 40. The modification shown in FIG. 19 is obtained by modifying the modification of the second embodiment shown in FIG. 9 such that the lower end of the second spring 57A in a state where the lever 40 is not depressed is apart from the top surface of the first movable supporting member 53A. Such modifications can also achieve the effect similar to that of the fifth embodiment.

g. Sixth Embodiment

Figure 20:
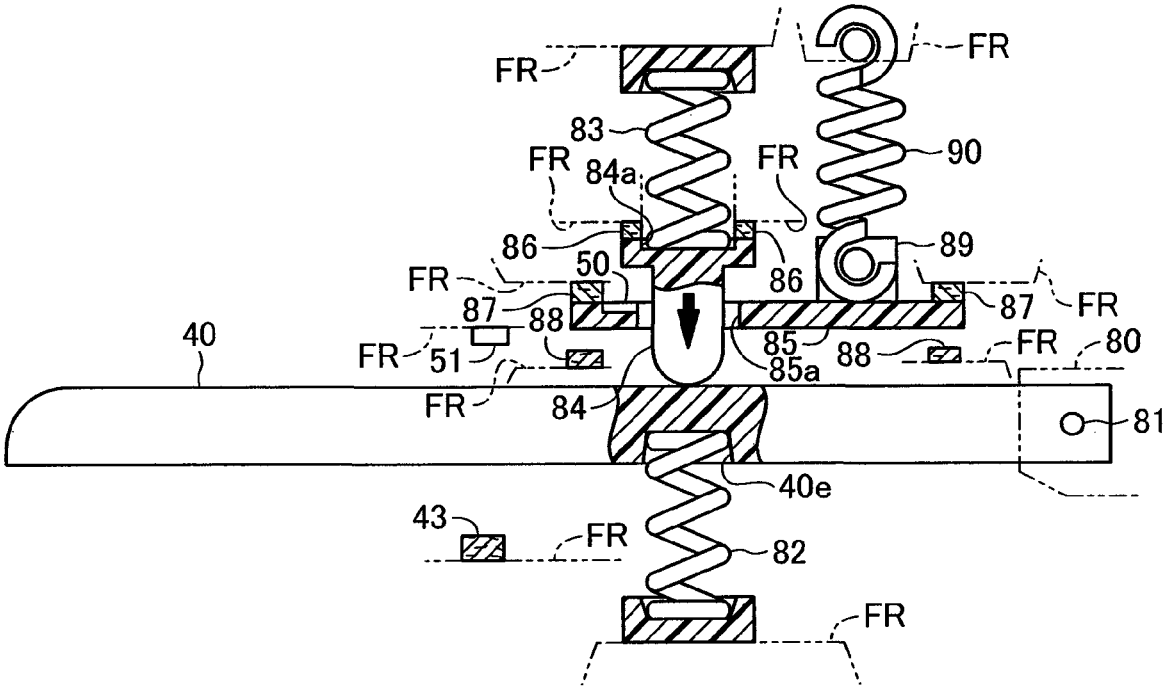
FIG. 20 is a side view of the pedal apparatus according to the sixth embodiment.

Next, a sixth embodiment of the pedal apparatus 12 according to the present invention will be described in detail. FIG. 20 is a side view of the pedal apparatus 12 of the present embodiment. This embodiment is configured almost similarly to the third embodiment shown in FIG. 10. Unlike the third embodiment, however, in a state where the lever 40 is not depressed, the pressing member 84 is apart from the movable supporting member 85.

Figure 21A:
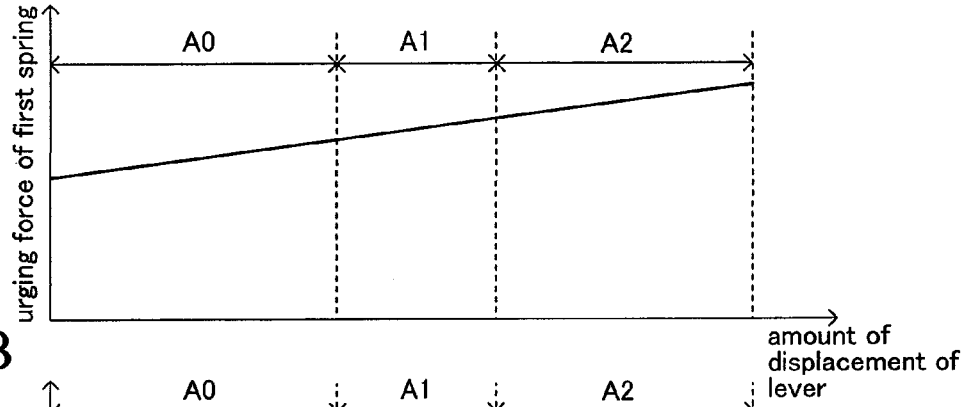
FIG. 21A is a graph showing characteristics of changes in the urging force of a first spring with respect to the amount of displacement of the lever according to the sixth embodiment.
Figure 21B:
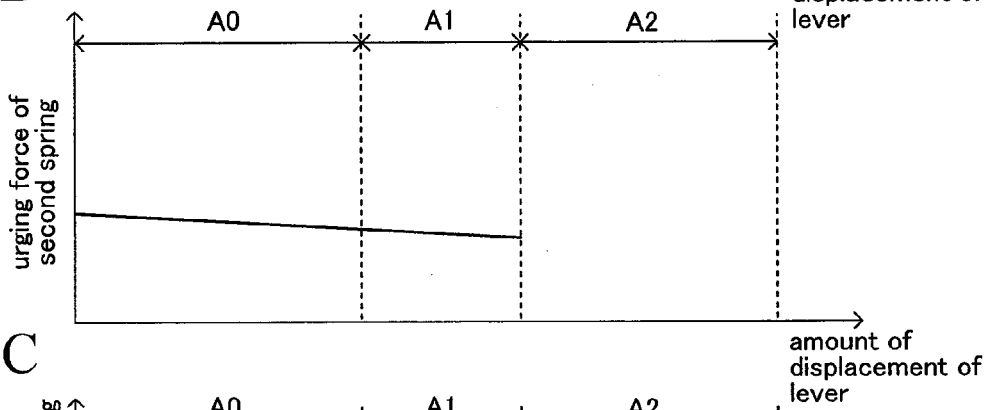
FIG. 21B is a graph showing characteristics of changes in the urging force of a second spring with respect to the amount of displacement of the lever according to the sixth embodiment.
Figure 21C:
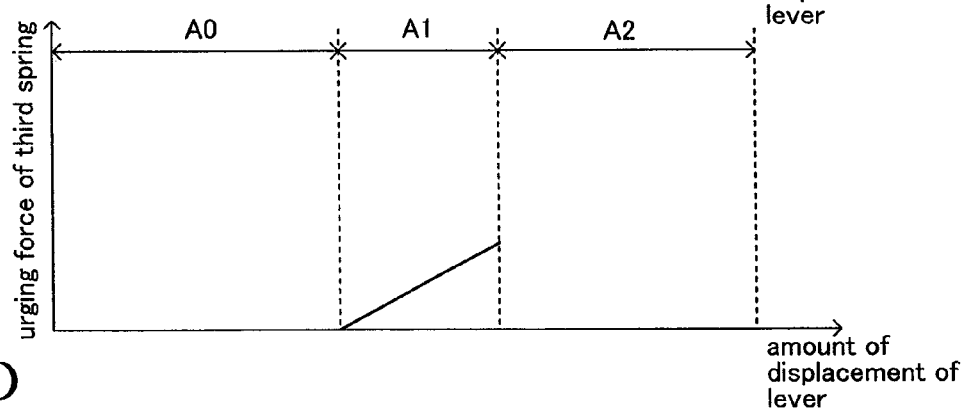
FIG. 21C is a graph showing characteristics of changes in the urging force of a third spring with respect to the amount of displacement of the lever according to the sixth embodiment.
Figure 21D:
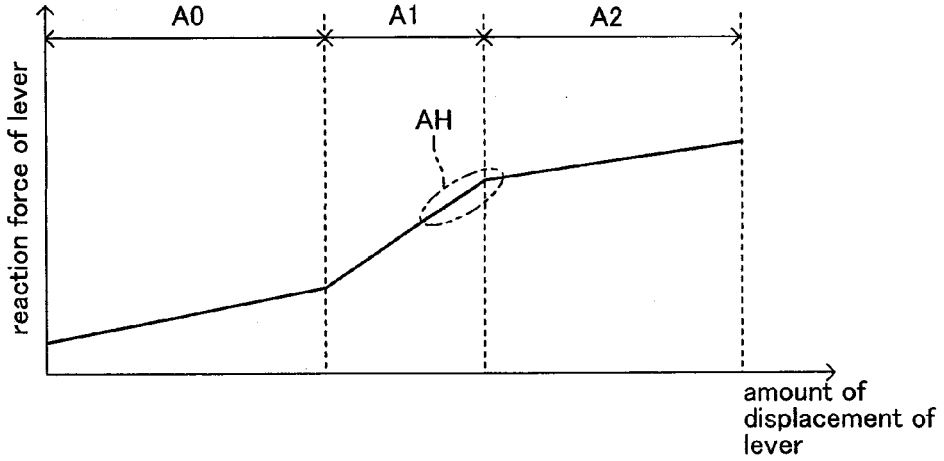
FIG. 21D is a graph showing characteristics of changes in the reaction force of the lever with respect to the amount of displacement of the lever according to the sixth embodiment.

Next, the operation of the pedal apparatus 12 configured as described above will be explained. FIG. 21A, FIG. 21B, and FIG. 21C show the urging force exerted by the first spring 82, the second spring 83 and the third spring 90 with respect to the amount of displacement of the lever 40. FIG. 21D shows the reaction force generated by the lever 40 according to displacement of the lever 40. In FIG. 21A and FIG. 21C, the urging force exerted in a direction resisting depression of the lever 40 is regarded as positive. In FIG. 21B, the urging force exerted in a direction facilitating depression of the lever 40 is regarded as positive. In a state where the lever 40 is not depressed, the urging force exerted by the first spring 82 to urge the lever 40 upward causes the lever 40 to pivot clockwise about the rotary shaft 81 in FIG. 20 to push up the pressing member 84 so that the top surface of the pressing member 84 comes into contact with the pressing member upper limit stopper 86 to make the lever 40 stand still to be in the state of FIG. 20. In this state, both the first spring 82 and the second spring 83 are compressed.

If the player depresses the lever 40 in spite of the urging force exerted by the first spring 82, the lever 40 starts pivoting counterclockwise about the rotary shaft 81 in FIG. 20, so that the forward part of the lever 40 is displaced downward. On this displacement, the first spring 82 is compressed to increase the urging force exerted by the first spring 82 (A0 of FIG. 21A). Because the second spring 83 is released from compression, the urging force exerted by the second spring 83 decreases (A0 of FIG. 21B). In this operational range, the third spring 90 will not urge the lever 40. The direction in which the first spring 82 urges the lever 40 is the direction resisting the depression of the lever 40, while the direction in which the second spring 83 urges the lever 40 is the direction facilitating the depression. As a result, the reaction force of the lever 40 is obtained by subtracting the urging force of the second spring 83 from the urging force of the first spring 82. Therefore, the change in the reaction force of the lever 40 is brought about by the first spring 82 and the second spring 83 (A0 of FIG. 21D).

If the lever 40 is depressed further to increase the amount of displacement of the lever 40, the urging force exerted by the first spring 82 also increases further (A1 of FIG. 21A). In addition, the circular plate portion of the pressing member 84 comes into contact with the top surface of the movable supporting member 85. The amount of depression of the lever 40 at the time of the contact of the circular plate portion of the pressing member 84 with the top surface of the movable supporting member 85 is referred to as the second amount of depression. The second spring 83 urges the lever 40 downward, also urging the movable supporting member 85 downward. As a result, the third spring 90 is extended to increase its urging force (A1 of FIG. 21C). The urging force of the second spring 83 and the third spring 90 at the start of depression of the lever 40 is adjusted such that, in this operational range (A1 of FIG. 21), the urging force of the third spring 90 is smaller than the urging force of the second spring 83. The reaction force of the lever 40 is obtained by subtracting the urging force of the second spring 83 from the force in which the urging force of the third spring 90 is added to the urging force of the first spring 82. Therefore, the change in the reaction force is brought about by the first spring 82, the second spring 83 and the third spring 90 (A1 of FIG. 21D).

If the amount of displacement of the lever 40 increases further, the urging force exerted by the first spring 82 also increases further (A2 of FIG. 21A). The undersurface of the movable supporting member 85 comes into contact with the movable supporting member lower limit stopper 88 to restrict downward displacement of the movable supporting member 85, so that the tip of the pressing member 84 leaves the top surface of the lever 40. The amount of depression of the lever which triggers the restriction of downward displacement of the movable supporting member 85 is referred to as the first amount of depression. In this operational range, therefore, the reaction force which resists depression of the lever 40 is brought about only by the first spring 82, while the change in the reaction force is also brought about only by the first spring (A2 of FIG. 21D).

Then, the undersurface of the middle part of the lever 40 comes into contact with the lower limit stopper 43 to restrict downward displacement of the forward part of the lever 40. If the depression of the lever 40 is released, the urging forces exerted by the first spring 82, the second spring 83 and the third spring 90 cause the lever 40 to operate in the order opposite to that in which the lever 40 has operated on the depression of the lever 40. More specifically, the lever 40 pivots clockwise about the rotary shaft 81 in FIG. 20 to push up the pressing member 84, so that the top surface of the pressing member 84 comes into contact with the pressing member upper limit stopper 86 to stand still. As a result, the pedal apparatus 12 recovers to the original state (FIG. 20). The load sensor 50 and the displacement sensor 51 operate similarly to the first embodiment.

The pedal apparatus according to the present embodiment configured as described above can also achieve the characteristics similar to those of the relationship between the amount of displacement of the lever from the start to the end of a depression of a pedal of an acoustic piano and the reaction force perceived by the player through the pedal as shown by the solid line in FIG. 34. In the operational range (A0 of FIG. 21D) equivalent to A0 of FIG. 34, more specifically, the urging force exerted on the lever 40 by the first spring 82 is canceled by a large amount by the urging force exerted by the second spring 83. The parallel connection of the first and second springs 82, 83 results in the spring constant of the combined springs being larger than the spring constant of the first spring 82.

In the operational range (A1 of FIG. 21D) equivalent to A1 of FIG. 34, although part of the urging force exerted by the first spring 82 is canceled by the urging force exerted by the second spring 83, part of the urging force of the second spring 83 is canceled by the third spring 90. The parallel connection of the first to third springs 82, 83, 90 results in the spring constant of the combined springs being larger than the spring constant of the combined springs formed of the first spring 82 and the second spring 83. Compared with the operational range (A0 of FIG. 21D) equivalent to A0 of FIG. 34, therefore, the rate of change in the reaction force in the operational range (A1 of FIG. 21D) equivalent to A1 of FIG. 34 can be increased.

In the operational range (A2 of FIG. 21D) equivalent to A2 of FIG. 34, the urging force of the first spring 82 is designed not to be canceled by the second spring 83 and the third spring 90. Compared with the operational range (A1 of FIG. 21D) equivalent to A1 of FIG. 34, therefore, the rate of change in the reaction force in the operational range (A2 of FIG. 21D) equivalent to A2 of FIG. 34 can be reduced. As a result, the pedal apparatus 12 according to the present embodiment achieves the characteristics of the acoustic piano shown by the solid line in FIG. 34.

In the present embodiment, similarly to the third embodiment, in the case where the player sharply decreases the amount of depression of the lever 40 or in the case where the player periodically changes the amount of depression of the lever 40, the lever 40 occasionally collides with the pressing member 84. The impact caused by the collisions of the lever 40 with the pressing member 84 is absorbed by the first spring 82 and the second spring 83. Therefore, the present embodiment can stabilize the reaction force of the lever 40.

In addition, because the load sensor 50 and the displacement sensor 51 operate similarly to the first embodiment, the pedal apparatus 12 of the present embodiment can synchronize the feeling perceived by the player on the manipulation of the lever 40 with the start and the end of musical tone elements including damper effect to be added to musical tones to be generated and timbre, resonance (acoustic effect) and the like of musical tones to be generated.

Similarly to the modification of the third embodiment, in addition, the respective positions where the first to third springs 82, 83, 90 are provided may be changed. Furthermore, the compression springs may be replaced with extension springs. Such modifications can also achieve the effect similar to that of the sixth embodiment.

h. Seventh Embodiment

Figure 22A:
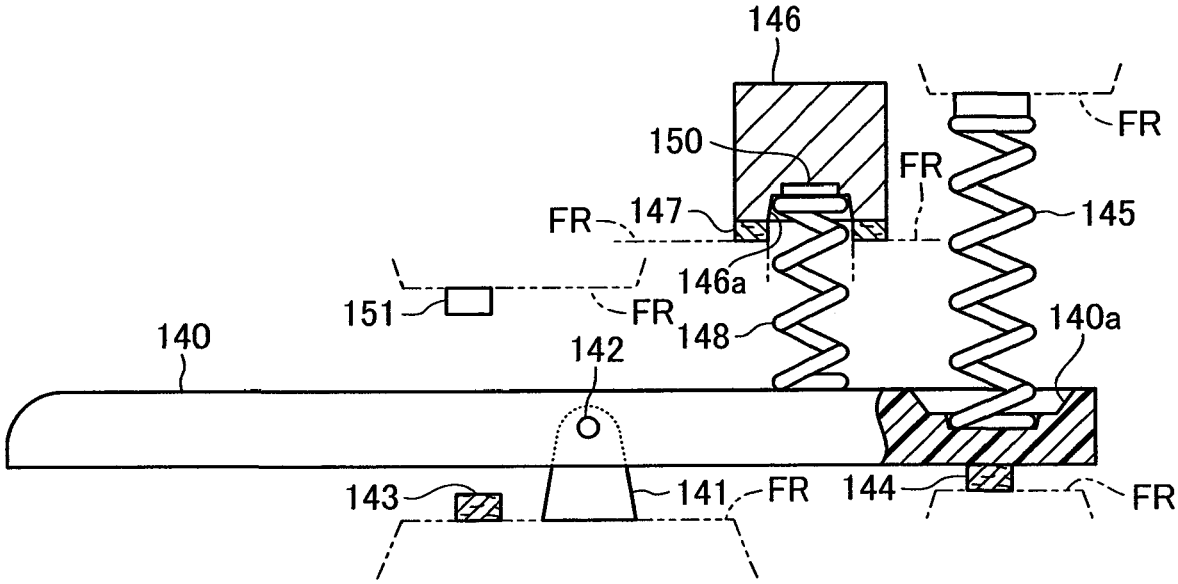
FIG. 22A is a side view of the pedal apparatus according to a seventh embodiment of the present invention.

Next, a seventh embodiment of the pedal apparatus 12 according to the present invention will be described in detail. FIG. 22A shows a side view of the pedal apparatus of the electronic musical instrument according to the present embodiment. A lever 140 is a long plate-shaped member. The forward part (left side in FIG. 22A) of the lever 140 is a wide depression part on which a player steps. The lever 140 is supported at a middle part thereof by a lever supporting portion 141 provided on the frame FR so that the front end of the lever 140 can pivot upward and downward about a rotary shaft 142. Below the middle part of the lever 140, a long lower limit stopper 143 made of a shock-absorbing member such as felt extends in a lateral direction to be fixed to the frame FR. The lower limit stopper 143 restricts downward displacement of the forward part of the lever 140. The frame FR is a structural body for supporting various parts of the pedal apparatus 12 and a housing itself of the pedal apparatus 12. Below the rear part of the lever 140, an upper limit stopper 144 which is similar to the lower limit stopper 143 is fixed to the frame FR to restrict upward displacement of the forward part of the lever 140.

Behind the rotary shaft 142 of the lever 140, the top end of a first spring 145 is fixed to the frame FR so that the top end of the first spring 145 is situated above the rear part of the lever 140. The lower end of the first spring 145 is inserted into a concave portion 140*a* provided on the top surface of the lever 140 behind the rotary shaft 142 of the lever 140 so that the lower end of the first spring 145 is in contact with the bottom surface of the concave portion 140*a* to urge the rear part of the lever 140 downward. The first spring 145 is a compression spring. Behind the rotary shaft 142 of the lever 140, a metal weight 146 serving as a movable supporting member is provided above the rear part of the lever 140. The weight 146 is allowed to move only upward and downward by a guide member which is not shown. The downward displacement of the weight 146 is restricted by a weight lower limit stopper 147 fixed to the frame FR. The weight 146 may be molded by resin to be fixed to a resin member formed by molding a metal massive body. The weight lower limit stopper 147 is made of a shock-absorbing member such as felt to prevent shock noise that would be generated when the weight 146 collides with the frame FR. On the undersurface of the weight 146, a concave portion 146*a* is provided. The top end of a second spring 148 is inserted into the concave portion 146*a* to be fixed to the upper bottom surface of the concave portion 146*a* to be supported. The lower end of the second spring 148 is in contact with a part of the top surface of the lever 140, the part being situated behind the rotary shaft 142. The second spring 148 is also a compression spring.

Into the concave portion 146*a* of the weight 146, a load sensor 150 for sensing the urging force of the second spring 148 (load applied to the lever 140 which is the pedal apparatus 12) is incorporated. By electrically sensing elastic deformation caused by the urging force of the second spring 148 (e.g., with a strain gauge), the load sensor 150 obtains the urging force of the second spring 148. Above the middle part of the lever 140, furthermore, a displacement sensor 151 for sensing the amount of displacement of the lever 140 is provided. By electrically or optically sensing the distance to the top surface of the lever 140 (e.g., by reflection of laser light), the displacement sensor 151 obtains the amount of displacement of the lever 140. The displacement sensor 151 may be replaced with a sensor for mechanically and electrically sensing the amount of upward and downward displacement of the lever 140 (e.g., variable resistance).

Figure 23A:
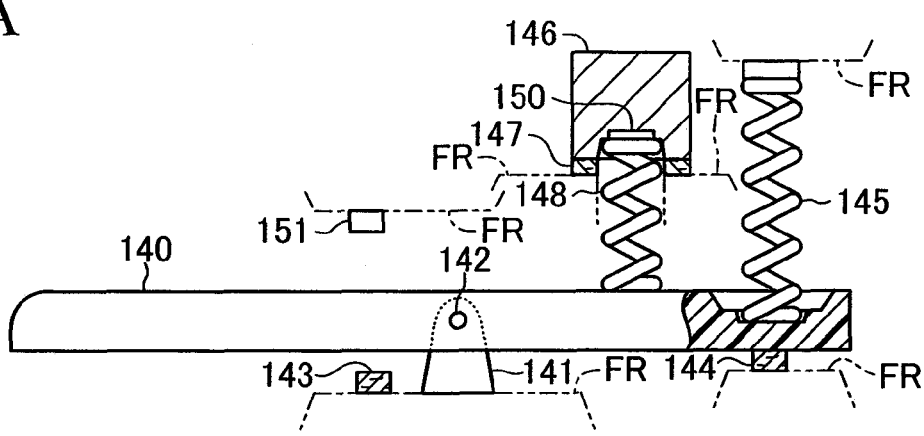
FIG. 23A is a diagram showing the position of a lever and a weight, and the state where a first spring and a second spring are compressed in a state where the lever is not depressed according to the seventh embodiment.
Figure 23B:
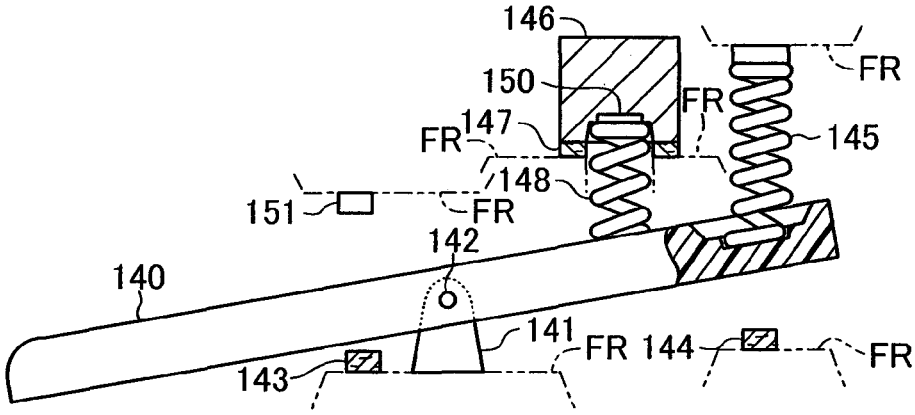
FIG. 23B is a diagram showing the position of the lever and the weight, and the state where the first spring and the second spring are compressed in a state where the weight starts being displaced according to the seventh embodiment.
Figure 23C:
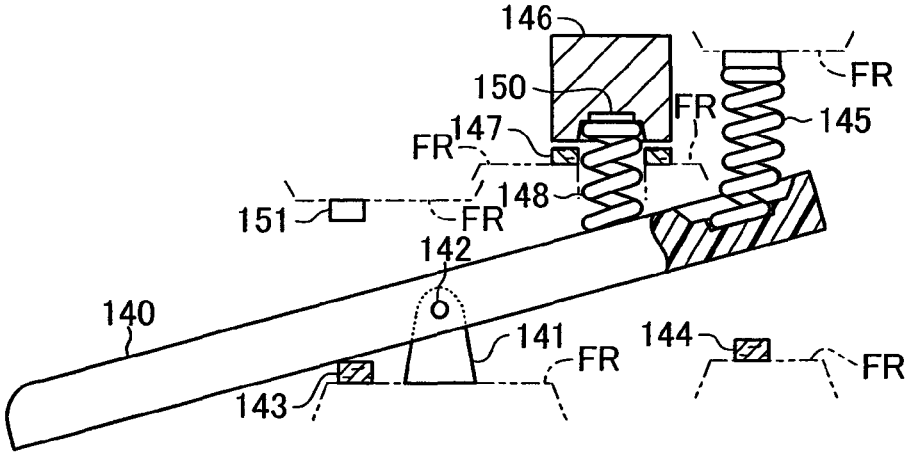
FIG. 23C is a diagram showing the position of the lever and the weight, and the state where the first spring and the second spring are compressed in a state where the amount of depression of the lever is at the maximum according to the seventh embodiment.
Figure 24A:
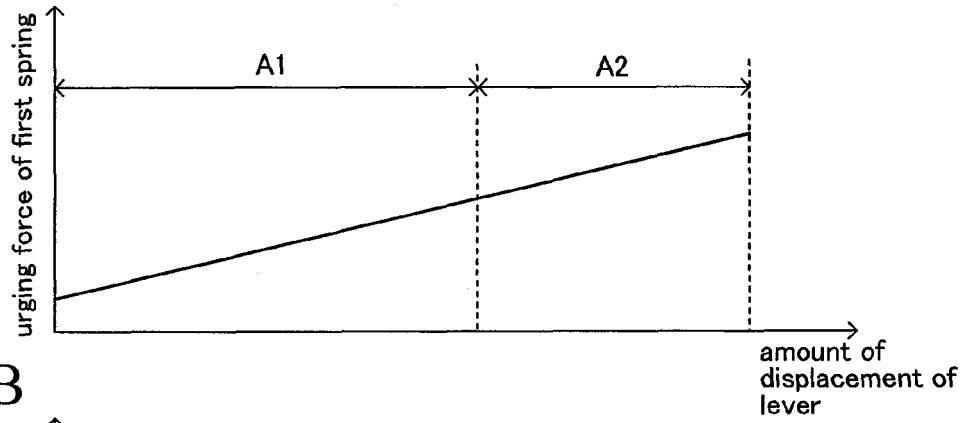
FIG. 24A is a graph showing characteristics of changes in the urging force of the first spring with respect to the amount of displacement of the lever according to the seventh embodiment.
Figure 24B:
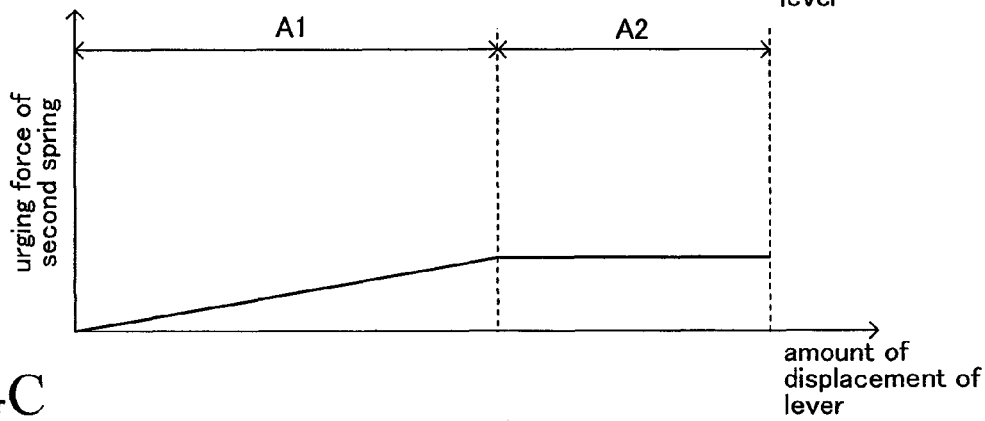
FIG. 24B is a graph showing characteristics of changes in the urging force of the second spring with respect to the amount of displacement of the lever according to the seventh embodiment.
Figure 24C:
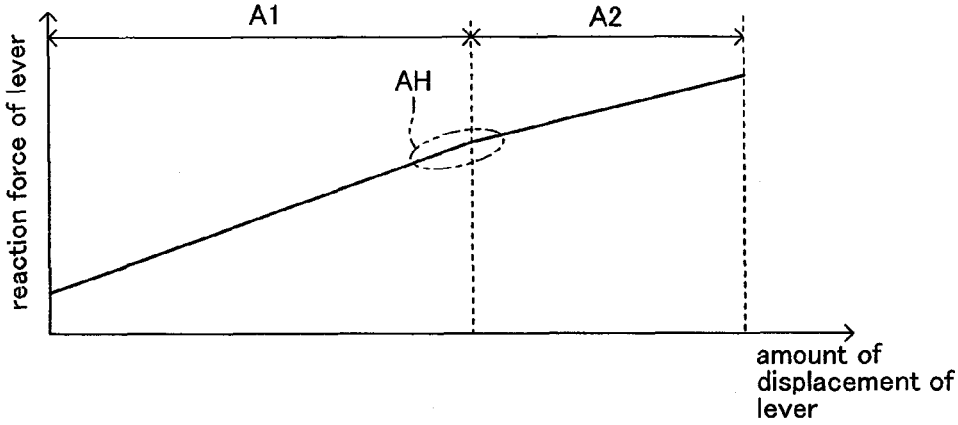
FIG. 24C is a graph showing characteristics of changes in the reaction force of the lever with respect to the amount of displacement of the lever according to the seventh embodiment.

Next, the operation of the pedal apparatus 12 configured as described above will be explained. FIG. 23A through FIG. 23C show various states in which the lever 140 and the weight 146 are displaced, with the first spring 145 and the second spring 148 being compressed. FIG. 24A and FIG. 24B show the urging force of the first spring 145 and the second spring 148 with respect to the amount of displacement of the lever 140. FIG. 24C shows the reaction force generated by the lever 140 according to the displacement of the lever 140. In a state where the lever 140 is not depressed, the rear part of the lever 140 is urged downward by the first spring 145. As a result, the undersurface of the rear part of the lever 140 is in contact with the upper limit stopper 144, so that the lever 140 stands still to be in a state shown in FIG. 23A. In this state, the second spring 148 is in its natural length, resulting in the urging force exerted on the lever 140 of "0". Because of the weight of the weight 146, in this state, the weight 146 is in contact with the weight lower limit stopper 147 to stand still. In this state, furthermore, although the second spring 148 may be slightly compressed to urge the lever 140, the urging force of the second spring 148 is designed to be smaller than the weight of the weight 146 so that the weight 146 is in contact with the weight lower limit stopper 147.

If the player depresses the lever 140 in spite of the urging force exerted by the first spring 145, the lever 140 starts pivoting counterclockwise about the rotary shaft 142 in FIG. 23A, so that the rear part of the lever 140 is displaced upward. This displacement causes compression of the first spring 145 to increase the urging force exerted by the first spring 145 (A1 of FIG. 24A). If the urging force exerted by the second spring 148 is smaller than the weight of the weight 146, furthermore, the weight 146 remains to be in contact with the weight lower limit stopper 147. As a result, the second spring 148 also starts compressing to increase the urging force exerted by the second spring 148 as well (A1 of FIG. 24B). In this operational range (from FIG. 23A to FIG. 23B), therefore, the reaction force of the lever 140 and the change in the reaction force are brought about by not only the first spring 145 but also the second spring 148 (A1 of FIG. 24C).

If the amount of displacement of the lever 140 increases further, the urging force of the first spring 145 increases further (A2 of FIG. 24A). If the urging force of the second spring 148 exceeds the weight of the weight 146, the weight 146 moves upward. As a result, the second spring 148 will not be compressed any further, with little increase in the urging force of the second spring 148 (A2 of FIG. 24B). In this operational range (from FIG. 23B to FIG. 23C), therefore, although the reaction force of the lever 140 is brought about by the first spring 145 and the second spring 148, the changes in the reaction force is brought about only by the first spring 145 (A2 of FIG. 24C). The amount of depression of the lever 140 at the time of the start of upward move of the weight 146 is referred to as the first amount of depression.

Then, the undersurface of the middle part of the lever 140 comes into contact with the lower limit stopper 143 to restrict downward displacement of the forward part of the lever 140. If the depression of the lever 140 is released, the urging force of the first spring 145, the urging force of the second spring 148 and the weight of the weight 146 which serves as a movable supporting member cause the lever 140 to operate in the order opposite to that in which the lever 140 has operated on the depression of the lever 140. More specifically, the lever 140 pivots clockwise about the rotary shaft 142 in FIG. 23C, so that the undersurface of the rear part of the lever 140 comes into contact with the upper limit stopper 144 to recover to the original state (FIG. 23A).

The detection circuit 23 detects a point where the rate of change in the reaction force of the lever 140 changes on the basis of the change in the urging force exerted by the second spring 148 detected by the load sensor 150. Furthermore, the displacement sensor 151 detects the amount of displacement of the lever 140. In accordance with the changing point of the rate of change in the reaction force and the information on the amount of displacement of the lever 140, the electronic musical instrument 10 adds a damper effect to a musical tone to be generated, also controlling musical tone elements such as timbre and resonance (acoustic effect) of the musical tone to be generated. In a range AH of FIG. 24C corresponding to the above-described half pedal range AH of FIG. 34, particularly, on the basis of the load detected by the load sensor 150 and the amount of displacement detected by the displacement sensor 151, the tone generator 15 and the effect circuit 26 subtly change the musical tone elements such as timbre and resonance (acoustic effect) of musical tones to be generated in accordance with pedal manipulation of the player. The above-described control of the musical tone elements may be done on the basis of either of the load detected by the load sensor 150 or the amount of displacement detected by the displacement sensor 151.

The pedal apparatus according to the present embodiment configured as described above can achieve the characteristics (FIG. 24C) similar to those of the relationship between the amount of displacement of the lever from the start to the end of a depression of a pedal of an acoustic piano and the reaction force perceived by the player through the pedal as shown by the dashed line in FIG. 34. In the operational range (A1 of FIG. 24C) equivalent to A0 and A1 of FIG. 34, more specifically, the urging force exerted by the first spring 145 and the second spring 148 to urge the lever 140 changes, whereas in the operational range (A2 of FIG. 24C) equivalent to A2 of FIG. 34, the urging force exerted on the lever 140 by the first spring 145 changes. Therefore, the rate of change in the reaction force in the operational range (A2 of FIG. 24C) equivalent to the range of A2 of FIG. 34 can be reduced, compared with the operational range (A1 of FIG. 24C) equivalent to the range of A0 and A1 of FIG. 34.

As for the acoustic piano, the range of A3 of FIG. 34 indicates a relationship between the amount of the displacement of the lever caused by the lever and a linkage mechanism coming into contact with various stopper members to slightly compress the stopper members and the reaction force. This range is equivalent to a state of the pedal apparatus 12 of the present embodiment where the undersurface of the forward part of the lever 140 is in contact with the lower limit stopper 143. Therefore, the pedal apparatus 12 of the embodiment can realize the characteristics of the acoustic piano as shown by the dashed line in FIG. 34.

In a case where the player deeply depresses the lever 140 and then sharply decreases the amount of depression, and in a case where the player periodically changes the amount of depression of the lever 140, the weight 146 can temporarily oscillate due to collaboration of inertial force and spring force applied to the weight 146. Furthermore, the weight 146 can collide with the weight lower limit stopper 147 to cause oscillation of the weight 146. In a case where the player periodically changes the amount of depression of the lever 140 in the neighborhood of the range AH of FIG. 24C, particularly, if the frequency of the periodic changes is close to the natural frequency of the second spring 148, the amplitude of the weight 146 can grow to cause periodic collision of the weight 146 with the weight lower limit stopper 147. In this case, however, because the force of the springs acting on the lever 140 is divided into the spring force exerted by the first spring 145 and the spring force exerted by the second spring 148, the spring force exerted by the second spring 148 is small. As a result, the unnatural reaction force of the lever caused by the oscillation can be reduced. Therefore, the pedal apparatus 12 configured as described above can stabilize the reaction force of the lever 140.

Due to variations in the spring constant of the first spring 145 and the second spring 148, and depending on assembling accuracy of various parts, variations occur in the relationship between the amount of displacement of the lever 140 and the reaction force. As for the pedal apparatus 12 of the present embodiment, however, the load sensor 150 detects the reaction force of the lever 140 to find out a point where the rate of change in the reaction force changes. Therefore, the pedal apparatus 12 of the embodiment can reliably distinguish a range equivalent to the current amount of displacement of the lever 140 from among the ranges of FIG. 34. As a result, the pedal apparatus 12 of the embodiment can synchronize the feeling perceived by the player on the manipulation of the lever 140 with the start and the end of musical tone elements including damper effect to be added to musical tones to be generated and timbre, resonance (acoustic effect) and the like of musical tones to be generated. Furthermore, the present embodiment realizes the pedal apparatus having a simple structure.

Figure 22B:
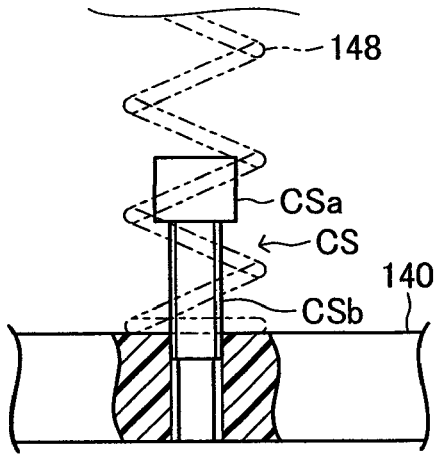
FIG. 22B is an enlarged view of a portion on which a capstan is mounted according to a modification of the seventh embodiment.

As shown in FIG. 22B, furthermore, a capstan CS may be added. The capstan CS has a cylindrical head portion CSa. Downward from the undersurface of the head portion CSa, a screw portion CSb whose diameter is slightly smaller than that of the head portion CSa extends. With a screw hole being provided on the top surface of the lever 140, the screw portion CSb is screwed into the screw hole to fix the capstan CS to the lever 140. The capstan CS is designed to have an outer diameter smaller than the interior diameter of the second spring 148 so that the central axis of the second spring 148 is overlaid with the central axis of the capstan CS. In other words, the capstan CS is situated inside the second spring 148. In a state where the lever 140 is not depressed, the top end of the head portion CSa is apart from the weight 146 to oppose to the undersurface of the weight 146. The length of the capstan CS is adjusted such that when the lever 140 is depressed to balance between the weight of the weight 146 and the urging force of the second spring 148, the capstan CS comes into contact with the undersurface of the weight 146.

In the case where the pedal apparatus 12 is configured as described above, while the weight 146 is apart from the weight lower limit stopper 147 to be displaced upward, the weight 146 is supported by the capstan CS to prevent further compression of the second spring 148. Therefore, the weight 146 can stably move upward and downward, resulting in stable reaction force exerted by the lever 140.

Figure 25A:
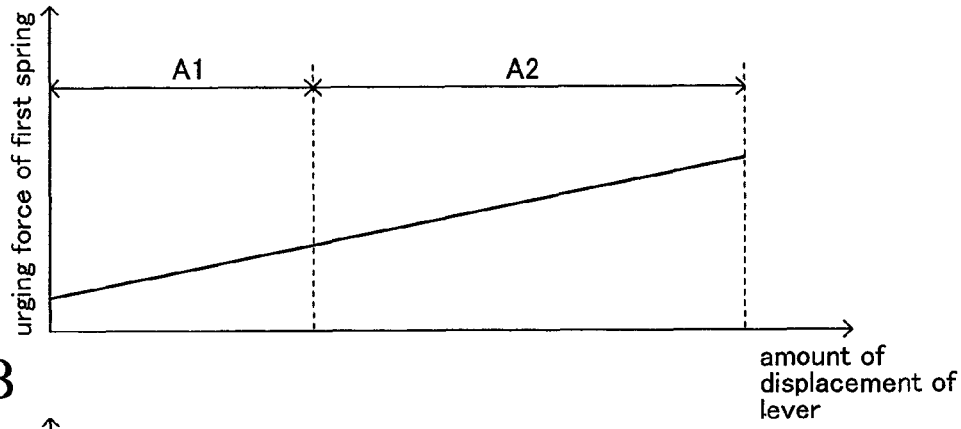
FIG. 25A is a graph showing characteristics of changes in the urging force of the first spring with respect to the amount of displacement of the lever according to the modification of the seventh embodiment.
Figure 25B:
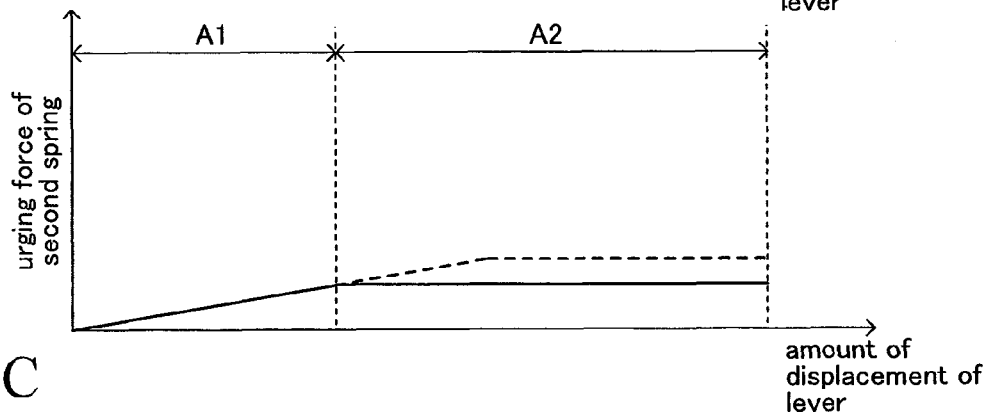
FIG. 25B is a graph showing characteristics of changes in the urging force of the second spring with respect to the amount of displacement of the lever according to the modification of the seventh embodiment.
Figure 25C:
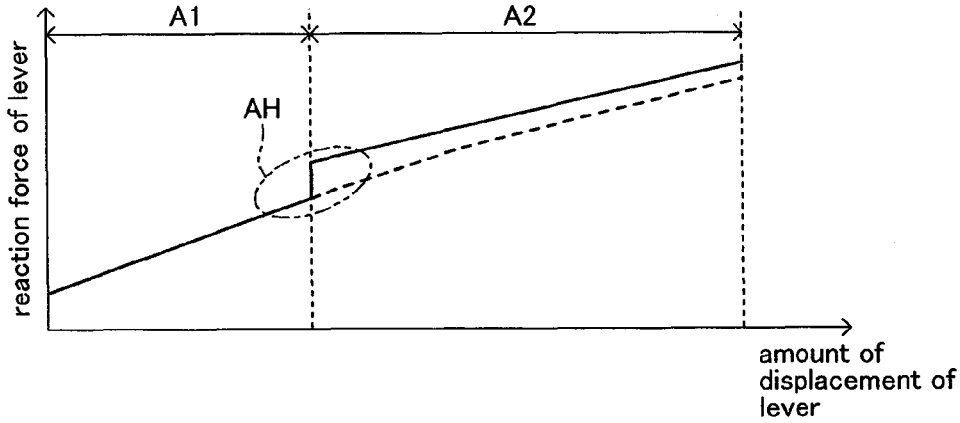
FIG. 25C is a graph showing characteristics of changes in the reaction force of the lever with respect to the amount of displacement of the lever according to the modification of the seventh embodiment.

The length of the capstan CS may be adjusted such that before the urging force of the second spring 148 exceeds the weight of the weight 146 after the depression of the lever 140, the capstan CS comes into contact with the undersurface of the weight 146. The respective urging forces of the first spring 145 and the second spring 148 with respect to the amount of displacement of the lever 140 configured as described above are shown in FIG. 25A and FIG. 25B. The reaction force exerted by the lever 140 according to the displacement of the lever 140 is shown in FIG. 25C. For comparison, the respective urging forces of the respective springs and the reaction force of the lever 140 without the capstan CS are shown by dashed lines in FIG. 25B and FIG. 25C. In this case, from the start of a depression of the lever 140 until the contact of the capstan CS with the weight 146, the urging forces of the first spring 145 and the second spring 148 increase (A1 of FIG. 25A and FIG. 25B). Once the capstan CS comes into contact with the weight 146, the second spring 148 will not be compressed any further with no increase in the urging force any more (A2 of FIG. 25B). As a result, as long as the force exerted by the lever 140 to lift the weight 146 through the capstan CS and the second spring 148 is smaller than the weight of the weight 146, the weight 146 is in contact with the weight lower limit stopper 147 to stand still. If the force exerted by the lever 140 to lift the weight 146 through the capstan CS and the second spring 148 exceeds the weight of the weight 146, the weight 146 starts being displaced upward. In addition, the urging force of the first spring 145 also increases with the increase in the amount of depression of the lever 140 (A2 of FIG. 25A). Therefore, the reaction force of the lever 140 increases stepwise when the capstan CS comes into contact with the weight 146. Compared with the rate of change in the reaction force before the contact of the capstan CS with the weight 146, the rate of change in the reaction force after the contact is small (FIG. 25C).

As for this modification, on the boundary between the range where the rate of change in the reaction force is great and the range where the rate of change is small, the reaction force of the lever 140 changes stepwise. The stepwise change in the reaction force facilitates player's perception of the boundary. Compared with the pedal apparatus 12 without the capstan CS, furthermore, the pedal apparatus 12 having the capstan CS can narrow the range where the rate of change in the reaction force is great (A1 of FIG. 25C) and widen the range where the rate of change in the reaction force is small (A2 of FIG. 25C).

Although this modification is designed such that the capstan CS is situated inside the second spring 148, the capstan CS may be placed anywhere as long as the top end of the capstan CS opposes to the undersurface of the weight 146. Alternatively, the capstan CS may be placed on the weight 146 side so that the head portion CSa of the capstan CS opposes to the top surface of the lever 140.

The above-described seventh embodiment is designed such that the top end of the first spring 145 is fixed to the frame FR situated above the rear part of the lever 140, with the lower end of the first spring 145 being in contact with the top surface of the rear part of the lever 140. However, the seventh embodiment may be modified such that the lower end of the first spring 145 is fixed to the frame FR situated below the forward part of the lever 140, with the top end of the first spring 145 being contact with a part of the undersurface of the lever 140, the part being situated in front of the rotary shaft 142. Furthermore, the seventh embodiment is designed such that the top end of the second spring 148 is inserted into the concave portion 146*a* of the weight 146 to be fixed to the upper bottom surface of the concave portion 146*a* to be supported. However, the seventh embodiment may be modified such that the lever 140 has a concave portion on its top surface so that the lower end of the second spring 148 is fixed to the bottom surface of the concave portion to be supported, with the top end of the second spring 148 being inserted into the concave portion 146*a* of the weight 146 to be in contact with the weight 146.

Figure 26:
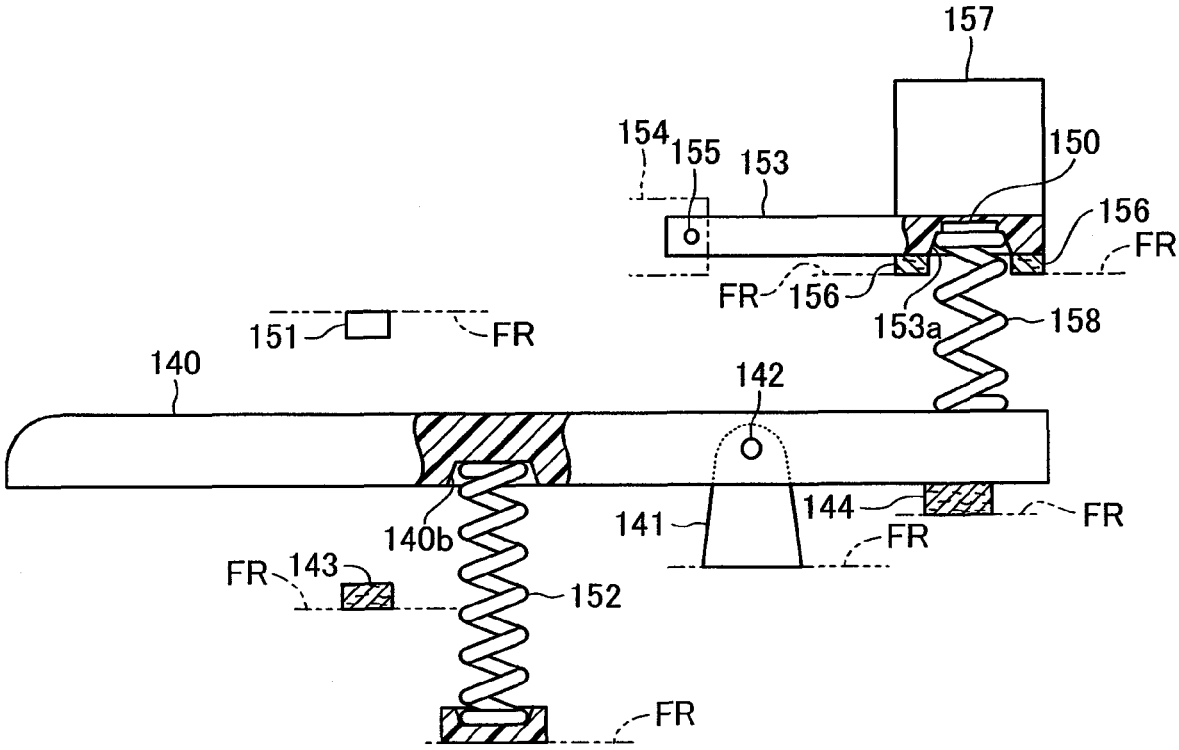
FIG. 26 is a side view of the pedal apparatus according to a modification of the seventh embodiment.

The seventh embodiment is designed such that the weight 146 can move upward and downward. However, the embodiment may be modified to have a weight lever 153 and a weight 157 which pivot in response to the lever 140 as shown in FIG. 26. In this modification, the lever 140, the lever supporting portion 141, the lower limit stopper 143 and the upper limit stopper 144 are configured similarly to those of the seventh embodiment. Below the forward part of the lever 140, the lower end of a first spring 152 is fixed to the frame FR, with the top end of the first spring 152 being inserted into a concave portion 140*b* provided on a part of the undersurface of the lever 140, the part being situated in front of the rotary shaft 142 of the lever 140. The top end of the first spring 152 is in contact with the upper bottom surface of the concave portion 140*b* so that the first spring 152 urges the forward part of the lever 140 upward. The first spring 152 is a compression spring.

Above the rear part of the lever 140, the weight lever 153 serving as a movable supporting member is provided. The weight lever 153, which is a plate-shaped member, is supported at its front end by a weight lever supporting portion 154 provided on the frame FR so that the rear end of the weight lever 153 can pivot upward and downward about a rotary shaft 155. Above the rear part of the lever 140, a weight lever lower limit stopper 156 is provided to restrict downward displacement of the rear part of the weight lever 153. The weight lever lower limit stopper 156 is also made of a shock-absorbing member such as felt in order to prevent shock noise. On the top surface of the rear part of the weight lever 153, the weight 157 which is part of the movable supporting member is provided. On the undersurface of the rear part of the weight lever 153, a concave portion 153*a* is provided. The top end of a second spring 158 is inserted into the concave portion 153*a* to be fixed to the upper bottom surface of the concave portion 153*a* to be supported. The lower end of the second spring 158 is in contact with a part of the top surface of the lever 140, the part being situated behind the rotary shaft 142 of the lever 140. The second spring 158 is a compression spring. Similarly to the seventh embodiment, in addition, the load sensor 150 is incorporated into the undersurface of the rear part of the weight lever 153, with the displacement sensor 151 being provided on the frame FR. Such a modification can also achieve the effect similar to that of the seventh embodiment.

The example having the weight lever 153 is designed such that the lower end of the first spring 152 is fixed to the frame FR situated below the middle part of the lever 140, with the top end being in contact with the undersurface of the middle part of the lever 140. However, the example may be modified such that a spring supporting portion is provided on the top surface of the lever 140 to be situated in front of the rotary shaft of the lever 140 so that the lower end of an extension spring is supported by the spring supporting portion with the top end of the extension spring being fixed to the frame FR situated above the middle part of the lever 140. Furthermore, the modification is designed such that the top end of the second spring 158 is inserted into the concave portion 153*a* of the weight lever 153 to be fixed to the upper bottom surface of the concave portion 153*a* to be supported. However, the modification may be modified such that a concave portion is provided on the top surface of the lever 140 to be situated behind the rotary shaft 142 of the lever 140 so that the lower end of the second spring 158 is fixed to the bottom surface of the concave portion to be supported, with the top end of the second spring 158 being inserted into the concave portion 153*a* of the weight lever 153 to be in contact with the weight lever 153.

i. Eighth Embodiment

Figure 27:
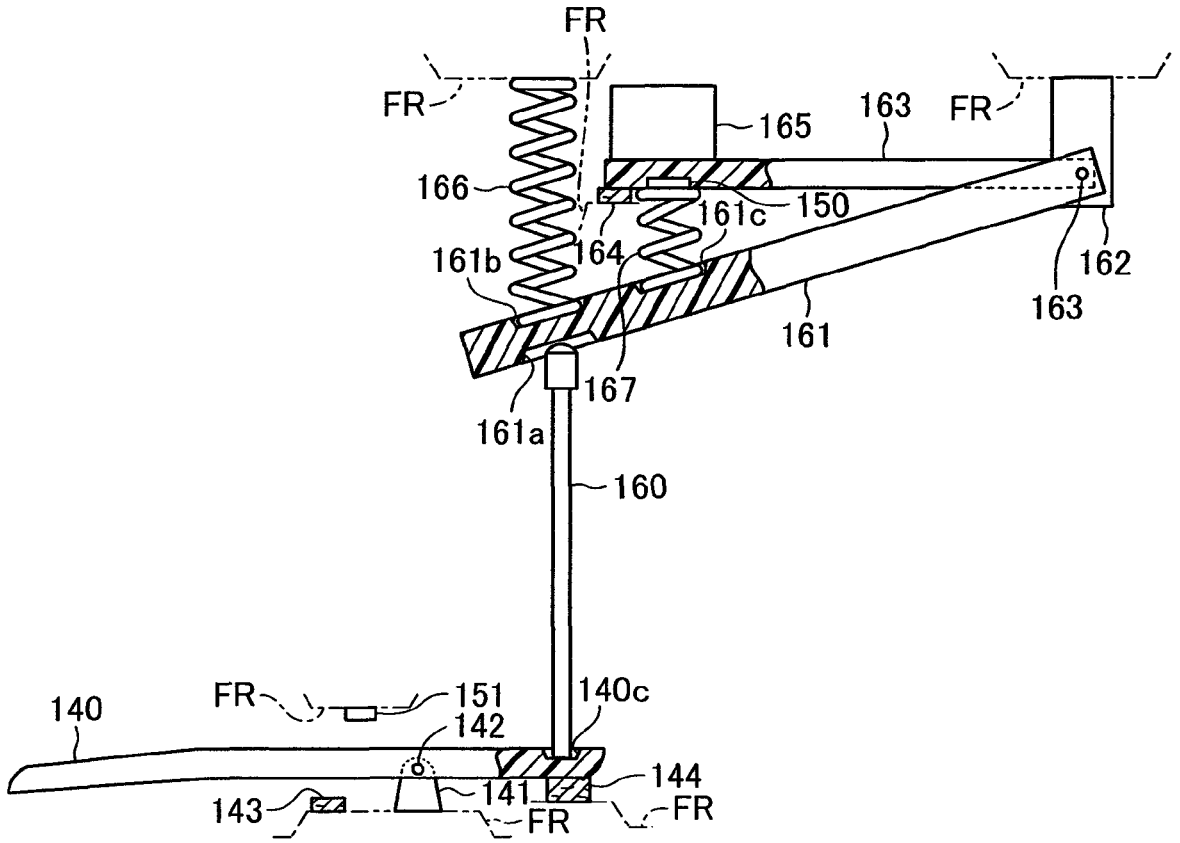
FIG. 27 is a side view of the pedal apparatus according to an eighth embodiment.

Next, an eighth embodiment of the pedal apparatus 12 according to the present invention will be described in detail. FIG. 27 is a side view of the pedal apparatus 12 according to the present embodiment. The lever 140, the lever supporting portion 141, the lower limit stopper 143 and the upper limit stopper 144 are similar to those of the seventh embodiment. Into a concave portion 140*c* provided on the top surface of the rear part of the lever 140 to be situated behind the rotary shaft 142 of the lever 140, the lower end of a drive rod 160 is inserted to be in contact with the bottom surface of the concave portion 140*c*. The drive rod 160, which is a long member, extends upward from the rear part of the lever 140. Above the rear part of the lever 140, a first movable supporting member 161 is provided so that the top end of the drive rod 160 is inserted into a concave portion 161*a* provided on the undersurface of the first movable supporting member 161 to be in contact with the upper bottom surface of the concave portion 161*a*. By a guide member which is not shown, the drive rod 160 is allowed to move only upward and downward.

The first movable supporting member 161 is a plate-shaped member which extends from the front toward the rear of the pedal apparatus 12. The first movable supporting member 161 is supported at the rear part thereof by a supporting portion 162 fixed to the frame FR so that the front end of the first movable supporting member 161 can pivot upward and downward about a rotary shaft 163. Above the first movable supporting member 161, a second movable supporting member 163 is provided. Similarly to the first movable supporting member 161, the second movable supporting member 163 is a plate-shaped member which extends from the front toward the rear of the pedal apparatus 12. The second movable supporting member 163 is supported at the rear part thereof by the supporting member 162 so that the front end of the second movable supporting member 163 can pivot upward and downward about the rotary shaft 163. Above the forward part of the first movable supporting member 161, a second movable supporting member lower limit stopper 164 fixed to the frame FR is provided to restrict downward displacement of the forward part of the second movable supporting member 163. The second movable supporting member lower limit stopper 164 is also made of shock-absorbing member such as felt in order to lessen shock noise. On the forward part of the second movable supporting member 163, a weight 165 is provided. Integrally with the second movable supporting member 163, the weight 165 serves as a movable supporting member. Into a concave portion 161*b* provided on the top surface of the forward part of the first movable supporting member 161, the lower end of a first spring 166 is inserted to be fixed to the bottom surface of the concave portion 161*b* to be supported. The top end of the first spring 166 is fixed to the frame FR situated above. The first spring 166 is a compression spring. The first spring 166 urges the front end of the lever 140 upward through the drive rod 160. Into a concave portion 161*c* provided on the top surface of the middle part of the first movable supporting member 161, the lower end of a second spring 167 is inserted to be fixed to the bottom surface of the concave portion 161*c* to be supported. The top end of the second spring 167 is in contact with the undersurface of the forward part of the second movable supporting member 163. Similarly to the seventh embodiment, the load sensor 150 is incorporated into the undersurface of the forward part of the second movable supporting member 163, while the displacement sensor 151 is provided on the frame FR.

Next, the operation of the pedal apparatus 12 configured as described above will be described. Although the configuration of the present embodiment is different from that of the seventh embodiment, the present embodiment operates almost similarly to the seventh embodiment. In a state where the lever 140 is not depressed, the first movable supporting member 161 is urged downward by the first spring 166, so that the rear part of the lever 140 is urged downward through the drive rod 160. Resultantly, the undersurface of the rear part of the lever 140 is in contact with the upper limit stopper 144, so that the lever 140 stands still to be in the state shown in FIG. 27. In this state, the second spring 167 is in its natural length, resulting in the urging force exerted on the lever 140 of "0". In this state, furthermore, the second movable supporting member 163 is in contact with the second movable supporting member lower limit stopper 164 by the weight of the second movable supporting member 163 and the weight 165. In this state, although the second spring 167 may be slightly compressed to urge the second movable supporting member 163, the urging force of the second spring 167 is designed to be smaller than a combined force formed of the weight of the second movable supporting member 163 and the weight of the weight 165 so that the second movable supporting member 163 is in contact with the second movable supporting member lower limit stopper 164.

If the player depresses the lever 140 in spite of the urging force exerted by the first spring 166, the lever 140 starts pivoting counterclockwise about the rotary shaft 142 in FIG. 27, so that the rear part of the lever 140 is displaced upward. By this displacement, the drive rod 160 causes the forward part of the first movable supporting member 161 to be displaced upward. As a result, the first spring 166 is compressed to increase the urging force exerted on the lever 140 by the first spring 166 (A1 of FIG. 24A). If the urging force exerted by the second spring 167 is smaller than the combined force formed of the weight of the second movable supporting member 163 and the weight of the weight 165, the second movable supporting member 163 remains to be in contact with the second movable supporting member lower limit stopper 164. As a result, the second spring 167 also starts compressing to increase the urging force exerted by the second spring 167 (A1 of FIG. 24B). In this operational range, therefore, the reaction force of the lever 140 and the change in the reaction force are brought about by the first spring 166 and the second spring 167 (A1 of FIG. 24C).

Then, if the urging force exerted by the second spring 167 exceeds the weight of the second movable supporting member 163 and the weight 165, the forward part of the second movable supporting member 163 moves upward. As a result, the second spring 167 will be hardly compressed any further with little increase in the urging force of the second spring 167. In this operational range, therefore, although the reaction force of the lever 140 is brought about by the first spring 166 and the second spring 167, the change in the reaction force is brought about only by the first spring 166 (A2 of FIG. 24C). The amount of depression of the lever 140 at the time of the start of upward move of the forward part of the second movable supporting member 163 is referred to as the first amount of depression.

Then, the undersurface of the middle part of the lever 140 comes into contact with the lower limit stopper 143 to restrict downward displacement of the forward part of the lever 140. If the depression of the lever 140 is released, the urging forces exerted by the first spring 166 and the second spring 167 and the weight of the first movable supporting member 161 and the second movable supporting member 163 cause the lever 140 to operate in the order opposite to that in which the lever 140 has operated on the depression of the lever 140. More specifically, the lever 140 pivots clockwise about the rotary shaft 142 in FIG. 27, so that the undersurface of the rear part of the lever 140 comes into contact with the upper limit stopper 144 to recover to the original state (FIG. 27). The load sensor 150 and the displacement sensor 151 operate similarly to the seventh embodiment to control the damper effect and musical tone elements of musical tones to be generated as in the case of the seventh embodiment.

As for the pedal apparatus according to the eighth embodiment configured as described above, similarly to the seventh embodiment, the urging forces exerted by the first spring 166 and the second spring 167 change according to the ranges equivalent to the respective operational ranges shown in FIG. 34. As a result, the pedal apparatus according to the present embodiment can achieve the characteristics (FIG. 24C) similar to those of the relationship between the amount of displacement of the lever from the start to the end of a depression of a pedal of an acoustic piano and the reaction force perceived by the player through the pedal as shown by the dashed line in FIG. 34.

In the present embodiment, similarly to the seventh embodiment, in the case where the player sharply decreases the amount of depression of the lever 140, and in the case where the player periodically changes the amount of depression of the lever 140, the second movable supporting member 163 can temporarily oscillate due to collaboration of inertial force and spring force acting on the second movable supporting member 163 and the weight 165. Furthermore, the second movable supporting member 163 can collide with the second movable supporting member lower limit stopper 164 to cause oscillation of the second movable supporting member 163. In this case, because the force of the springs acting on the lever 140 is divided into the spring force exerted by the first spring 166 and the spring force exerted by the second spring 167, the spring force exerted by the second spring 167 is small. As a result, the unnatural reaction force of the lever caused by the oscillation can be reduced. Therefore, the pedal apparatus 12 can stabilize the reaction force of the lever 140.

In addition, because the load sensor 150 and the displacement sensor 151 operate similarly to the seventh embodiment, the pedal apparatus 12 of the present embodiment can synchronize the feeling perceived by the player on the manipulation of the lever 140 with the start and the end of musical tone elements including damper effect to be added to musical tones to be generated, and timbre, resonance (acoustic effect) and the like of musical tones to be generated. Furthermore, the present embodiment realizes the pedal apparatus having a simple structure.

Between the first movable supporting member 161 and the second movable supporting member 163, the capstan CS similar to that of the modification of the seventh embodiment may be provided. Such a modification also achieves the effect similar to the modification of the seventh embodiment.

The eighth embodiment is designed such that the lower end of the first spring 166 is inserted into the concave portion 161*b* provided on the first movable supporting member 161 to be fixed to the bottom surface of the concave portion 161 to be supported. However, the eighth embodiment may be modified such that a spring supporting portion is provided on the forward part of the first movable supporting member 161 so that the top end of an extension spring is supported by the spring supporting portion with the lower end of the extension spring being fixed to the frame FR situated below the first movable supporting member 161. Such a modification can achieve the effect similar to the eighth embodiment.

j. Ninth Embodiment

Figure 28:
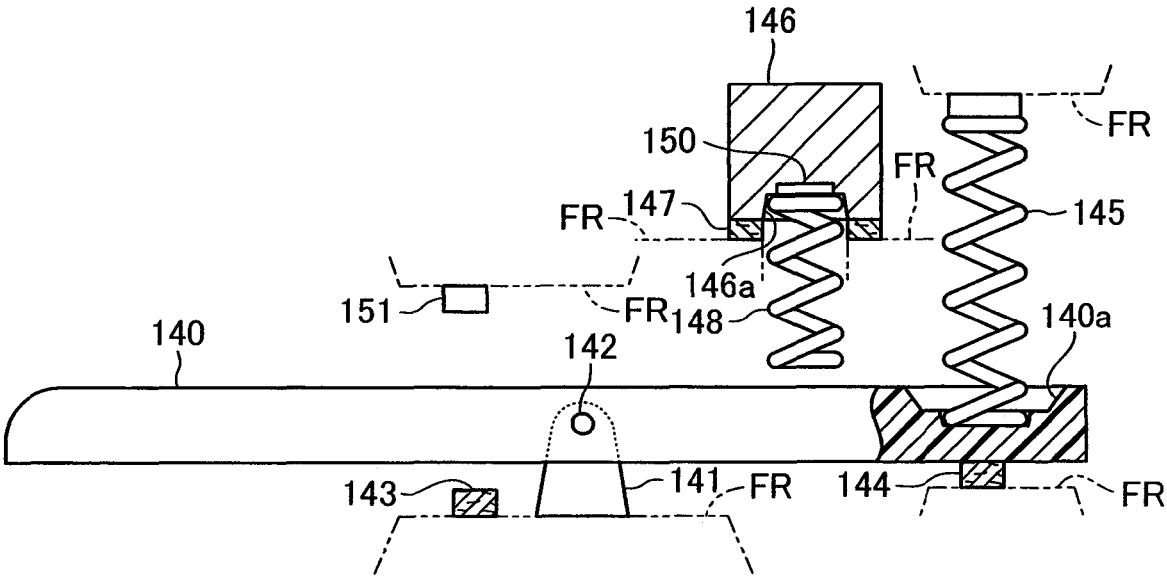
FIG. 28 is a side view of the pedal apparatus according to a ninth embodiment.

Next, a ninth embodiment of the pedal apparatus 12 according to the present invention will be described in detail. FIG. 28 is a side view of the pedal apparatus of the electronic musical instrument according to the present embodiment. This embodiment is configured almost similarly to the seventh embodiment shown in FIG. 22A. Unlike the seventh embodiment, however, in a state where the lever 140 is not depressed, the lower end of the second spring 148 is apart from the lever 140.

Next, the operation of the pedal apparatus 12 configured as described above will be explained. FIG. 29A through FIG. 29D show various states in which the lever 140 and the weight 146 are displaced, with the first spring 145 and the second spring 148 being compressed. FIG. 30A and FIG. 30B show the urging force of the first spring 145 and the second spring 148 with respect to the amount of displacement of the lever 140. FIG. 30C shows the reaction force generated by the lever 140 according to the displacement of the lever 140. In a state where the lever 140 is not depressed, the rear part of the lever 140 is urged downward by the first spring 145. As a result, the undersurface of the rear part of the lever 140 is in contact with the upper limit stopper 144, so that the lever 140 stands still to be in a state shown in FIG. 29A. In this state, the weight 146 is in contact with the weight lower limit stopper 147 by the weight of the weight 146, so that the weight 146 stands still.

Figure 29A:
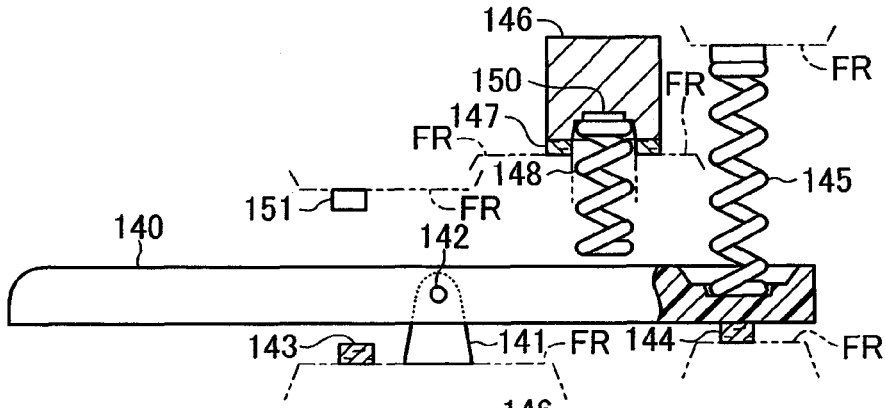
FIG. 29A is a diagram showing the position of the lever and the weight, and the state where the first spring and the second spring are compressed in a state where the lever is not depressed according to the ninth embodiment.
Figure 29B:
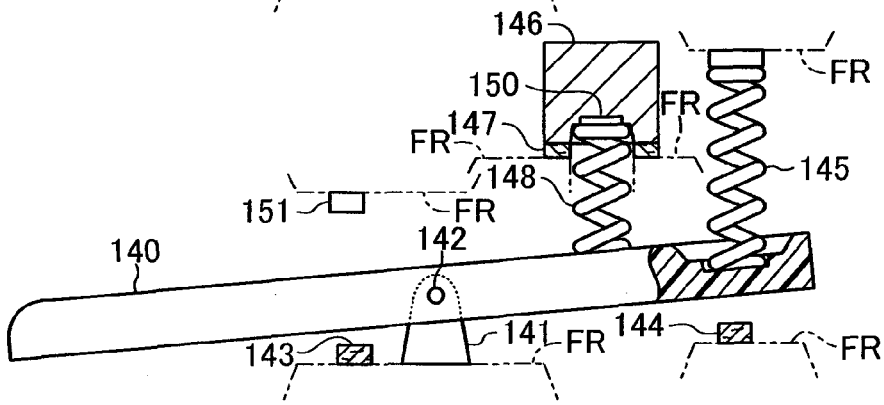
FIG. 29B is a diagram showing the position of the lever and the weight, and the state where the first spring and the second spring are compressed in a state where the lever comes into contact with the second spring according to the ninth embodiment.
Figure 29C:
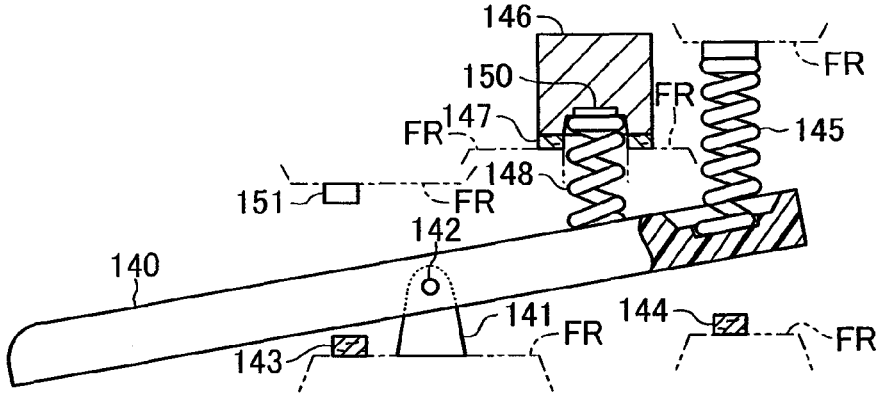
FIG. 29C is a diagram showing the position of the lever and the weight, and the state where the first spring and the second spring are compressed in a state where the weight starts being displaced according to the ninth embodiment.
Figure 29D:
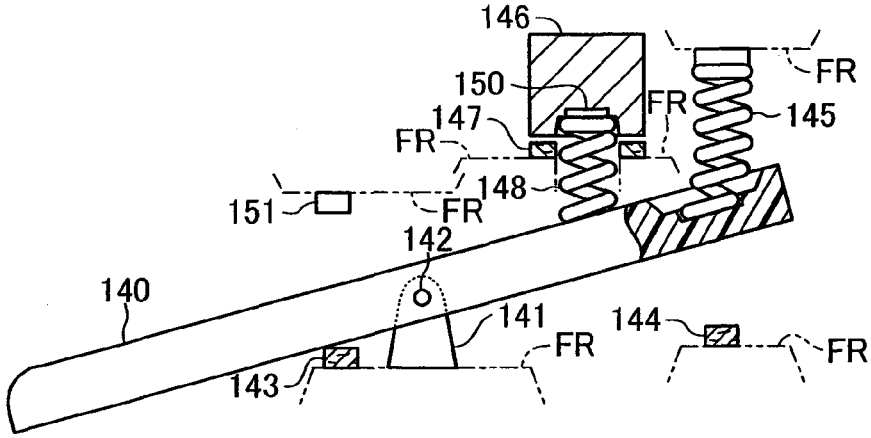
FIG. 29D is a diagram showing the position of the lever and the weight, and the state where the first spring and the second spring are compressed in a state where the amount of depression of the lever is at the maximum according to the ninth embodiment.
Figure 30A:
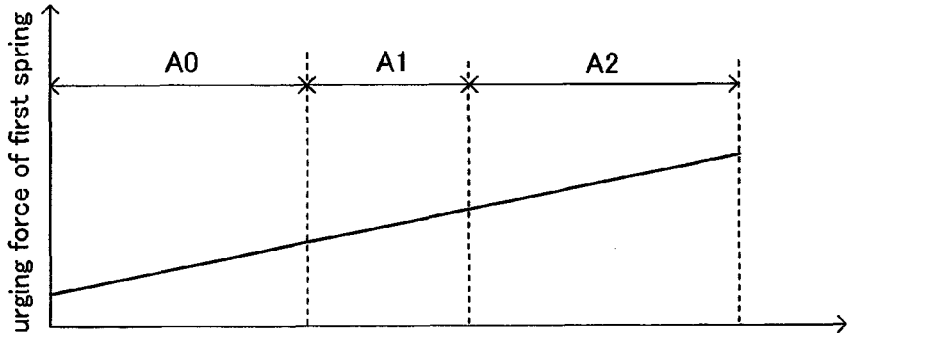
FIG. 30A is a graph showing characteristics of changes in the urging force of the first spring with respect to the amount of displacement of the lever according to the ninth embodiment.
Figure 30B:
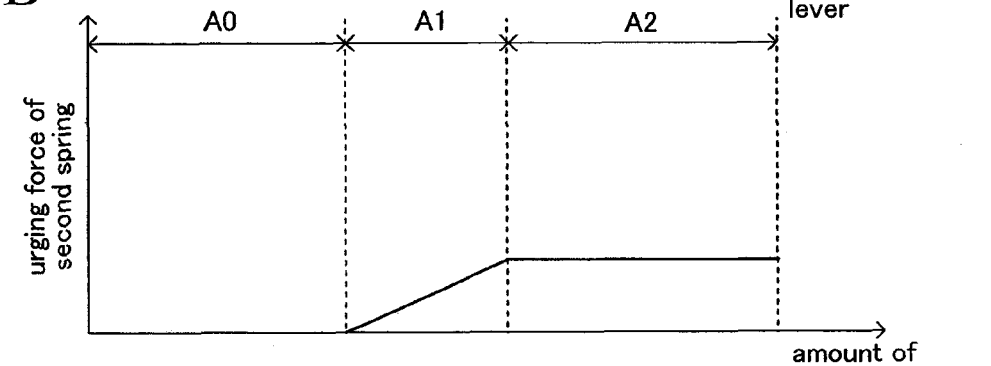
FIG. 30B is a graph showing characteristics of changes in the urging force of the second spring with respect to the amount of displacement of the lever according to the ninth embodiment.
Figure 30C:
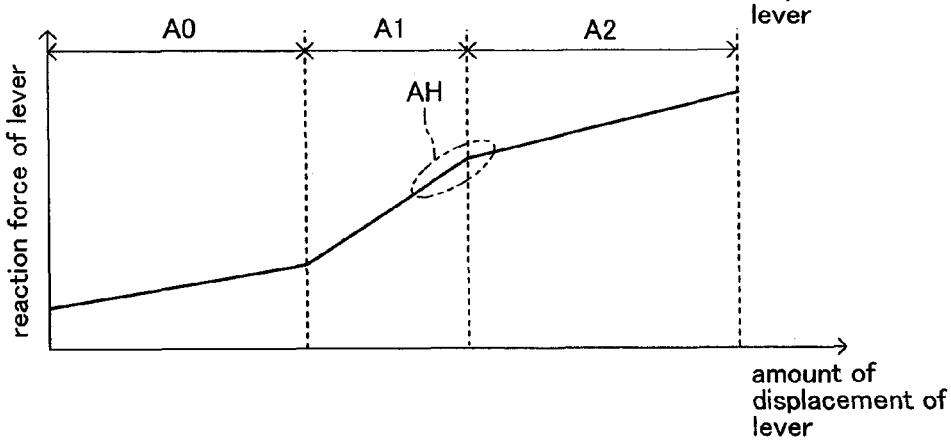
FIG. 30C is a graph showing characteristics of changes in the reaction force of the lever with respect to the amount of displacement of the lever according to the ninth embodiment.

If the player depresses the lever 140 in spite of the urging force exerted by the first spring 145, the lever 140 starts pivoting counterclockwise about the rotary shaft 142 in FIG. 29A, so that the rear part of the lever 140 is displaced upward. This displacement causes compression of the first spring 145 to increase the urging force exerted by the first spring 145 (A0 of FIG. 30A). In this operational range (from FIG. 29A to FIG. 29B), the lower end of the second spring 148 is not in contact with the lever 140. In this operational range, therefore, the reaction force of the lever 140 and the change in the reaction force are brought about by the first spring 145 (A0 of FIG. 30C).

If the player depresses the lever 140 further to increase the amount of the displacement of the lever 140, the urging force exerted by the first spring 145 on the lever 140 increases further (A1 of FIG. 30A). The lower end of the second spring 148 comes into contact with the top surface of the lever 140. If the urging force exerted by the second spring 148 is smaller than the weight of the weight 146, the weight 146 remains to be in contact with the weight lower limit stopper 147. As a result, the second spring 148 also starts compressing to increase the urging force exerted by the second spring 148 (A1 of FIG. 30B). In this operational range (from FIG. 29B to FIG. 29C), therefore, the reaction force of the lever 140 and the change in the reaction force are brought about by the first spring 145 and the second spring 148 (A1 of FIG. 30C). The amount of depression of the lever 140 at the time of the contact of the lower end of the second spring 148 with the top surface of the lever 140 is referred to as the second amount of depression.

If the amount of the displacement of the lever 140 increases further, the urging force of the first spring 145 also increases further (A2 of FIG. 30A). Then, if the urging force exerted by the second spring 148 exceeds the weight of the weight 146, the weight 146 moves upward. As a result, the second spring 148 will be hardly compressed any further without any increase in the urging force of the second spring 148 (A2 of FIG. 30B). In this operational range (from FIG. 29C to FIG. 29D), therefore, although the reaction force of the lever 140 is brought about by the first spring 145 and the second spring 148, the change in the reaction force is brought about only by the first spring 145 (A2 of FIG. 30C). The amount of depression of the lever 140 at the time of the start of upward move of the weight 146 is referred to as the first amount of depression.

Then, the undersurface of the middle part of the lever 140 comes into contact with the lower limit stopper 143 to restrict downward displacement of the forward part of the lever 140. If the depression of the lever 140 is released, the urging forces exerted by the first spring 145 and the second spring 148, and the weight of the weight 146 which serves as a movable supporting member cause the lever 140 to operate in the order opposite to that in which the lever 140 has operated on the depression of the lever 140. More specifically, the lever 140 pivots clockwise about the rotary shaft 142 in FIG. 29D, so that the undersurface of the rear part of the lever 140 comes into contact with the upper limit stopper 144 to recover to the original state (FIG. 29A). The load sensor 150 and the displacement sensor 151 operate similarly to the seventh embodiment to control the damper effect and musical tone elements of musical tones to be generated as in the case of the seventh embodiment.

The pedal apparatus according to the embodiment configured as described above can achieve the characteristics (FIG. 30C) similar to those of the relationship between the amount of displacement of the lever from the start to the end of a depression of a pedal of an acoustic piano and the reaction force perceived by the player through the pedal as shown by the solid line in FIG. 34. In the operational range (A0 of FIG. 30C) equivalent to A0 of FIG. 34, more specifically, the urging force exerted by the first spring 145 to urge the lever 140 changes, whereas in the operational range (A1 of FIG. 30C) equivalent to A1 of FIG. 34, the urging force exerted by the second spring 148 also changes in addition to the urging force of the first spring 145. Compared with the operational range (A0 of FIG. 30C) equivalent to A0 of FIG. 34, therefore, the rate of change in the reaction force can be increased in the operational range (A1 of FIG. 30C) equivalent to A1 of FIG. 34. In the operational range (A2 of FIG. 30C) equivalent to A2 of FIG. 34, the urging force of only the first spring 145 changes. Compared with the operational range (A1 of FIG. 30C) equivalent to the range of A1 of FIG. 34, therefore, the rate of change in the reaction force in the operational range (A2 of FIG. 30C) equivalent to the range of A2 of FIG. 34 can be reduced. Therefore, the pedal apparatus 12 of the embodiment can realize the characteristics of the acoustic piano as shown by the solid line in FIG. 34.

In the present embodiment, similarly to the seventh embodiment, in a case where the player sharply decreases the amount of depression, and in a case where the player periodically changes the amount of depression of the lever 140, the weight 146 can temporarily oscillate due to collaboration of inertial force and spring force applied to the weight 146. Furthermore, the weight 146 can collide with the weight lower limit stopper 147 to cause oscillation of the weight 146. In this case, however, because the force of the springs acting on the lever 140 is divided into the spring force exerted by the first spring 145 and the spring force exerted by the second spring 148, the spring force exerted by the second spring 148 is small. As a result, the unnatural reaction force of the lever caused by the oscillation can be reduced. Therefore, the pedal apparatus 12 configured as described above can stabilize the reaction force of the lever 140.

In addition, because the load sensor 150 and the displacement sensor 151 operate similarly to the seventh embodiment, the pedal apparatus 12 of the present embodiment can synchronize the feeling perceived by the player on the manipulation of the lever 140 with the start and the end of musical tone elements including damper effect to be added to musical tones to be generated, and timbre, resonance (acoustic effect) and the like of musical tones to be generated. Furthermore, the present embodiment realizes the pedal apparatus having a simple structure.

Figure 31A:
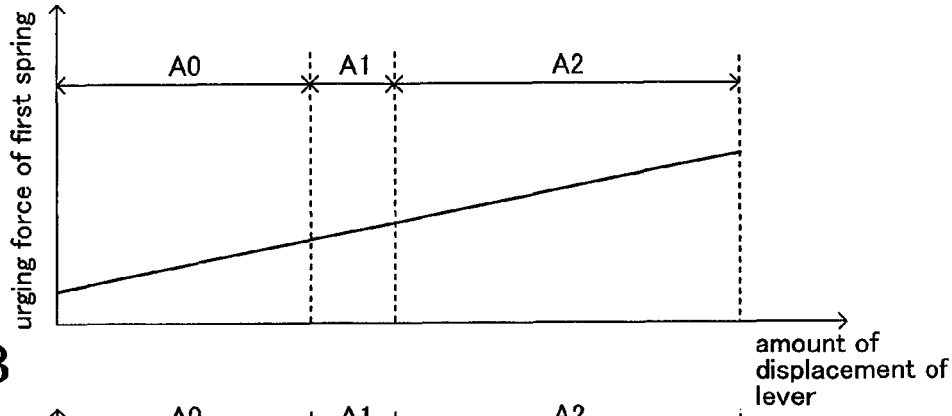
FIG. 31A is a graph showing characteristics of changes in the urging force of the first spring with respect to the amount of displacement of the lever according to a modification of the ninth embodiment.
Figure 31B:
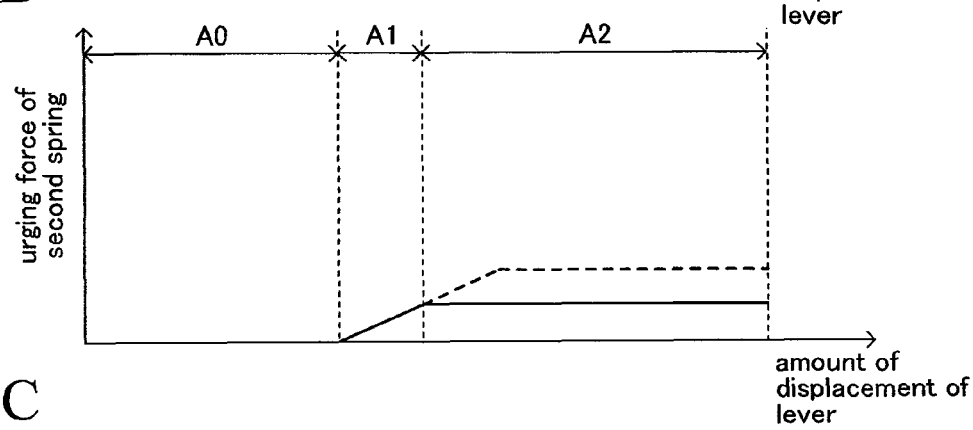
FIG. 31B is a graph showing characteristics of changes in the urging force of the second spring with respect to the amount of displacement of the lever according to the modification of the ninth embodiment.
Figure 31C:
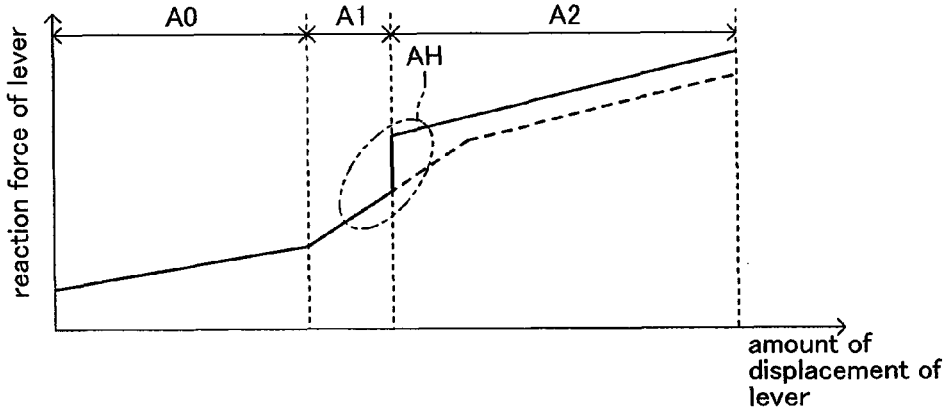
FIG. 31C is a graph showing characteristics of changes in the reaction force of the lever with respect to the amount of displacement of the lever according to the modification of the ninth embodiment.

Between the weight 146 and the lever 140, the capstan CS similar to that of the modification of the seventh embodiment may be provided. Such a modification can stabilize reaction force of the lever 140 as in the case of the modification of the seventh embodiment. In addition, the modification of the ninth embodiment may be further modified such that the capstan CS comes into contact with the weight 146 before the urging force of the second spring 148 exceeds the weight of the weight 146. The respective urging forces of the first spring 145 and the second spring 148 with respect to the amount of displacement of the lever 140 in this modification are shown in FIG. 31A and FIG. 31B. FIG. 31C shows the reaction force generated by the lever 140 according to the displacement of the lever 140. For comparison, the respective urging forces of the respective springs and the reaction force of the lever 140 without the capstan CS are shown by dashed lines in FIG. 31. From the start of a depression of the lever 140 until the contact of the second spring 148 with the lever 140, the urging force of only the first spring 145 increases (A0 of FIG. 31A). From the contact of the second spring 148 with the lever 140 until the capstan CS comes into contact with the weight 146, the urging forces of the first spring 145 and the second spring 148 increase (A1 of FIG. 31A and A1 of FIG. 31B). If the contact of the capstan CS with the weight 146 is followed by the further increase in the amount of the depression of the lever 140, the urging force of the first spring 145 increases according to the increase in the amount of the depression, without any further increase in the urging force of the second spring 148 (A2 of FIG. 31A to FIG. 31C). As for this modification, on the boundary between the range where the rate of change in the reaction force is great and the range where the rate of change is small, the reaction force of the lever 140 changes stepwise. The stepwise change in the reaction force facilitates player's perception of the boundary. Compared with the pedal apparatus 12 without the capstan CS, furthermore, the pedal apparatus 12 having the capstan CS can narrow the range where the rate of change in the reaction force is great (A1 of FIG. 31C) and widen the range where the rate of change in the reaction force is small (A2 of FIG. 31C).

Figure 32:
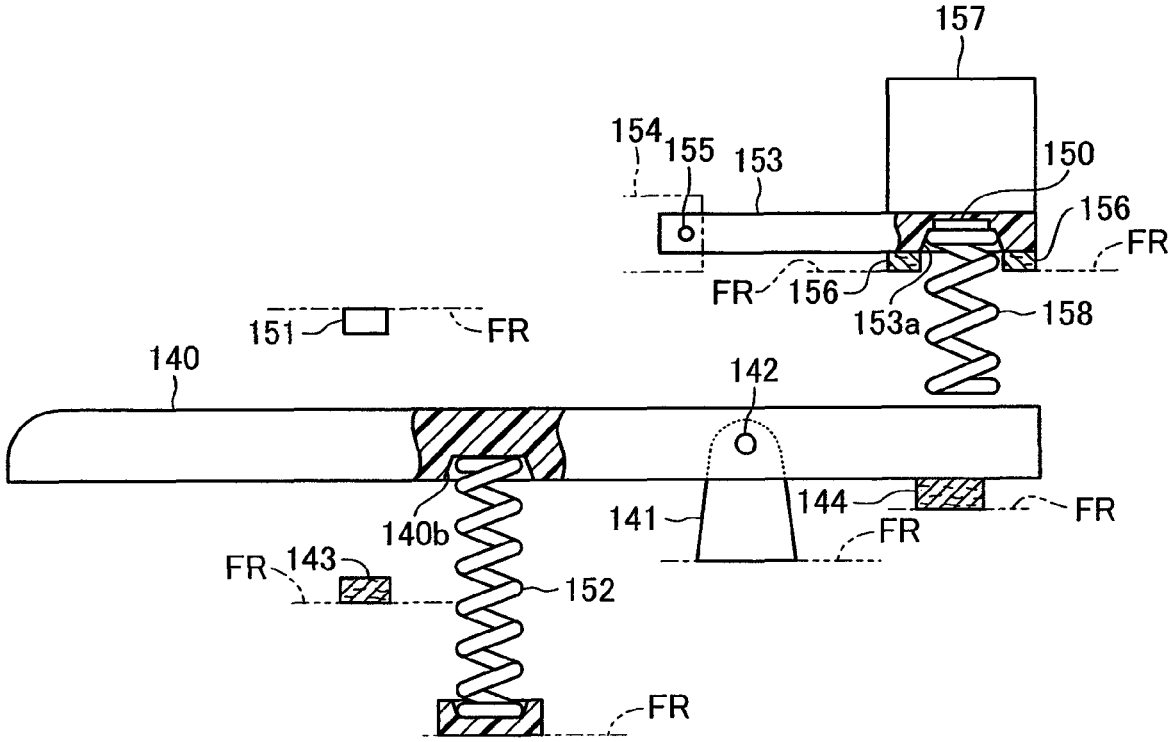
FIG. 32 is a side view of the pedal apparatus according to a modification of the ninth embodiment.

Similarly to the modification of the seventh embodiment, in addition, the position where the first spring 145 is provided may be changed. Furthermore, the ninth embodiment is designed such that in a state where the lever 140 is not depressed, the lower end of the second spring 148 is apart from the lever 140. However, the ninth embodiment may be modified such that a concave portion is provided on the top surface of the lever 140 so that the lower end of the second spring 148 is inserted into the concave portion to be fixed to the concave portion with the top end of the second spring 148 being apart from the weight 146. As shown in FIG. 32, furthermore, the weight 146 may be replaced with the weight lever 153 and the weight 157 which pivot in response to the lever 140. The modification shown in FIG. 32 is obtained by modifying the modification of the seventh embodiment shown in FIG. 26 such that the lower end of the second spring 158 in a state where the lever 140 is not depressed is apart from the lever 140. In addition, this modification may be also modified such that a concave portion is provided on the top surface of the lever 140 so that the lower end of the second spring 158 is inserted into the concave portion to be fixed to the concave portion with the top end of the second spring 158 being apart from the weight lever 153. Such modifications can also achieve the effect similar to that of the ninth embodiment.

k. Tenth Embodiment

Figure 33:
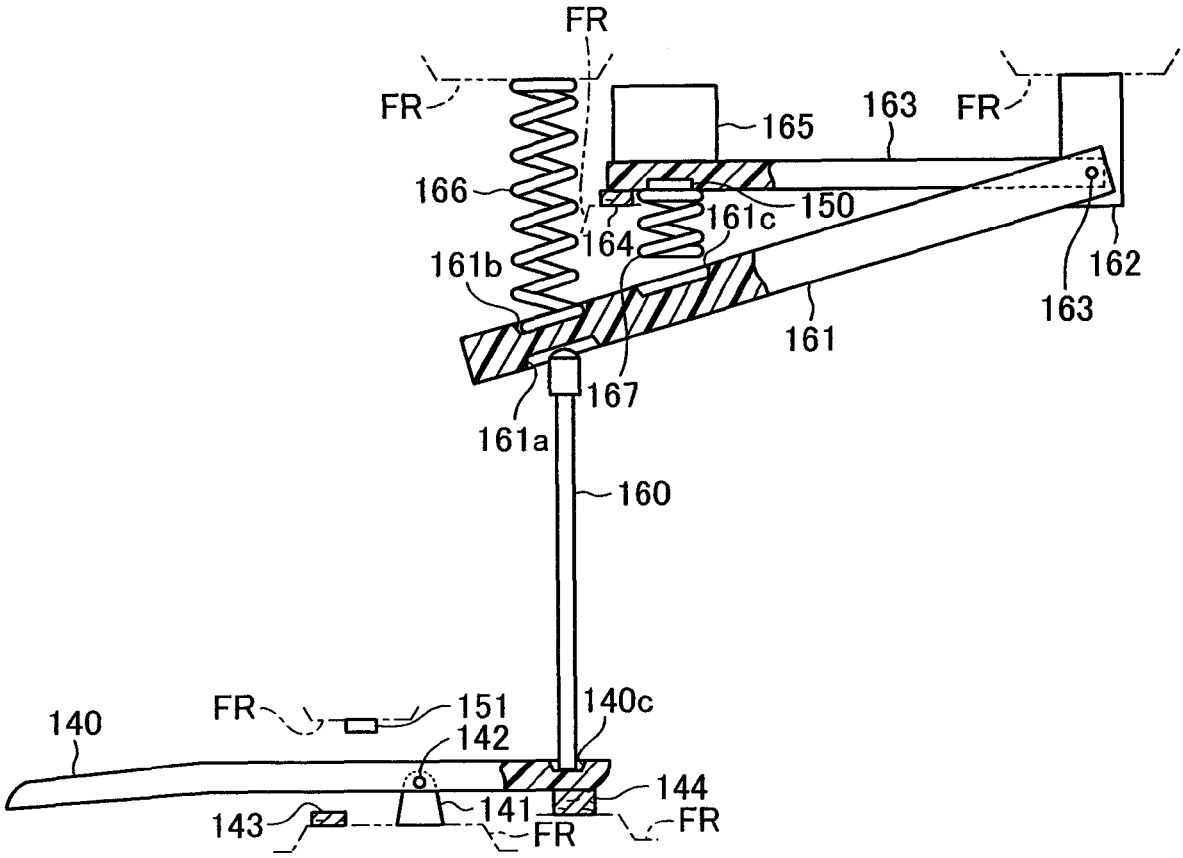
FIG. 33 is a side view of the pedal apparatus according to a tenth embodiment.

Next, a tenth embodiment of the pedal apparatus 12 according to the present invention will be described in detail. FIG. 33 is a side view of the pedal apparatus 12 of the present embodiment. This embodiment is configured almost similarly to the eighth embodiment shown in FIG. 27. Unlike the eighth embodiment, however, in a state where the lever 140 is not depressed, the lower end of the second spring 167 is apart from the first movable supporting member 161.

Next, the operation of the pedal apparatus 12 configured as described above will be explained. In a state where the lever 140 is not depressed, the first movable supporting member 161 is urged downward by the first spring 166 to urge the rear part of the lever 140 downward through the drive rod 160. As a result, the undersurface of the rear part of the lever 140 is in contact with the upper limit stopper 144, so that the lever 140 stands still to be in a state shown in FIG. 33. In this state, the second movable supporting member 163 pivots counterclockwise about the rotary shaft 163 in FIG. 33 by the weight of the weight 165 and the second movable supporting member 163, so that the undersurface of the forward part of the second movable supporting member 163 comes into contact with the second movable supporting member lower limit stopper 164 to stand still.

If the player depresses the lever 140 in spite of the urging force exerted by the first spring 166, the lever 140 starts pivoting counterclockwise about the rotary shaft 142 in FIG. 33, so that the rear part of the lever 140 is displaced upward. By this displacement, the drive rod 160 causes the forward part of the first movable supporting member 161 to be displaced upward. As a result, the first spring 166 is compressed to increase the urging force exerted on the lever 140 by the first spring 166 (A0 of FIG. 30A). In this operational range, the lower end of the second spring 167 is not in contact with the first movable supporting member 161. In this operational range, therefore, the reaction force of the lever 140 and the change in the reaction force are brought about by the first spring 166 (A0 of FIG. 30C).

If the player depresses the lever 140 further to increase the amount of the displacement of the lever 140, the urging force exerted by the first spring 166 on the lever 140 increases further (A1 of FIG. 30A). The lower end of the second spring 167 comes into contact with the top surface of the first movable supporting member 161. If the urging force exerted by the second spring 167 is smaller than the weight of the second movable supporting member 163 and the weight 165, the second movable supporting member 163 remains to be in contact with the second movable supporting member lower limit stopper 164. As a result, the second spring 167 also starts compressing to increase the urging force exerted by the second spring 167 (A1 of FIG. 30B). In this operational range, therefore, the reaction force of the lever 140 and the change in the reaction force are brought about by the first spring 166 and the second spring 167 (A1 of FIG. 30C). The amount of depression of the lever 140 at the time of the contact of the lower end of the second spring 167 with the top surface of the first movable supporting member 161 is referred to as the second amount of depression.

Then, if the urging force of the second spring 167 exceeds the combined force formed of the respective weights of the second movable supporting member 163 and the weight 165, the forward part of the second movable supporting member 163 is displaced upward. As a result, the second spring 167 will not be compressed any further, with no increase in the urging force of the second spring 167. Therefore, although the reaction force of the lever 140 is brought about by the first spring 166 and the second spring 167, the change in the reaction force is brought about only by the first spring 166 (A2 of FIG. 30C). The amount of depression of the lever 140 at the time of the start of upward displacement of the forward part of the second movable supporting member 163 is referred to as the first amount of depression.

Then, the undersurface of the middle part of the lever 140 comes into contact with the lower limit stopper 143 to restrict downward displacement of the forward part of the lever 140. If the depression of the lever 140 is released, the urging forces exerted by the first spring 166 and the second spring 167, and the weight of the first movable supporting member 161 cause the lever 140 to operate in the order opposite to that in which the lever 140 has operated on the depression of the lever 140. More specifically, the lever 140 pivots clockwise about the rotary shaft 142 in FIG. 33, so that the undersurface of the rear part of the lever 140 comes into contact with the upper limit stopper 144 to recover to the original state (FIG. 33). The load sensor 150 and the displacement sensor 151 operate similarly to the seventh embodiment to control the damper effect and musical tone elements of musical tones to be generated as in the case of the seventh embodiment.

As for the pedal apparatus according to the tenth embodiment configured as described above, similarly to the ninth embodiment, the urging forces exerted by the first spring 166 and the second spring 167 change according to the ranges equivalent to the respective operational ranges shown in FIG. 34. As a result, the pedal apparatus according to the present embodiment can achieve the characteristics (FIG. 30C) similar to those of the relationship between the amount of displacement of the lever from the start to the end of a depression of a pedal of an acoustic piano and the reaction force perceived by the player through the pedal as shown by the solid line in FIG. 34.

In the present embodiment, similarly to the seventh embodiment, in the case where the player sharply decreases the amount of depression of the lever 140, and in the case where the player periodically changes the amount of depression of the lever 140, the second movable supporting member 163 can temporarily oscillate due to collaboration of inertial force and spring force acting on the second movable supporting member 163 and the weight 165. Furthermore, the second movable supporting member 163 can collide with the second movable supporting member lower limit stopper 164 to cause oscillation of the second movable supporting member 163. In this case, because the force of the springs acting on the lever 140 is divided into the spring force exerted by the first spring 166 and the spring force exerted by the second spring 167, the spring force exerted by the second spring 167 is small. As a result, the unnatural reaction force of the lever caused by the oscillation can be reduced. Therefore, the pedal apparatus 12 can stabilize the reaction force of the lever 140.

In addition, because the load sensor 150 and the displacement sensor 151 operate similarly to the seventh embodiment, the pedal apparatus 12 of the present embodiment can synchronize the feeling perceived by the player on the manipulation of the lever 140 with the start and the end of musical tone elements including damper effect to be added to musical tones to be generated, and timbre, resonance (acoustic effect) and the like of musical tones to be generated. Furthermore, the present embodiment realizes the pedal apparatus having a simple structure.

Furthermore, the present embodiment may be modified to have the capstan CS similar to that of the modification of the seventh embodiment between the first movable supporting member 161 and the second movable supporting member 163. Similarly to the modification of the eighth embodiment, in addition, the present embodiment may be modified to replace the first spring 166 with an extension spring. Furthermore, the tenth embodiment is designed such that in a state where the lever 140 is not depressed, the lower end of the second spring 167 is apart from the first movable supporting member 161. However, the embodiment may be modified such that the lower end of the second spring 167 is inserted into the concave portion 161*c* to be fixed to the concave portion with the upper end of the second spring 167 being apart from the second movable supporting member 163. Such modifications can achieve the effect similar to the modifications of the seventh embodiment.

In the first to tenth embodiments, the pedal apparatus 12 is applied to the damper pedal of the electronic musical instrument. However, the pedal apparatus 12 can be applied to the other pedals such as a sostenuto pedal and soft pedal of an electronic musical instrument.

What is claimed is:

1. A pedal apparatus of an electronic musical instrument comprising:

a fixed supporting member;

a lever supported by the fixed supporting member and pivotable by a player's depression of the lever from an initial state to a final state;

a plurality of springs that exert spring force on the lever; and a movable supporting member that supports any of the plurality of springs and is displaceable in response to pivoting of the lever, wherein the fixed supporting member restricts the displacement of the movable supporting member when an amount of depression of the lever increases from the initial state to a first predetermined amount of depression occurring before the final state, wherein the plurality of springs comprise first to third springs, wherein the first spring exerts spring force on the lever at all times in a direction resisting the depression of the lever, and wherein when an amount of depression of the lever increases from the initial state to the first predetermined amount of depression, a rate of change in reaction force with respect to the depression is lower between the initial state and the first predetermined amount of depression than between the first predetermined amount of depression and the final state due to collaboration of the second spring, the third spring, and the movable supporting member.

2. The pedal apparatus of an electronic musical instrument according to claim 1, wherein:

the fixed supporting member restricts the displacement of the movable supporting member from a predetermined position toward a first predetermined direction, while allowing the displacement toward a second direction, which is opposite to the first direction, the first spring is provided between the fixed supporting member and the lever to exert spring force on the lever at all times in the direction resisting the depression of the lever, the second spring is provided between the movable supporting member and the lever so that ends of the second spring are in contact with the movable supporting member and the lever in a state where the lever is not depressed and that the second spring exerts spring force on the lever in the direction resisting the depression during depression of the lever, and the third spring is provided between the fixed supporting member and the movable supporting member so that the third spring exerts spring force on the lever in the direction resisting the depression during the displacement of the movable supporting member from the predetermined position toward the second direction.

3. The pedal apparatus of an electronic musical instrument according to claim 1, wherein:

the movable supporting member comprises a first movable supporting member and a second movable supporting member, the fixed supporting member restricts the displacement of the first movable supporting member from a first predetermined position toward a first predetermined direction, while allowing the displacement toward a second direction, which is opposite to the first direction, the first movable supporting member is connected to the lever so that the first movable supporting member conveys a force to the lever, the fixed supporting member restricts the displacement of the second movable supporting member toward the first direction from a second predetermined position, which is apart from the first predetermined position toward the second direction, while allowing the displacement toward the second direction, the first spring is provided between the fixed supporting member and the first movable supporting member to exert spring force through the first movable supporting member on the lever at all times in the direction resisting the depression, the second spring is provided between the first movable supporting member and the second movable supporting member so that in a state where the lever is not depressed, ends of the second spring are in contact with the first movable supporting member and the second movable supporting member, while the second spring exerts spring force on the lever in the direction resisting the depression of the lever during depression of the lever, and the third spring is provided between the fixed supporting member and the second movable supporting member to exert spring force on the lever in the direction resisting the depression during the displacement of the second movable supporting member from the second predetermined position toward the second direction.

4. The pedal apparatus of an electronic musical instrument according to claim 1, wherein:

the movable supporting member comprises a first movable supporting member and a second movable supporting member, the fixed supporting member allows the displacement of the first movable supporting member between a first predetermined position and a second predetermined position, which is away from the first predetermined position toward a first predetermined direction, the fixed supporting member restricts the displacement of the second movable supporting member, which is in contact with the lever, toward a second direction, which is opposite to the first direction, from a third predetermined position, which is away from the first predetermined position toward the second direction, the second movable supporting member is in contact with the first movable supporting member at all times to restrict displacement toward the first direction with respect to the first movable supporting member, the first spring is provided between the fixed supporting member and the lever to exert spring force on the lever at all times in the direction resisting the depression, the second spring is provided between the fixed supporting member and the second movable supporting member to exert spring force on the lever in a direction facilitating the depression until the displacement of the first movable supporting member from the second predetermined position toward the first direction is restricted, and the third spring is provided between the fixed supporting member and the first movable supporting member to exert, during the displacement of the first movable supporting member from the first predetermined position to the second predetermined position, spring force on the lever in the direction resisting the depression.

5. The pedal apparatus of an electronic musical instrument according to claim 1, wherein in a range of the amount of depression smaller than the first amount of depression, when the amount of depression of the lever increases from the initial state to a second predetermined amount of depression, the rate of change in reaction force with respect to the depression is higher between the initial state and the second predetermined amount of depression than between the second predetermined amount of depression and the first predetermined amount due to collaboration of the second spring, the third spring, and the movable supporting member.

6. The pedal apparatus of an electronic musical instrument according to claim 5, wherein:

the fixed supporting member restricts the displacement of the movable supporting member from a predetermined position toward a first predetermined direction, while allowing the displacement toward a second direction opposite to the first direction, the first spring is provided between the fixed supporting member and the lever to exert spring force on the lever at all times in the direction resisting the depression of the lever, the second spring is provided between the movable supporting member and the lever so that in a state where the lever is not depressed, one end of the second spring is away from the movable supporting member or the lever, whereas depressing the lever causes ends of the second spring to come into contact with the movable supporting member and the lever to exert spring force on the lever in the direction resisting the depression of the lever, and the third spring is provided between the fixed supporting member and the movable supporting member so that the third spring exerts spring force on the lever in the direction resisting the depression during the displacement of the movable supporting member from the predetermined position toward the second direction.

7. The pedal apparatus of an electronic musical instrument according to claim 5, wherein:

the movable supporting member comprises a first movable supporting member and a second movable supporting member, the fixed supporting member restricts the displacement of the first movable supporting member from a first predetermined position toward a first predetermined direction, while allowing the displacement toward a second direction, which is opposite to the first direction, the first movable supporting member is connected to the lever so that the first movable supporting member conveys force to the lever, the fixed supporting member restricts the displacement of the second movable supporting member toward the first direction from a second predetermined position, which is away from the first predetermined position toward the second direction, while allowing the displacement toward the second direction, the first spring is provided between the fixed supporting member and the first movable supporting member to exert spring force through the first movable supporting member on the lever at all times in the direction resisting the depression, the second spring is provided between the first movable supporting member and the second movable supporting member so that in a state where the lever is not depressed, one end of the second spring is away from the first movable supporting member or the second movable supporting member, whereas depressing the lever causes ends of the second spring to come into contact with the first movable supporting member and the second movable supporting member to exert spring force on the lever in the direction resisting the depression of the lever, and the third spring is provided between the fixed supporting member and the second movable supporting member to exert spring force on the lever in the direction resisting the depression during the displacement of the second movable supporting member from the second predetermined position toward the second direction.

8. The pedal apparatus of an electronic musical instrument according to claim 5, wherein:

the movable supporting member comprises a first movable supporting member and a second movable member, the fixed supporting member allows the displacement of the first movable supporting member between a first predetermined position and a second predetermined position, which is away from the first predetermined position toward a first predetermined direction, the fixed supporting member restricts the displacement of the second movable supporting member, which is in contact with the lever, toward a second direction opposite to the first direction from a third predetermined position, which is away from the first predetermined position toward the second direction, while the first movable member restricts the displacement toward the first direction with respect to the first movable supporting member by contact with the first movable supporting member, the first spring is provided between the fixed supporting member and the lever to exert spring force on the lever at all times in the direction resisting the depression, the second spring is provided between the fixed supporting member and the second movable supporting member to exert spring force on the lever in a direction facilitating the depression until the displacement of the first movable supporting member from the second predetermined position toward the first direction is restricted with the displacement of the second movable supporting member with respect to the first movable supporting member being restricted, and the third spring is provided between the fixed supporting member and the first movable supporting member to exert spring force on the lever in the direction resisting the depression during the displacement of the first movable supporting member from the first predetermined position to the second predetermined position caused by the contact of the second movable supporting member with the first movable supporting member.

9. A pedal apparatus of an electronic musical instrument comprising:

a fixed supporting member;

a lever supported by the fixed supporting member and pivotable by a player's depression of the lever from an initial state to a final state;

a plurality of springs that exert spring force on the lever; and a movable supporting member that supports any of the plurality of springs and is displaceable in response to pivoting of the lever, wherein the fixed supporting member restricts the displacement of the movable supporting member when an amount of depression of the lever increases from the initial state to a first predetermined amount of depression occurring before the final state, wherein the plurality of springs comprises first and second springs, wherein the first spring exerts spring force on the lever at all times in a direction resisting the depression of the lever, wherein when an amount of depression of the lever increases from the initial state to the first predetermined amount of depression, a rate of change in reaction force with respect to the depression is lower between the initial state and the first predetermined amount of depression than between the first predetermined amount of depression and the final state due to collaboration of the second spring and the movable supporting member, wherein the fixed supporting member restricts the downward displacement of the movable supporting member from a predetermined position, while allowing the upward displacement, the first spring is provided between the fixed supporting member and the lever to exert spring force on the lever at all times in the direction resisting the depression of the lever, and the second spring is provided between the movable supporting member and the lever so that ends of the second spring are in contact with the movable supporting member and the lever in a state where the lever is not depressed and that the second spring exerts spring force on the lever in the direction resisting the depression during depression of the lever.

10. The pedal apparatus of an electronic musical instrument according to claim 9, wherein the movable supporting member is a weight sufficient to restrict its displacement from the initial state until the first amount of depression.

11. A pedal apparatus of an electronic musical instrument comprising:

a fixed supporting member;

a lever supported by the fixed supporting member and pivotable by a player's depression of the lever from an initial state to a final state;

a plurality of springs that exert spring force on the lever; and a movable supporting member that supports any of the plurality of springs and is displaceable in response to pivoting of the lever, wherein the fixed supporting member restricts the displacement of the movable supporting member when an amount of depression of the lever increases from the initial state to a first predetermined amount of depression occurring before the final state, wherein the plurality of springs comprises first and second springs, wherein the first spring exerts spring force on the lever at all times in a direction resisting the depression of the lever, wherein when an amount of depression of the lever increases from the initial state to the first predetermined amount of depression, a rate of change in reaction force with respect to the depression is lower between the initial state and the first predetermined amount of depression than between the first predetermined amount of depression and the final state due to collaboration of the second spring and the movable supporting member, wherein the movable supporting member comprises a first movable supporting member and a second movable supporting member, wherein the fixed supporting member restricts the downward displacement of the first movable supporting member from a first predetermined position, while allowing the upward displacement, wherein the first movable supporting member is connected to the lever so that the first movable supporting member conveys force to the lever, wherein the fixed supporting member restricts the downward displacement of the second movable supporting member from a second predetermined position, which is apart upward from the first predetermined position, while allowing the upward displacement, wherein the first spring is provided between the fixed supporting member and the first movable supporting member to exert spring force through the first movable supporting member on the lever at all times in the direction resisting the depression, and wherein the second spring is provided between the first movable supporting member and the second movable supporting member so that in a state where the lever is not depressed, ends of the second spring are in contact with the first movable supporting member and the second movable supporting member, while the second spring exerts spring force on the lever in the direction resisting the depression of the lever during depression of the lever.

12. The pedal apparatus of an electronic musical instrument according to claim 11, wherein the second movable supporting member is a weight sufficient to restricts its displacement from the initial state until the first amount of depression.

13. A pedal apparatus of an electronic musical instrument comprising:

a fixed supporting member;

a lever supported by the fixed supporting member and pivotable by a player's depression of the lever from an initial state to a final state;

a plurality of springs that exert spring force on the lever; and a movable supporting member that supports any of the plurality of springs and is displaceable in response to pivoting of the lever, wherein the fixed supporting member restricts the displacement of the movable supporting member when an amount of depression of the lever increases from the initial state to a first predetermined amount of depression occurring before the final state, wherein the plurality of springs comprises first and second springs, wherein the first spring exerts spring force on the lever at all times in a direction resisting the depression of the lever, wherein when an amount of depression of the lever increases from the initial state to the first predetermined amount of depression, a rate of change in reaction force with respect to the depression is lower between the initial state and the first predetermined amount of depression than between the first predetermined amount of depression and the final state due to collaboration of the second spring and the movable supporting member, wherein in a range of the amount of depression smaller than the first amount of depression, when the amount of depression of the lever increases from the initial state to a second predetermined amount of depression, the rate of change in reaction force with respect to the depression is higher between the initial state and the second predetermined amount of depression than between the second predetermined amount of depression and the first predetermined amount due to collaboration of the second spring and the movable supporting member, wherein the fixed supporting member restricts the downward displacement of the movable supporting member from a predetermined position, while allowing the upward displacement, wherein the first spring is provided between the fixed supporting member and the lever to exert spring force on the lever at all times in the direction resisting the depression of the lever, and wherein the second spring is provided between the movable supporting member and the lever so that in a state where the lever is not depressed, one end of the second spring is away from the movable supporting member or the lever, whereas depressing the lever causes ends of the second spring to come into contact with the movable supporting member and the lever to exert spring force on the lever in the direction resisting the depression of the lever.

14. The pedal apparatus of an electronic musical instrument according to claim 13, wherein the movable supporting member is a weight sufficient to restrict its displacement from the initial state until the first amount of depression.

15. A pedal apparatus of an electronic musical instrument comprising:

a fixed supporting member;

a lever supported by the fixed supporting member and pivotable by a player's depression of the lever from an initial state to a final state;

a plurality of springs that exert spring force on the lever; and a movable supporting member that supports any of the plurality of springs and is displaceable in response to pivoting of the lever, wherein the fixed supporting member restricts the displacement of the movable supporting member when an amount of depression of the lever increases from the initial state to a first predetermined amount of depression occurring before the final state, wherein the plurality of springs comprises first and second springs, wherein the first spring exerts spring force on the lever at all times in a direction resisting the depression of the lever, wherein when an amount of depression of the lever increases from the initial state to the first predetermined amount of depression, a rate of change in reaction force with respect to the depression is lower between the initial state and the first predetermined amount of depression than between the first predetermined amount of depression and the final state due to collaboration of the second spring and the movable supporting member, wherein in a range of the amount of depression which is smaller than the first amount of depression, when the amount of depression of the lever increases from the initial state to a second predetermined amount of depression, the rate of change in reaction force with respect to the depression is higher between the initial state and the second predetermined amount of depression than between the second predetermined amount of depression and the first predetermined amount due to collaboration of the second spring and the movable supporting member, wherein the movable supporting member comprises a first movable supporting member and a second movable member, wherein the fixed supporting member restricts the downward displacement of the first movable supporting member from a first predetermined position, while allowing upward displacement, wherein the first movable supporting member is connected to the lever so that the first movable supporting member conveys force to the lever, wherein the fixed supporting member restricts the downward displacement of the second movable supporting member from a second predetermined position, which is away upward from the first predetermined position, while allowing upward displacement, wherein the first spring is provided between the fixed supporting member and the first movable supporting member to exert spring force through the first movable supporting member on the lever at all times in the direction resisting the depression, and wherein the second spring is provided between the first movable supporting member and the second movable supporting member so that in a state where the lever is not depressed, one end of the second spring is away from the first movable supporting member or the second movable supporting member, whereas depressing the lever causes ends of the second spring to come into contact with the first movable supporting member and the second movable supporting member to exert spring force on the lever in the direction resisting the depression of the lever.

16. The pedal apparatus of an electronic musical instrument according to claim 15, wherein the second movable supporting member is a weight sufficient to restrict its displacement from the initial state until the first amount of depression.

* * * * *